US011710432B2

(12) United States Patent
Kim et al.

(10) Patent No.: US 11,710,432 B2
(45) Date of Patent: Jul. 25, 2023

(54) DISPLAY PANEL AND METHOD OF TESTING DISPLAY PANEL

(71) Applicant: Samsung Display Co., Ltd., Yongin-si (KR)

(72) Inventors: Hyun Joon Kim, Yongin-si (KR); Jun Ki Jeong, Yongin-si (KR); Kyung Hoon Chung, Yongin-si (KR); Kyung Bae Kim, Yongin-si (KR); Seung Chan Lee, Yongin-si (KR); Chong Chul Chai, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/749,690

(22) Filed: May 20, 2022

(65) Prior Publication Data

US 2022/0277677 A1 Sep. 1, 2022

Related U.S. Application Data

(62) Division of application No. 16/821,706, filed on Mar. 17, 2020, now Pat. No. 11,341,878.

(30) Foreign Application Priority Data

Mar. 21, 2019 (KR) ..... 10-2019-0032503
Aug. 5, 2019 (KR) ..... 10-2019-0095106

(51) Int. Cl.
*G09G 3/00* (2006.01)

(52) U.S. Cl.
CPC ..... *G09G 3/006* (2013.01); *G09G 2300/0842* (2013.01); *G09G 2330/10* (2013.01); *G09G 2330/12* (2013.01)

(58) Field of Classification Search
CPC ..... G09G 3/3233; G09G 3/006; G09G 2310/0262; G09G 2330/12;
(Continued)

(56) References Cited

U.S. PATENT DOCUMENTS 8,054,257 B2 * 11/2011 Kwak ..... G09G 3/006 345/82
8,130,182 B2 * 3/2012 Levey ..... G09G 3/3233 345/82

(Continued)

FOREIGN PATENT DOCUMENTS

CN 109416900 A * 3/2019 ..... G09G 3/006
KR 10-1987434 10/2019

(Continued)

*Primary Examiner* — Vinh T Lam
(74) *Attorney, Agent, or Firm* — Kile Park Reed & Houtteman PLLC

(57) ABSTRACT

A method of testing a display panel including a pixel coupled to first, second, and third power lines, a data line, scan lines, an emission control line, and a test line, the method includes: applying a first power supply voltage to the first power line; applying a test voltage having a turn-on voltage level to the second power line; applying a scan signal having a turn-on voltage level sequentially to the scan lines and an emission control signal having a turn-on voltage level to the emission control line; applying a gate signal to the test line to turn on a test transistor coupled between two electrode of a light emitting element included in the pixel; measuring a sensing voltage output through the data line; and determining whether the pixel is defective, based on a voltage level of the measured sensing voltage.

22 Claims, 27 Drawing Sheets

(58) Field of Classification Search
CPC ..... G09G 2310/0251; G09G 2330/10; G09G 2300/0819; G09G 2300/0861; G09G 2300/0842
See application file for complete search history.

(56) References Cited

U.S. PATENT DOCUMENTS

| | | | | |
|---|---|---|---|---|
| 8,405,587 | B2 * | 3/2013 | Nathan | G09G 3/3233 345/82 |
| 8,890,180 | B2 | 11/2014 | Kimura | |
| 9,018,947 | B2 * | 4/2015 | Jin | G01R 31/2635 324/501 |
| 9,047,822 | B2 | 6/2015 | Iwabuchi et al. | |
| 9,066,408 | B2 | 6/2015 | Choi et al. | |
| 9,379,142 | B2 | 6/2016 | Kimura | |
| 9,390,652 | B2 * | 7/2016 | Chang | G09G 3/3233 |
| 9,468,050 | B1 * | 10/2016 | Rotzoll | G09G 3/3275 |
| 9,489,884 | B2 | 11/2016 | Koyama | |
| 9,715,322 | B2 * | 7/2017 | Teranishi | G06F 3/0412 |
| 9,767,767 | B2 * | 9/2017 | Kong | G09G 5/18 |
| 9,818,347 | B2 * | 11/2017 | Uriostigue | G09G 3/3433 |
| 9,824,632 | B2 * | 11/2017 | Chaji | H05B 47/10 |
| 9,905,164 | B2 * | 2/2018 | Mizukoshi | G09G 3/3233 |
| 9,997,106 | B2 * | 6/2018 | Chaji | G09G 3/3266 |
| 10,013,931 | B2 * | 7/2018 | Iwasa | G09G 3/2022 |
| 10,134,335 | B2 * | 11/2018 | Chaji | G09G 3/3233 |
| 10,152,923 | B2 * | 12/2018 | Li | G09G 3/3233 |
| 10,192,858 | B2 | 1/2019 | Higginson et al. | |
| 10,242,611 | B2 * | 3/2019 | Kenmotsu | G09G 3/006 |
| 10,256,221 | B2 | 4/2019 | Bibl et al. | |
| 10,262,567 | B2 * | 4/2019 | Cok | G09G 3/2003 |
| 10,290,284 | B2 * | 5/2019 | Chaji | G09G 5/10 |
| 10,339,861 | B2 * | 7/2019 | Kim | G09G 3/3233 |
| 10,453,759 | B2 | 10/2019 | Iguchi | |
| 10,497,300 | B2 * | 12/2019 | Xu | G09G 3/3233 |
| 10,629,130 | B2 | 4/2020 | Kim et al. | |
| 10,658,444 | B2 * | 5/2020 | Kang | H10K 59/1213 |
| 10,762,837 | B2 * | 9/2020 | Yang | G09G 3/3233 |
| 10,804,350 | B2 * | 10/2020 | Choi | H10K 59/131 |
| 10,872,562 | B2 * | 12/2020 | Na | G09G 3/3233 |
| 10,878,754 | B2 * | 12/2020 | Kim | G09G 3/3258 |
| 10,916,211 | B2 * | 2/2021 | Nagashima | G09G 3/3688 |
| 10,957,251 | B2 * | 3/2021 | Hwang | G09G 3/3275 |
| 10,996,258 | B2 * | 5/2021 | Chaji | G09G 3/006 |
| 11,011,087 | B2 * | 5/2021 | Yamamoto | G01R 31/2884 |
| 11,030,949 | B2 * | 6/2021 | Chaji | H05B 47/165 |
| 11,030,955 | B2 * | 6/2021 | Chaji | G09G 3/3258 |
| 11,049,439 | B2 * | 6/2021 | Lo | G09G 3/2003 |
| 11,107,420 | B2 * | 8/2021 | Hong | G09G 3/3258 |
| 11,308,874 | B2 * | 4/2022 | Kim | G09G 3/3266 |
| 11,380,256 | B2 * | 7/2022 | Chen | G09G 3/3233 |
| 2002/0047838 | A1 | 4/2002 | Aoki et al. | |
| 2007/0262929 | A1 | 11/2007 | Kim et al. | |
| 2008/0036711 | A1 | 2/2008 | Kwak et al. | |
| 2011/0043500 | A1 | 2/2011 | Kwak et al. | |
| 2013/0038806 | A1 | 2/2013 | Tae et al. | |
| 2013/0257437 | A1 | 10/2013 | Jin et al. | |
| 2013/0321376 | A1 * | 12/2013 | Kim | G09G 3/3233 345/212 |
| 2014/0124745 | A1 | 5/2014 | Jin et al. | |
| 2014/0152336 | A1 | 6/2014 | Sasaki et al. | |
| 2014/0167769 | A1 | 6/2014 | Kim et al. | |
| 2014/0346475 | A1 | 11/2014 | Cho et al. | |
| 2014/0354285 | A1 | 12/2014 | Kim et al. | |
| 2015/0091444 | A1 | 4/2015 | Ebisuno | |
| 2015/0103062 | A1 | 4/2015 | Kwon et al. | |
| 2015/0379910 | A1 * | 12/2015 | Nishinohara | G09G 3/006 345/82 |
| 2016/0043010 | A1 | 2/2016 | Kwak et al. | |
| 2016/0155379 | A1 | 6/2016 | Na | |
| 2016/0267826 | A1 | 9/2016 | Seo | |
| 2016/0284771 | A1 | 9/2016 | Hwang | |
| 2016/0322446 | A1 | 11/2016 | Park et al. | |
| 2016/0372017 | A1 | 12/2016 | Byun et al. | |
| 2016/0372029 | A1 * | 12/2016 | Park | G09G 3/3233 |
| 2017/0076671 | A1 | 3/2017 | Kim et al. | |
| 2017/0141181 | A1 | 5/2017 | Nl et al. | |
| 2017/0269398 | A1 | 9/2017 | Park | |
| 2017/0337860 | A1 | 11/2017 | Yl et al. | |
| 2018/0006105 | A1 | 1/2018 | Kim et al. | |
| 2018/0114500 | A1 | 4/2018 | Jung et al. | |
| 2018/0190712 | A1 | 7/2018 | Xu et al. | |
| 2018/0358339 | A1 | 12/2018 | Iguchi | |
| 2019/0304365 | A1 | 10/2019 | Hyun et al. | |
| 2019/0385513 | A1 | 12/2019 | Iguchi et al. | |
| 2019/0386079 | A1 * | 12/2019 | Kang | G09G 3/3225 |
| 2019/0392758 | A1 * | 12/2019 | Kim | G09G 3/3266 |
| 2019/0392765 | A1 | 12/2019 | Kuk et al. | |
| 2021/0020729 | A1 | 1/2021 | Kitakado | |
| 2021/0335168 | A1 * | 10/2021 | Lee | G09G 3/3233 |

FOREIGN PATENT DOCUMENTS

| | | |
|---|---|---|
| WO | 2017/043216 | 3/2017 |
| WO | 2017/094461 | 6/2017 |

* cited by examiner

DISPLAY PANEL AND METHOD OF TESTING DISPLAY PANEL

CROSS REFERENCE TO RELATED APPLICATION(S)

This is a divisional application of U.S. patent application Ser. No. 16/821,706, filed Mar. 17, 2020 (now pending), the disclosure of which is incorporated herein by reference in its entirety. U.S. patent application Ser. No. 16/821,706 claims priority to and benefit of Korean Patent Application No. 10-2019-0032503 filed on Mar. 21, 2019 and Korean Patent Application No. 10-2019-0095106 filed on Aug. 5, 2019 under 35 U.S.C. § 119 in the Korean Intellectual Property Office, the entire contents of which are incorporated herein by reference.

BACKGROUND

Field

Exemplary embodiments/implementations of the invention relate generally to a display panel and a method of testing the display panel.

Discussion of the Background

A display device displays an image on a display panel using control signals applied from an external device.

The display device may include a plurality of pixels. Each of the pixels may include: a line unit having a scan line, a data line, and a power line; a switching transistor coupled to the line unit; and a light emitting element and a capacitor which are coupled to the switching transistor. The switching transistor may be turned on in response to a signal provided through the line unit so that driving current flows to the light emitting element.

If the switching transistor in the pixel is defective, the pixel may malfunction.

The above information disclosed in this Background section is only for understanding of the background of the inventive concepts, and, therefore, it may contain information that does not constitute prior art.

SUMMARY

Devices and methods according to exemplary embodiments of the invention are directed to a display panel capable of testing whether a pixel is defective, and a method of testing the display panel.

Additional features of the inventive concepts will be set forth in the description which follows, and in part will be apparent from the description, or may be learned by practice of the inventive concepts.

According to one or more exemplary embodiments of the invention, provided is a method of testing a display panel including a pixel coupled to a first power line, a second power line, a third power line, a data line, scan lines, an emission control line, and a test line, the method includes: applying a first power supply voltage and a second power supply voltage to the first power line and the second power line, respectively; applying a test voltage having a turn-on voltage level to the third power line; applying, by a scan driver, a scan signal having a turn-on voltage level sequentially to the scan lines and an emission control signal having a turn-on voltage level to the emission control line; applying, through the test line, a gate signal having a turn-on voltage level to a test transistor coupled between a first pixel electrode and a second pixel electrode of a light emitting element included in the pixel; measuring a sensing voltage output through the data line; and determining whether the pixel is defective, based on a voltage level of the sensing voltage.

The pixel may include: a first transistor including a first electrode coupled to a first node, a second electrode coupled to a second node, and a gate electrode coupled to a third node; a second transistor including a first electrode coupled to the data line, a second electrode coupled to the first node, and a gate electrode coupled to a first scan line; a third transistor including a first electrode coupled to the second node, a second electrode coupled to the third node, and a gate electrode coupled to the first scan line; a fourth transistor including a first electrode coupled to the third power line, a second electrode coupled to the third node, and a gate electrode coupled to a second scan line; a fifth transistor including a first electrode coupled to the first power line, a second electrode coupled to the first node, and a gate electrode coupled to the emission control line; a sixth transistor including a first electrode coupled to the second node, a second electrode coupled to a fourth node, and a gate electrode coupled to the emission control line; a seventh transistor including a first electrode coupled to the third power line, a second electrode coupled to the fourth node, and a gate electrode coupled to a third scan line; and a capacitor coupled between the first power line and the third node. The light emitting element may be coupled between the fourth node and the second power line.

The scan signal may be sequentially provided to the second scan line, the first scan line, and the third scan line.

The scan signal having one pulse may be applied during each frame period.

The applying of the scan signal and the emission control signal may include: applying, during a first period, a scan signal having a turn-on voltage level may to the second scan line; and applying, during a second period, a scan signal having a turn-on voltage level to the first scan line, an emission control signal having a turn-on voltage level to the emission control line, and a gate signal having a turn-on voltage level to the test line.

The applying of the scan signal and the emission control signal may further include: turning on, during the second period, the fifth transistor, the first transistor, the sixth transistor, and the test transistor.

The sensing voltage may be formed at the first node proportional to each of a turn-on resistance of the first transistor, a turn-on resistance of the sixth transistor, and a turn-on resistance of the test transistor, and may be inversely proportional to a turn-on resistance of the fifth transistor.

The determining of the pixel being defective may include determining that the sixth transistor is defective in response to the voltage level of the sensing voltage being equal to or less than a reference voltage level.

The method may further include, before the applying of the first power supply voltage and the second power supply voltage, applying a test voltage having a turn-on voltage level to the third power line; applying, by a scan driver, a scan signal having a turn-on voltage level sequentially to the scan lines and an emission control signal having a turn-off voltage level to the emission control line; measuring a second sensing voltage output through the test line; and determining whether the first to fourth transistors are defective based on the second sensing voltage.

The applying of the first power supply voltage and the second power supply voltage may include: applying the first power supply voltage to the first power line; applying a test voltage having a turn-off voltage level to the third power line; applying, by a scan driver, a scan signal having a turn-on voltage level sequentially to the scan lines and an emission control signal having a turn-on voltage level to the emission control line; measuring a third sensing voltage output through the data line; and determining whether the fifth transistor is defective based on the third sensing voltage.

According to one or more exemplary embodiments of the invention, provided is a method of testing a display panel including a pixel coupled to a first power line, a second power line, a third power line, a data line, scan lines, an emission control line, and a test line, the method includes: applying a first power supply voltage to the first power line; applying a test voltage having a turn-on voltage level to the second power line; applying, by a scan driver, a scan signal having a turn-on voltage level sequentially to the scan lines and an emission control signal having a turn-on voltage level to the emission control line; applying, through the test line, a gate signal having a turn-on voltage level to a test transistor coupled between a first pixel electrode and a second pixel electrode of a light emitting element included in the pixel; measuring a sensing voltage output through the data line; and determining whether the pixel is defective, based on a voltage level of the sensing voltage measured through the data line.

The pixel may include: a first transistor including a first electrode coupled to a first node, a second electrode coupled to a second node, and a gate electrode coupled to a third node; a second transistor including a first electrode coupled to the data line, a second electrode coupled to the first node, and a gate electrode coupled to a first scan line; a third transistor including a first electrode coupled to the second node, a second electrode coupled to the third node, and a gate electrode coupled to the first scan line; a fourth transistor including a first electrode coupled to the third power line, a second electrode coupled to the third node, and a gate electrode coupled to a second scan line; a fifth transistor including a first electrode coupled to the first power line, a second electrode coupled to the first node, and a gate electrode coupled to the emission control line; a sixth transistor including a first electrode coupled to the second node, a second electrode coupled to a fourth node, and a gate electrode coupled to the emission control line; a seventh transistor including a first electrode coupled to the third power line, a second electrode coupled to the fourth node, and a gate electrode coupled to a third scan line; and a capacitor coupled between the first power line and the third node. The light emitting element may be coupled between the fourth node and the second power line.

The scan signal may be sequentially provided to the second scan line, the first scan line, and the third scan line.

The scan signal having two pulses may be applied during each frame period.

The gate signal having one pulse in a section between two pulses may be applied during each frame period.

The applying of the scan signal and the emission control signal may include: applying, during a first period, a scan signal having a turn-on voltage level to the second scan line and the third scan line, and a gate signal having a turn-on voltage level to the test line; and applying, during a second period, a scan signal having a turn-on voltage level to the first scan line.

The determining of the pixel is defective may include determining that the seventh transistor is defective in response to the voltage level of the sensing voltage being equal to or less than a reference voltage level.

The method may further include, before the applying of the first power supply voltage, applying a test voltage having a turn-on voltage level to the third power line; applying, by a scan driver, a scan signal having a turn-on voltage level sequentially to the scan lines and an emission control signal having a turn-off voltage level to the emission control line; measuring a second sensing voltage output through the data line; and determining whether the first to fourth transistors are defective based on the second sensing voltage.

According to one or more exemplary embodiments of the invention, a display panel includes first, second, third, and fourth scan lines; a data line; an emission control line; a first power line; a second power line; a third power line; and a pixel including: a first transistor including a first electrode coupled to a first node, a second electrode coupled to a second node, and a gate electrode coupled to a third node; a second transistor including a first electrode coupled to the data line, a second electrode coupled to the first node, and a gate electrode coupled to a first scan line; a third transistor including a first electrode coupled to the second node, a second electrode coupled to the third node, and a gate electrode coupled to the first scan line; a fourth transistor including a first electrode coupled to the third power line, a second electrode coupled to the third node, and a gate electrode coupled to a second scan line; a fifth transistor including a first electrode coupled to the first power line, a second electrode coupled to the first node, and a gate electrode coupled to the emission control line; a sixth transistor including a first electrode coupled to the second node, a second electrode coupled to a fourth node, and a gate electrode coupled to the emission control line; a seventh transistor including a first electrode coupled to the third power line, a second electrode coupled to the fourth node, and a gate electrode coupled to a third scan line; an eighth transistor including a first electrode coupled to the fourth node, a second electrode coupled to the second power line, and a gate electrode coupled to the fourth scan line; a storage capacitor coupled between the first power line and the third node; and a light emitting element coupled between the fourth node and the second power line.

According to one or more exemplary embodiments of the invention, a display panel includes a substrate having pixels, each of the pixels having an emission area, a first circuit area, and a second circuit area, each of the pixels including: light emitting elements disposed on the substrate in the emission area; a pixel circuit disposed on the substrate in the first circuit area, the pixel circuit comprising: sub-pixel circuits configured to respectively provide driving current to the light emitting elements; and a test circuit disposed on the substrate in the second circuit area, the test circuit comprising: auxiliary transistors coupled in parallel to the respective light emitting elements. Each of the first circuit area and the second circuit area may be disposed adjacent to the emission area.

The display panel may further include scan lines and data lines provided on the substrate. Each of the pixels are defined by the scan lines and the data lines. Each of the sub-pixel circuits may include at least one transistor coupled to the scan lines and the data lines.

The pixel circuit may be disposed in a first direction with respect to the light emitting elements. The test circuit may be disposed in a second direction with respect to the light emitting elements, the second direction being perpendicular to the first direction.

Each of the pixels may further have a peripheral area. Each of the pixels may further include connection lines extending in the peripheral area from the first circuit area to the second circuit area. The auxiliary transistors may be respectively coupled to the light emitting elements through the connection lines.

The display panel may further include an emission capacitor, the emission capacitor formed by at least a part of each of the connection lines extending to the emission area overlapping with a cathode electrode of the corresponding light emitting element. A width of a portion of the connection line that overlaps with the cathode electrode may be greater than a width of a portion of the connection line that does not overlap with the cathode electrode.

The light emitting elements may include a first light emitting element configured to emit light with a first color, a second light emitting element configured to emit light with a second color, and a third light emitting element configured to emit light with a third color.

The cathode electrode of each of the light emitting elements may be coupled to a second power line. The second power line may be disposed on an overall surface of the substrate and include an opening formed in the emission area. Anode electrodes of the light emitting elements may be disposed in the opening.

The second power line may include a first opening and a second opening that are formed in the emission area, the first opening and the second opening being spaced apart from each other with respect to the cathode electrode. At least one of the light emitting elements may be disposed in the first opening, and the rest of the light emitting elements may be disposed in the second opening.

Each of the sub-pixel circuits may include a first semiconductor pattern that forms a channel area of the at least one transistor. The test circuit may include a second semiconductor pattern that forms a channel area of each of the auxiliary transistors. The second semiconductor pattern may be spaced apart from the first semiconductor pattern.

Each of the sub-pixel circuits may include: a first transistor including a first electrode coupled to a first node, a second electrode coupled to a second node, and a gate electrode coupled to a third node; a second transistor including a first electrode coupled to the data line, a second electrode coupled to the first node, and a gate electrode coupled to a first scan line; a third transistor including a first electrode coupled to the second node, a second electrode coupled to the third node, and a gate electrode coupled to the first scan line; a fourth transistor including a first electrode coupled to a third power line, a second electrode coupled to the third node, and a gate electrode coupled to a second scan line; a fifth transistor including a first electrode coupled to a first power line, a second electrode coupled to the first node, and a gate electrode coupled to an emission control line; a sixth transistor including a first electrode coupled to the second node, a second electrode coupled to a fourth node, and a gate electrode coupled to the emission control line; a seventh transistor including a first electrode coupled to the third power line, a second electrode coupled to the fourth node, and a gate electrode coupled to a third scan line; and a storage capacitor coupled between the first power line and the third node. An anode electrode of one of the light emitting elements may be coupled to the fourth node.

The display panel may further include: a pixel circuit layer disposed on the substrate; and a light emitting element layer disposed on the pixel circuit layer. The pixel circuit layer may include the first to the seventh transistors, the auxiliary transistors, and the storage capacitor. The light emitting element layer may include the light emitting elements, and anode electrodes and cathode electrodes of the light emitting elements may be disposed on an identical layer.

Each of the light emitting elements may include a first semiconductor layer, an intermediate layer, and a second semiconductor layer that are sequentially stacked. Each of the anode electrodes may be coupled to the first semiconductor layer through a first contact electrode. The cathode electrode may be coupled to the second semiconductor layer through a second contact electrode.

The pixel circuit layer may include a first insulating layer, a second insulating layer, a third insulating layer, a fourth insulating layer, and a fifth insulating layer that are sequentially stacked on the substrate. A semiconductor pattern of the auxiliary transistor may be disposed between the substrate and the first insulating layer. A gate electrode of the auxiliary transistor may be disposed between the first insulating layer and the second insulating layer. The third power line may be disposed between the second insulating layer and the third insulating layer. A first electrode and a second electrode of the auxiliary transistor may be disposed between the third insulating layer and the fourth insulating layer. The first power line may be disposed between the fourth insulating layer and the fifth insulating layer.

The first electrode of the sixth transistor may be coupled to the anode electrode of the light emitting element through a bridge pattern interposed between the fourth insulating layer and the fifth insulating layer. The cathode electrode of the light emitting element may be integrally formed with a second power line disposed on a layer identical with a layer on which the cathode electrode is disposed.

The bridge pattern may partially overlap with the second power line. The second power line, the fifth insulating layer, and the bridge pattern may form an emission capacitor.

According to one or more exemplary embodiments of the invention, a display panel includes: data lines extending in a first direction; scan lines extending in a second direction intersecting the first direction; and unit pixels coupled to the data lines and the scan lines. Each of the unit pixels may include first pixel, second pixel, third pixel, and fourth pixel disposed adjacent to each other in the first direction and the second direction. Each of the first to fourth pixels may include: light emitting elements provided in an emission area; a pixel circuit provided in a first circuit area, the pixel circuit including sub-pixel circuits configured to respectively provide driving current to the light emitting elements; and a test circuit provided in a second circuit area, the test circuit including auxiliary transistors coupled in parallel to the respective light emitting elements.

The first circuit area may be disposed between the emission areas of two pixels adjacent in the first direction. The second circuit area may be disposed between the emission areas of two pixels adjacent in the second direction. Each of the sub-pixel circuits may include at least one transistor coupled to the scan lines and the data lines.

The display panel may further include a scan driver coupled to the scan lines and configured to provide a scan signal to the scan lines. The scan driver may be disposed between two unit pixels adjacent to each other in the second direction among the unit pixels.

According to one or more exemplary embodiments of the invention, a display panel including: a substrate including an emission area, a first circuit area, and a second circuit area; a light emitting element provided in the emission area; a first pixel circuit provided in the first circuit area and including at least one transistor, the first pixel circuit being configured to provide driving current corresponding to a data signal supplied through a data line to the light emitting element in response to a scan signal provided through a scan line; and a test circuit provided in the second circuit area and including at least one auxiliary transistor coupled in parallel to the light emitting element.

The substrate may include a pixel area defined by the scan line and the data line. The pixel area may include the emission area, the first circuit area, and the second circuit area.

The emission area may be disposed between the first circuit area and the second circuit area.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1A:
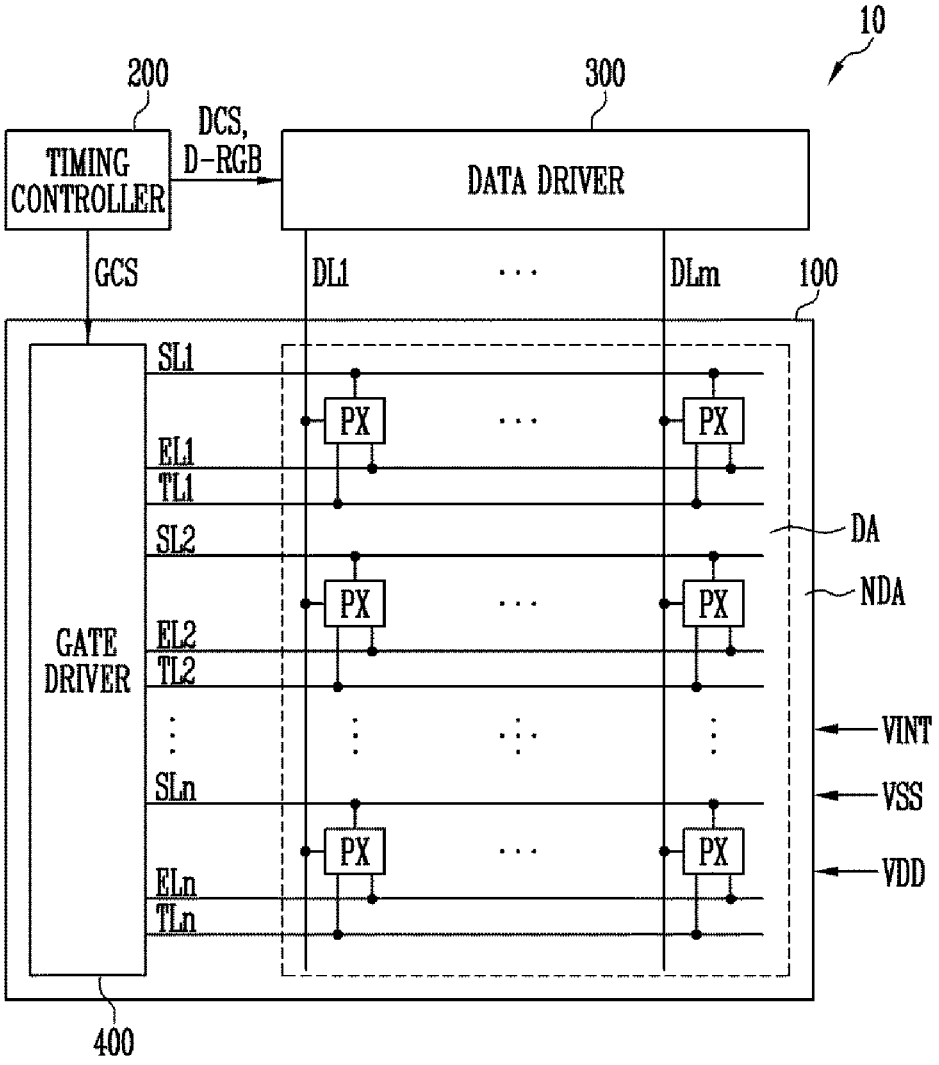
FIGS. 1A and 1B are diagrams illustrating a display device in accordance with an exemplary embodiment of the present disclosure.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process may be performed differently from the described order. For example, two consecutively described processes may be performed substantially at the same time or performed in an order opposite to the described order. Also, like reference numerals denote like elements.

When an element or a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, a DR1-axis, a DR2-axis, and a DR3-axis are not limited to three axes of a rectangular coordinate system, such as the x, y, and z-axes, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein should be interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 1B:
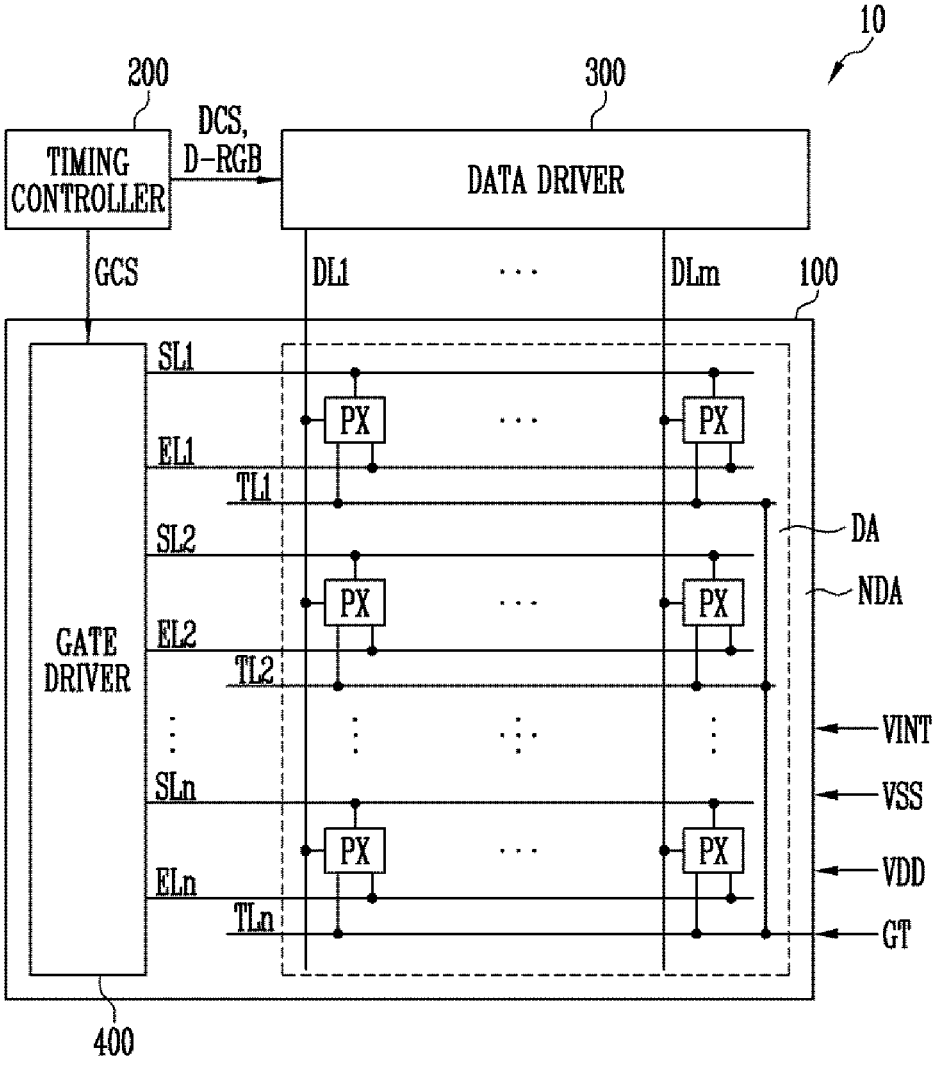

FIGS. 1A and 1B are diagrams illustrating a display device 10 in accordance with an exemplary embodiment of the present disclosure.

Referring to FIGS. 1A and 1B, the display device 10 may include a display panel 100, a timing controller 200, a data driver 300, and a scan driver 400.

The display panel 100 may include a display area DA on which an image is displayed, and a non-display area NDA excluded from the display area DA. The non-display area NDA may be disposed on one side of the display area DA or formed to enclose the display area DA, but it is not limited thereto.

The display panel 100 may include signal lines and pixels PX. The signal lines may include data lines DL1 to DLm (here, m is a positive integer), scan lines SL1 to SLn (here, n is a positive integer), emission control lines EL1 to ELn, and test lines TL1 to TLn. The pixels PX may be provided in the display area DA and disposed in areas defined by the data lines DL1 to DLm, the scan lines SL1 to SLn, and the emission control lines EL1 to ELn. The pixels PX may be electrically coupled to the data lines DL1 to DLm, the scan lines SL1 to SLn, the emission control lines EL1 to ELn, and the test lines TL1 to TLn.

For example, a pixel PX that is disposed on a first row and a first column may be coupled to the first data line DL1, the first scan line SL1, the first emission control line EL1, and the first test line TL1. For example, a pixel PX that is disposed on an n-th row and an m-th column may be coupled to the m-th data line DLm, the n-th scan line SLn, the n-th emission control line ELn, and the n-th test line TLn.

However, the connection of the pixels PX is not limited thereto. For instance, each pixel PX may be electrically coupled to scan lines (e.g., a scan line corresponding to a row preceding the row including the pixel PX and a scan line corresponding to a row following the row including the pixel PX) corresponding to rows adjacent to the pixel PX. Although not illustrated, the pixels PX may be electrically coupled with power lines, e.g., a first power line (e.g., "PL1" in FIG. 2), a second power line (e.g., "PL2" in FIG. 2), and an initialization power line (e.g., "PL3" in FIG. 2), to receive a first power supply voltage VDD, a second power supply voltage VSS, and an initialization voltage VINT. Here, the first power supply voltage VDD and the second power supply voltage VSS may be voltages required to drive the pixels PX. The initialization voltage VINT may be a voltage which is used to initialize the pixels PX (or internal components of the pixels PX). The first power supply voltage VDD, the second power supply voltage VSS, and the initialization voltage VINT each may be provided from a separate power supply.

Each pixel PX may emit light at a luminance corresponding to a data signal provided through the corresponding data line in response to a scan signal provided through the scan line and an emission control signal provided through the corresponding emission control line. Detailed configuration and operation of the pixel PX will be described later herein with reference to FIG. 2.

The timing controller 200 may receive a control signal and input image data (e.g., RGB data) from an external device (e.g., a graphic processor), and generate a scan control signal GCS and a data control signal DCS based on the control signal. Here, the control signal may include a clock signal, a horizontal synchronization signal, a data enable signal, etc. The scan control signal GCS may be a signal for controlling the operation of the scan driver 400, and include a start signal (or a scan start signal), clock signals (or scan clock signals), etc. The scan control signal GCS may further include an emission start signal, emission clock signals, etc. The data control signal DCS may be a signal for controlling the operation of the data driver 300, and include a load signal (or a data enable signal) for instructing to output a valid data signal.

The timing controller 200 may convert the input image data to image data D-RGB corresponding to a pixel array of the display panel 100, and output the image data D-RGB.

The data driver 300 may generate a data signal based on the data control signal DCS and the image data D-RGB, and provide the data signal to the data lines DL1 to DLm.

The data driver 300 may be implemented as an IC, and may be coupled to the display panel 100 in the form of a tape carrier package (TCP) or formed in the non-display area NDA of the display panel 100.

The scan driver 400 may generate a scan signal based on the scan control signal GCS and provide the scan signal to the scan lines SL1 to SLn. For example, the scan driver 400 may sequentially generate and output scan signals corresponding to a start signal (e.g., scan signals having waveforms equal or similar to that of the start signal) using clock signals. The scan driver 400 may include a shift register. Although the scan driver 400 may be formed in the non-display area NDA of the display panel 100, it is not limited thereto. The scan driver 400 may be implemented as an IC and coupled to the display panel 100 in the form of a TCP.

The scan driver 400 may generate an emission control signal and provide the emission control signal to the emission control lines EL1 to ELn. For example, the scan driver 400 may sequentially generate and output emission control signals corresponding to an emission start signal using emission clock signals.

In embodiments, the scan driver 400 may generate gate signals (or test control signals) and sequentially provide the gate signals to the test lines TL1 to TLn. For example, the scan driver 400 may sequentially generate and output gate signals corresponding to a test start signal.

Although FIG. 1A illustrates that the scan driver 400 generates emission control signals, the present disclosure is not limited thereto. For example, an emission driver separated from the scan driver 400 may be included in the display device 10 to generate emission control signals.

Furthermore, although FIG. 1A illustrates that the test lines TL1 to TLn are coupled to the scan driver 400, the present disclosure is not limited thereto. For example, as illustrated in FIG. 1B, the test lines TL1 to TLn may be electrically coupled to each other and receive gate signals GT from an external device (e.g., a test device which is used to test the display device 10.) The operation of the display panel 100 (or the pixels PX) in response to gate signals GT will be described later herein with reference to FIGS. 8, 9A, 9B, 10, 11A, and 11B.

Figure 2:
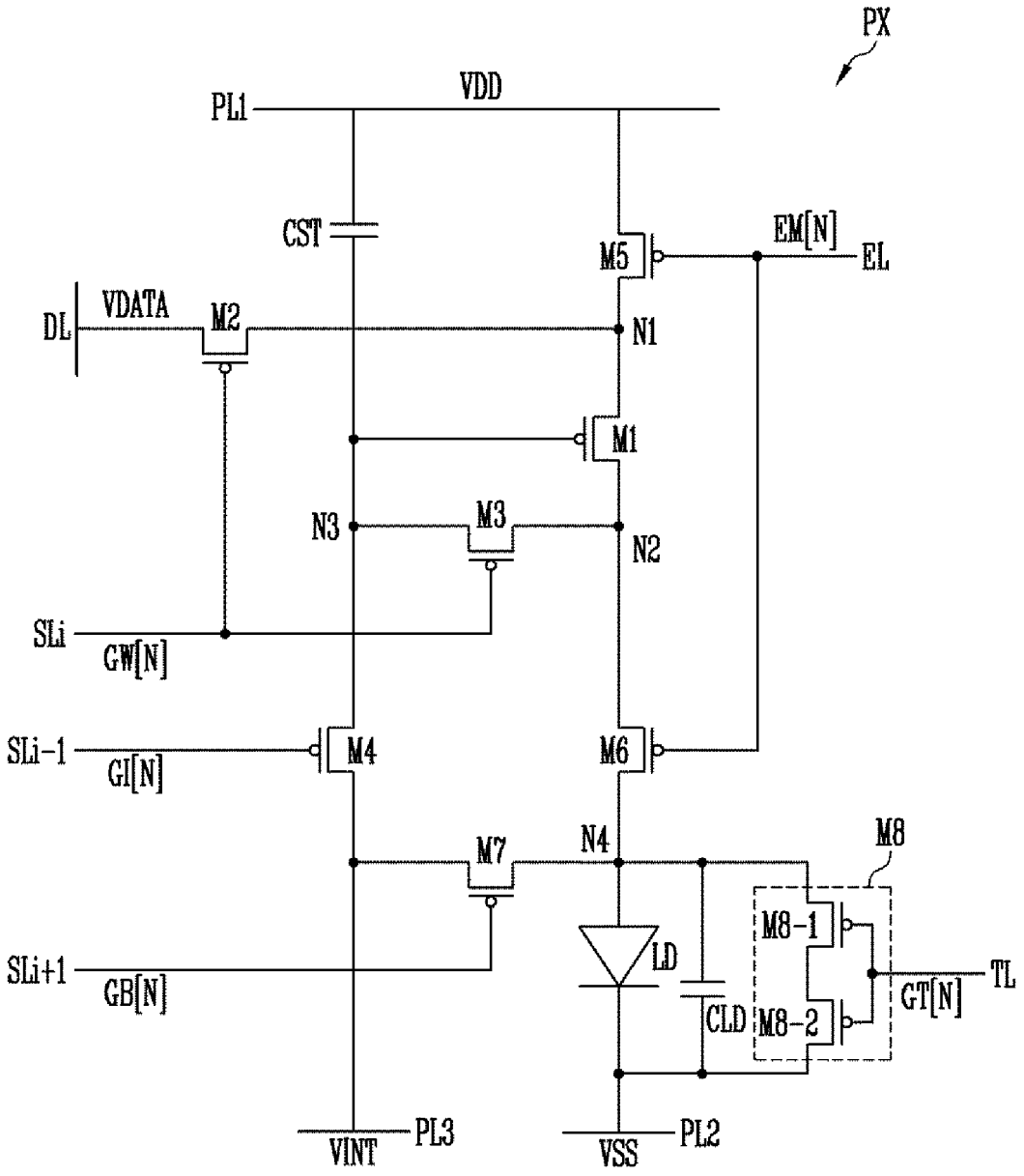
FIG. 2 is a circuit diagram illustrating an example of a pixel included in the display device of FIG. 1A.

FIG. 2 is a circuit diagram illustrating an example of a pixel PX included in the display device 10 of FIG. 1A.

Referring to FIGS. 1A and 2, the pixel PX may include first to eighth transistors M1 to M8, a storage capacitor CST, and a light emitting element LD. The pixel PX may further include an emission capacitor (or a capacitor) CLD.

Each of the first transistor M1, the second transistor M2, the third transistor M3, the fourth transistor M4, the fifth transistor M5, the sixth transistor M6, the seventh transistor M7, and the eighth transistor M8 may be formed of a P-type transistor (e.g., a PMOS transistor), but the present disclosure is not limited thereto. For example, at least some of the first transistor M1, the second transistor M2, the third transistor M3, the fourth transistor M4, the fifth transistor M5, the sixth transistor M6, the seventh transistor M7, and the eighth transistor M8 may be formed of N-type transistors (e.g., NMOS transistors).

The first transistor (or driving transistor) M1 may include a first electrode electrically coupled to a first node N1, a second electrode electrically coupled to a second node N2, and a gate electrode electrically coupled to a third node N3.

The second transistor (or switching transistor) M2 may include a first electrode coupled to a data line DL, a second electrode coupled to the first node N1, and a gate electrode coupled to a first scan line SLi (here, i is an integer of 2 or more). The second transistor M2 may be turned on in response to a first scan signal GW[N] (here, N is a positive integer) provided through the first scan line SLi, and transmit, to the first node N1, a data signal VDATA provided through the data line DL. For example, the first scan signal GW[N] may be a pulse signal including at least one pulse having a turn-on voltage level for turning on a transistor.

The third transistor M3 may include a first electrode coupled to the second node N2, a second electrode coupled to the third node N3, and a gate electrode coupled to the first scan line SLi. The third transistor M3 may be turned on in response to the first scan signal GW[N], and transmit, to the third node N3, the data signal VDATA transmitted from the first node N1 through the first transistor M1.

The storage capacitor CST may be coupled between a first power line PL1 and the third node N3. Here, a first power supply voltage VDD may be applied to the first power line PL1. The storage capacitor CST may store the data signal VDATA transmitted to the third node N3.

The fourth transistor M4 may include a first electrode coupled to the third node N3, a second electrode coupled to an initialization power line (or a third power line) PL3, and a gate electrode coupled to a second scan line (or a preceding scan line) SLi−1. The second scan line SLi−1 may be a scan line that is disposed adjacent to the first scan line SLi and receives a scan signal earlier than does the first scan line SLi. The fourth transistor M4 may be turned on in response to a second scan signal GI[N] provided through the second scan line SLi−1 and initialize the third node N3 using an initialization voltage VINT provided through the initialization power line PL3. In other words, a node voltage (or a data signal VDATA stored in the storage capacitor CST during a preceding frame) of the third node N3 may be initialized by the initialization voltage VINT.

The fifth transistor M5 may include a first electrode coupled to the first power line PL1, a second electrode coupled to the first node N1, and a gate electrode coupled to the emission control line EL. Likewise, the sixth transistor M6 may include a first electrode coupled to the second node N2, a second electrode coupled to a fourth node N4, and a gate electrode coupled to the emission control line EL. The fifth transistor M5 and the sixth transistor M6 may be turned on in response to an emission control signal EM[N] provided through the emission control line EL, and form a flow path for driving current between the first power line PL1 and the fourth node N4 (or between the first power line PL1 and the second power line PL2).

The light emitting element (or light emitting diode) LD may include an anode electrode (or a first pixel electrode) coupled to the fourth node N4, and a cathode electrode (or a second pixel electrode) coupled to the second power line PL2. For example, the light emitting element LD may be an organic light emitting diode or an inorganic light emitting diode. The light emitting element LD may emit light with a luminance corresponding to driving current (or the amount of driving current).

The emission capacitor CLD may be coupled in parallel to the light emitting element LD and prevent or suppress the light emitting element LD from emitting light due to leakage current drawn into the fourth node N4, e.g., through the sixth transistor M6.

The seventh transistor M7 may include a first electrode coupled to the fourth node N4, a second electrode coupled to the initialization power line PL3, and a gate electrode coupled to a third scan line (a following scan line) SLi+1. The third scan line SLi+1 may be a scan line that is disposed adjacent to the first scan line SLi and receives a scan signal later than does the first scan line SLi. The seventh transistor M7 may initialize the fourth node N4 (or the emission capacitor CLD) in response to a third scan signal GB[N].

The eighth transistor (or test transistor) M8 may include a first electrode electrically coupled to the fourth node N4, a second electrode coupled to the second power line PL2, and a gate electrode coupled to a test line (or a fourth scan line) TL. The eighth transistor M8 may form a current flow path bypassing the light emitting element LD, in response to a gate signal GT[N] provided through the test line TL. The eighth transistor M8 may not be operated during a normal driving operation of the display device 10 (in other words, while the display device 10 normally displays an image after a test has been completed).

In embodiments, the eighth transistor M8 may include first and second sub-transistors M8-1 and M8-2 coupled in series between the fourth node N4 and the second power line PL2. The first and second sub-transistors M8-1 and M8-2 may be turned on/off in response to a gate signal GT[N] provided through the test line TL. In other words, the eighth transistor M8 may be implemented as a dual gate transistor. In this case, while the display device 10 is normally operated, leakage current through the eighth transistor M8 may be interrupted or reduced.

Hereinafter, a method of testing the display panel 100 in accordance with an exemplary embodiment of the present disclosure will be described with reference to FIGS. 3, 4, 5, 6, 7A, 7B, 8, 9A, 9B, and 10.

Figure 3:
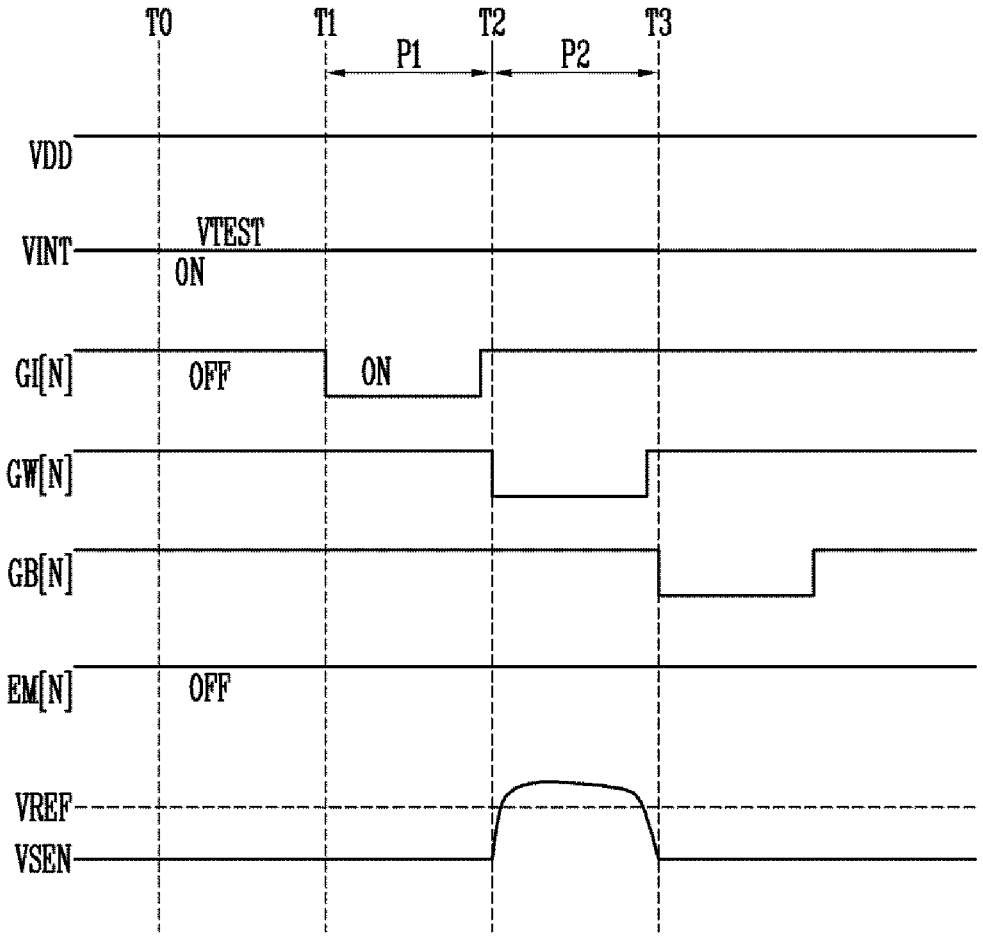
FIG. 3 is a waveform diagram illustrating signals measured in the pixel of FIG. 2 in accordance with an exemplary embodiment.
Figure 4:
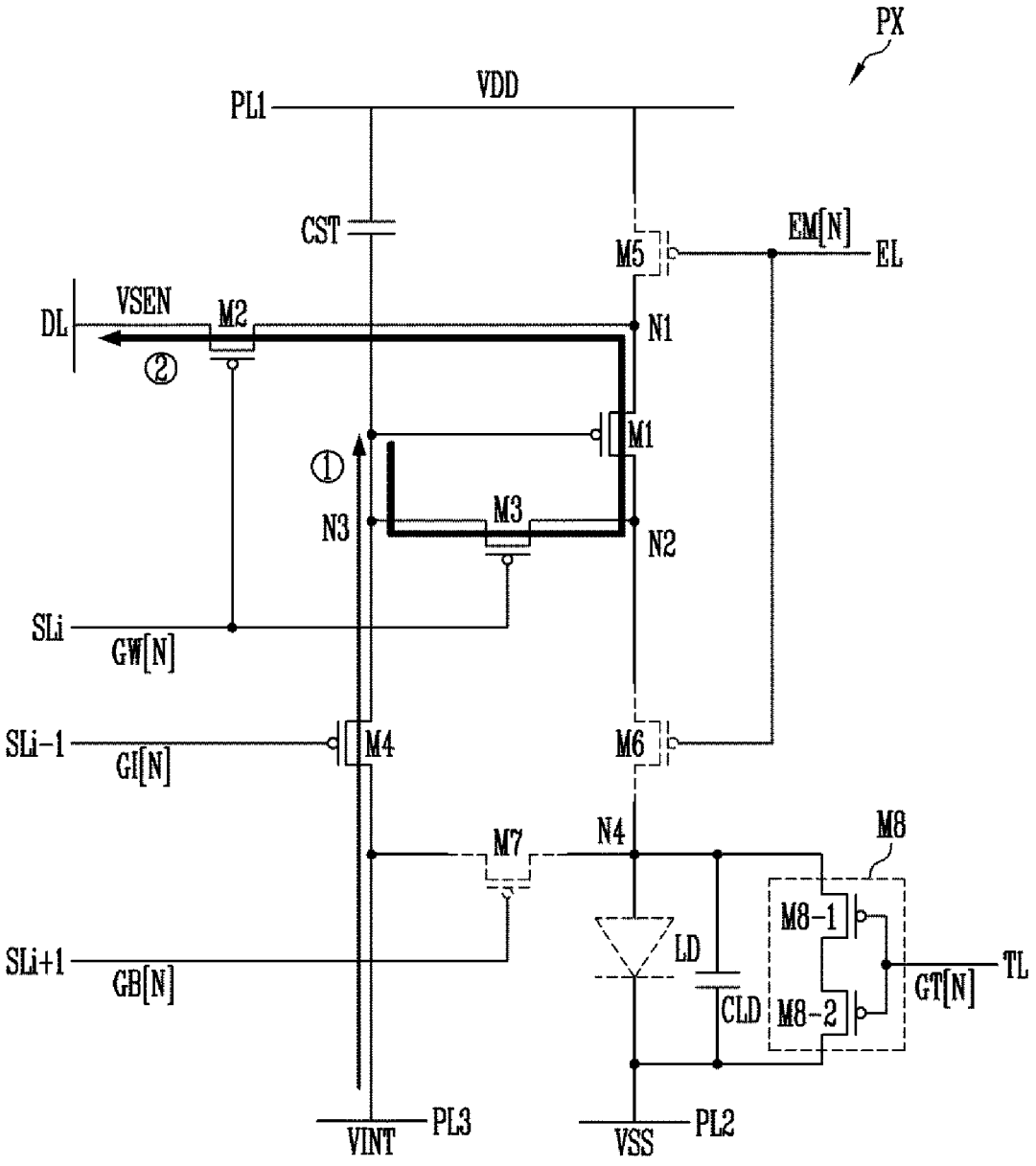
FIG. 4 is a diagram for describing an operation of a pixel in response to signals of FIG. 3.

FIG. 3 is a waveform diagram illustrating signals measured in the pixel PX of FIG. 2 in accordance with an exemplary embodiment. FIG. 4 is a diagram for describing an operation of a pixel PX in response to signals of FIG. 3. The pixel PX may be any one selected from among the pixels PX illustrated in FIG. 1A. FIGS. 3 and 4 illustrate a test method of determining whether the first to fourth transistors M1 to M4 provided in the pixel PX are defective.

Referring to FIGS. 1A, 3, and 4, at a reference time point TO, a test on the display panel 100 may start.

The first power supply voltage VDD may be applied to the first power line PL1. Furthermore, a test voltage VTEST having a turn-on voltage level may be applied to the initialization power line PL3. In other words, an initialization voltage VINT having the same voltage level (i.e., the turn-on voltage level) as that of the test voltage VTEST may be measured. Here, the turn-on voltage level may correspond to a voltage level for turning on a transistor (e.g., any one of the first transistor M1, the second transistor M2, the third transistor M3, the fourth transistor M4, the fifth transistor M5, the sixth transistor M6, the seventh transistor M7, and the eighth transistor M8 of FIG. 4). A turn-off voltage level may correspond to a voltage level for turning off a transistor (e.g., any one of the first transistor M1, the second transistor M2, the third transistor M3, the fourth transistor M4, the fifth transistor M5, the sixth transistor M6, the seventh transistor M7, and the eighth transistor M8 of FIG. 4).

Thereafter, a start signal (or a scan start signal) having a turn-on voltage level may be applied to the scan driver 400 described with reference to FIG. 1A. In response to this, the scan driver 400 may sequentially output scan signals having a turn-on voltage level to the scan lines SL1 to SLn. An emission start signal having a turn-off voltage level may be applied to the scan driver 400.

In this case, at a first time point T1, the level of the second scan signal GI[N] may be changed from a turn-off voltage level to a turn-on voltage level in response to the start signal (or the scan start signal). During at least a portion of a first period P1, the level of the second scan signal GI[N] may be maintained at the turn-on voltage level. Here, the width of the first period P1 (and a second period P2) may correspond to a first horizontal period (i.e., a time allocated for driving one pixel rod). Each frame period may include horizontal periods.

During the first period P1, the level of each of the first scan signal GW[N] and the third scan signal GB[N] may be maintained at a turn-off voltage level, and the level of the emission control signal EM[N] may also be maintained at a turn-off voltage level.

In this case, as illustrated in FIG. 4, the fourth transistor M4 may be turned on in response to the second scan signal GI[N] having the turn-on voltage level, and the test voltage VTEST applied to the initialization power line PL3 may be transmitted to the third node N3. The storage capacitor CST may store the test voltage VTEST. The first transistor M1 may be turned on in response to the test voltage VTEST.

The second, third, fifth, sixth, seventh, and eighth transistors M2, M3, M5, M6, M7, and M8 may remain turned off.

Referring to FIG. 3 again, at a second time point T2, the first scan signal GW[N] may make a transition from the turn-off voltage level to the turn-on voltage level. During the second period P2, the level of the first scan signal GW[N] may be maintained at the turn-on voltage level.

The level of the second scan signal GI[N] may be changed to the turn-off voltage level before the second time point T2 and be maintained at the turn-off voltage level during the second period P2.

In this case, as illustrated in FIG. 4, the second and third transistors M2 and M3 may be turned on in response to the first scan signal GW[N] having the turn-on voltage level. The third node N3 may be electrically coupled with the data line DL through the first to third transistors M1 to M3. Hence, the test voltage VTEST may be provided to the data line DL, and a sensing voltage VSEN corresponding to the test voltage VTEST may be measured.

Although the sensing voltage VSEN may have a partially distorted shape, e.g., due to charge/discharge characteristics of the storage capacitor CST and a signal transmission delay, the sensing voltage VSEN may have a pulse shape corresponding to the first scan signal GW [N].

Thereafter, in the test method, whether the pixel PX (or pixel circuit) is defective may be determined based on the voltage level of the sensing voltage VSEN.

For example, the test method may include comparing the sensing voltage VSEN with a preset reference voltage VREF, and determining that a failure has occurred on at least one of the first to fourth transistors M1 to M4 when the sensing voltage VSEN is equal to or less than the reference voltage VREF.

As described with reference to FIGS. 3 and 4, the method of testing the display panel 100 may include: applying a start signal (or a scan start signal) having a turn-on voltage level to the scan driver 400 (i.e., sequentially applying scan signals to the scan lines SL1 to SLn) in a state in which a test voltage VTEST having a turn-on voltage level has been applied to the initialization power line PL3; and measuring a sensing voltage VSEN on the data line DL, thus determining whether the first to fourth transistors M1 to M4 in the pixel PX are defective.

Figure 5:
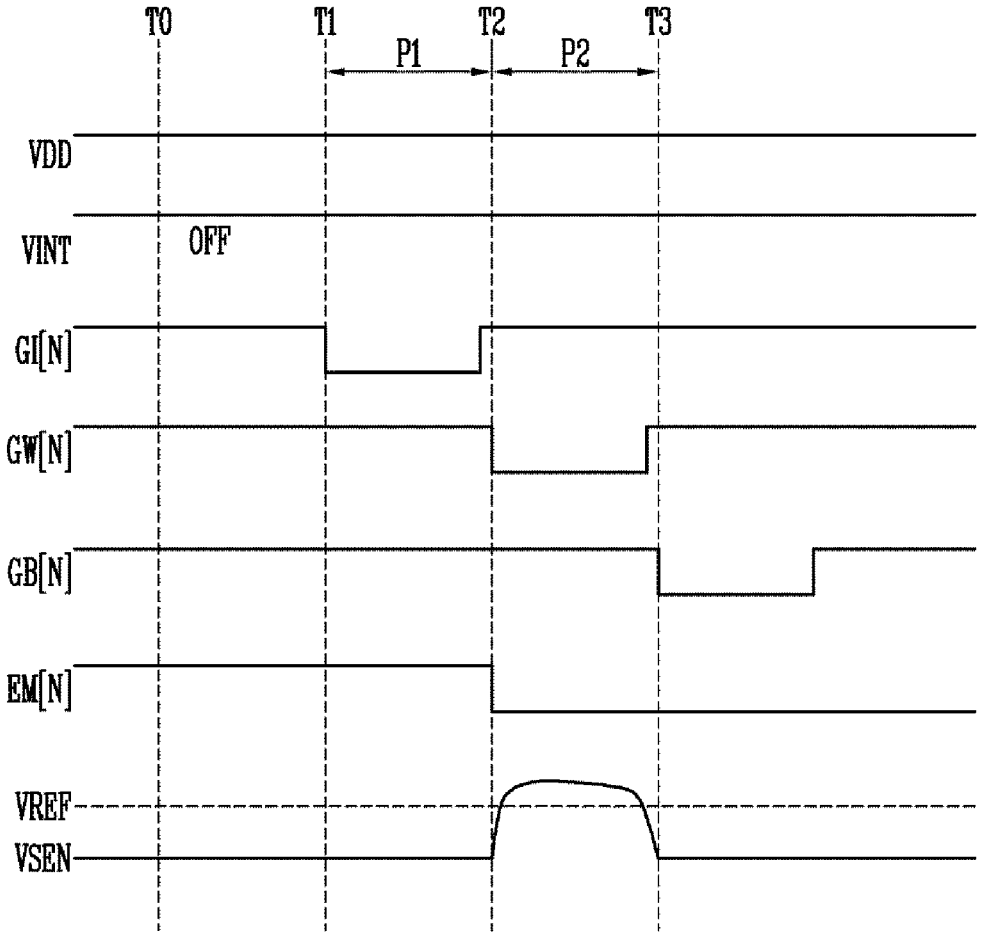
FIG. 5 is a waveform diagram illustrating signals measured in the pixel of FIG. 2 in accordance with an exemplary embodiment.
Figure 6:
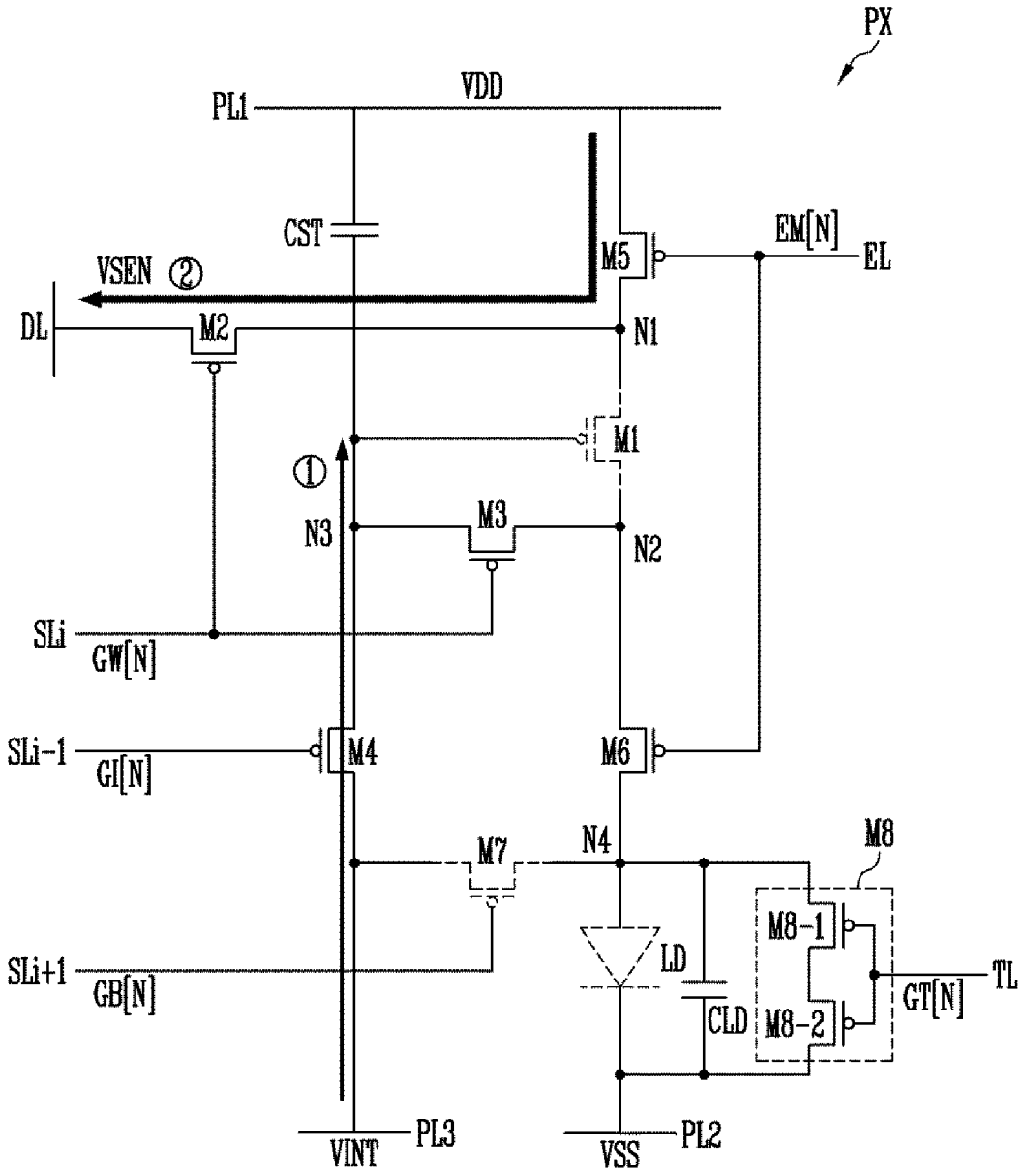
FIG. 6 is a diagram for describing an operation of the pixel in response to signals of FIG. 5.

FIG. 5 is a waveform diagram illustrating signals measured in the pixel PX of FIG. 2 in accordance with an exemplary embodiment. FIG. 6 is a diagram for describing an operation of the pixel PX in response to the signals of FIG. 5. FIGS. 5 and 6 illustrate a test method of determining whether the fifth transistor M5 provided in the pixel PX is defective. The test method to be described with reference to FIGS. 5 and 6 may be performed after (or before) the test operation described with reference to FIGS. 3 and 4.

Referring to FIGS. 1A, 5, and 6, at the reference time point TO, a test on the display panel 100 may start.

The first power supply voltage VDD may be applied to the first power line PL1. Furthermore, a test voltage VTEST having a turn-off voltage level may be applied to the initialization power line PL3. In other words, an initialization voltage VINT having the same voltage level (i.e., the turn-off voltage level) as that of the test voltage VTEST may be measured.

Thereafter, a start signal (or a scan start signal) having a turn-on voltage level and an emission start signal having a turn-on voltage level may be simultaneously applied to the scan driver 400 described with reference to FIG. 1A. In response to this, the scan driver 400 may sequentially output scan signals having a turn-on voltage level to the scan lines SL1 to SLn, and may also sequentially output emission control signals having a turn-on voltage level to the emission control lines EL1 to ELn.

In this case, at a first time point T1, the level of the second scan signal GI[N] may be changed from a turn-off voltage level to a turn-on voltage level in response to the start signal (or the scan start signal). During at least a portion of a first period P1, the level of the second scan signal GI[N] may be maintained at the turn-on voltage level.

During the first period P1, the level of each of the first scan signal GW[N] and the third scan signal GB[N] may be maintained at a turn-off voltage level, and the level of the emission control signal EM[N] may also be maintained at a turn-off voltage level.

In this case, as illustrated in FIG. 6, the fourth transistor M4 may be turned on in response to the second scan signal GI[N] having the turn-on voltage level, and the test voltage VTEST (i.e., the voltage having the turn-off voltage level) applied to the initialization power line PL3 may be transmitted to the third node N3. The storage capacitor CST may store the test voltage VTEST. The first transistor M1 may be turned off in response to the test voltage VTEST having the turn-off voltage level.

The second, third, fifth, sixth, seventh, and eighth transistors M2, M3, M5, M6, M7, and M8 may remain turned off.

Referring to FIG. 5 again, at the second time point T2, the first scan signal GW[N] may make a transition from the turn-off voltage level to the turn-on voltage level. During the second period P2, the first scan signal GW[N] may be maintained at the turn-on voltage level. Likewise, the emission control signal EM[N] may make a transition from the turn-off voltage level to the turn-on voltage level. During the second period P2, the emission control signal EM[N] may be maintained at the turn-on voltage level. The pulse width of the emission control signal EM[N] may be greater than that of the first scan signal GW[N], but the present disclosure is not limited thereto.

The level of the second scan signal GI[N] may be changed to the turn-off voltage level before the second time point T2 and be maintained at the turn-off voltage level during the second period P2.

In this case, as illustrated in FIG. 6, the second and third transistors M2 and M3 may be turned on in response to the first scan signal GW[N] having the turn-on voltage level, and the fifth and sixth transistors M5 and M6 may be turned on in response to the emission control signal EM[N] having the turn-on voltage level. The first power line PL1 may be electrically coupled with the data line DL through the fifth transistor M5 and the second transistor M2. Hence, the first power supply voltage VDD applied to the first power line PL1 may be provided to the data line DL, and a sensing voltage VSEN corresponding to the first power supply voltage VDD may be measured.

Thereafter, in the test method, whether the pixel PX (or pixel circuit) is defective may be determined based on the voltage level of the sensing voltage VSEN.

For example, the test method may include comparing the sensing voltage VSEN with a preset reference voltage VREF, and determining that a failure has occurred on the fifth transistor M5 when the sensing voltage VSEN is equal to or less than the reference voltage VREF.

As described with reference to FIGS. 5 and 6, the method of testing the display panel 100 may include: applying a start signal (or a scan start signal) having a turn-on voltage level and an emission start signal having a turn-on voltage level to the scan driver 400 (i.e., sequentially applying scan signals to the scan lines SL1 to SLn and, simultaneously, sequentially applying emission control signals to the emission control lines EL1 to ELn) in a state in which a test voltage VTEST having a turn-off voltage level has been applied to the initialization power line PL3; and measuring a sensing voltage VSEN on the data line DL, thus determining whether the fifth transistors M5 in the pixel PX is defective.

Figure 7A:
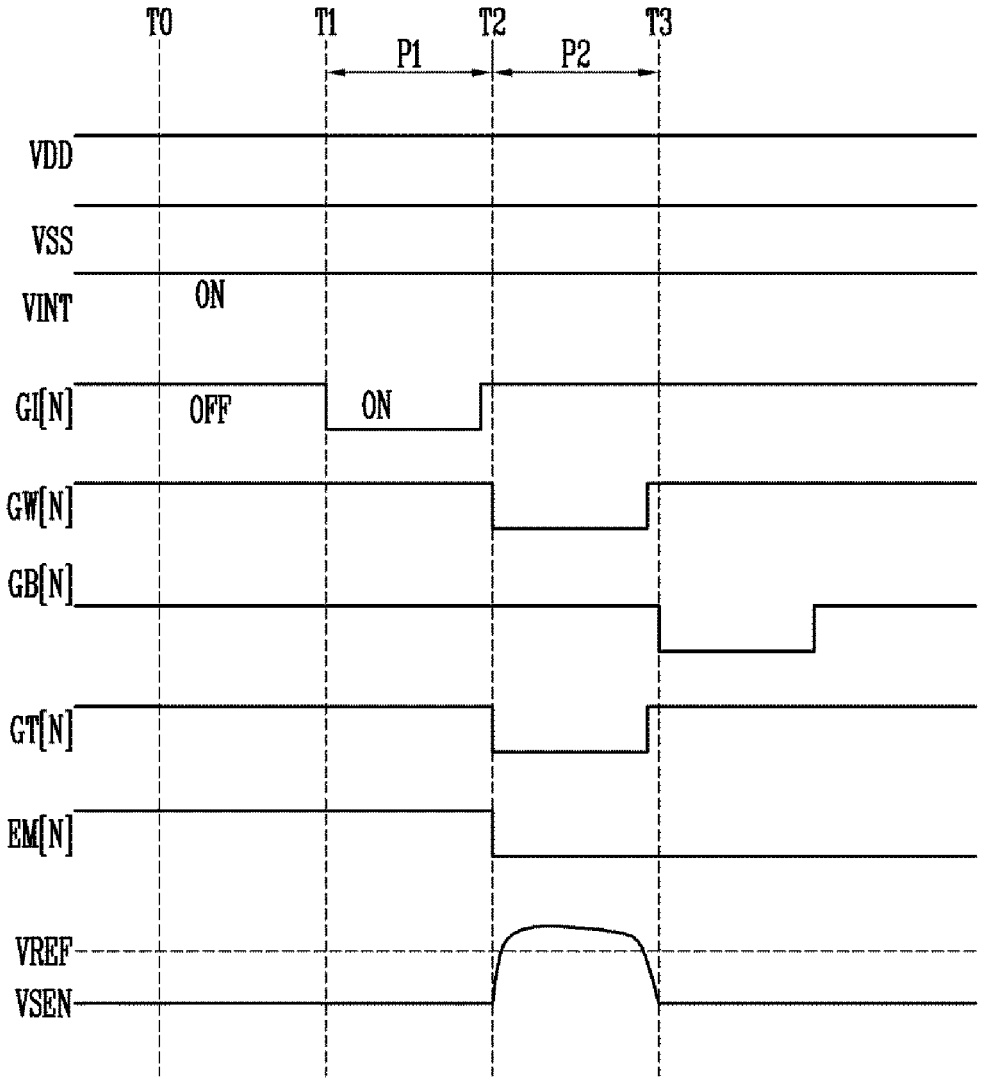
FIGS. 7A and 7B are waveform diagrams illustrating signals measured in the pixel of FIG. 2 in accordance with an exemplary embodiment.
Figure 7B:
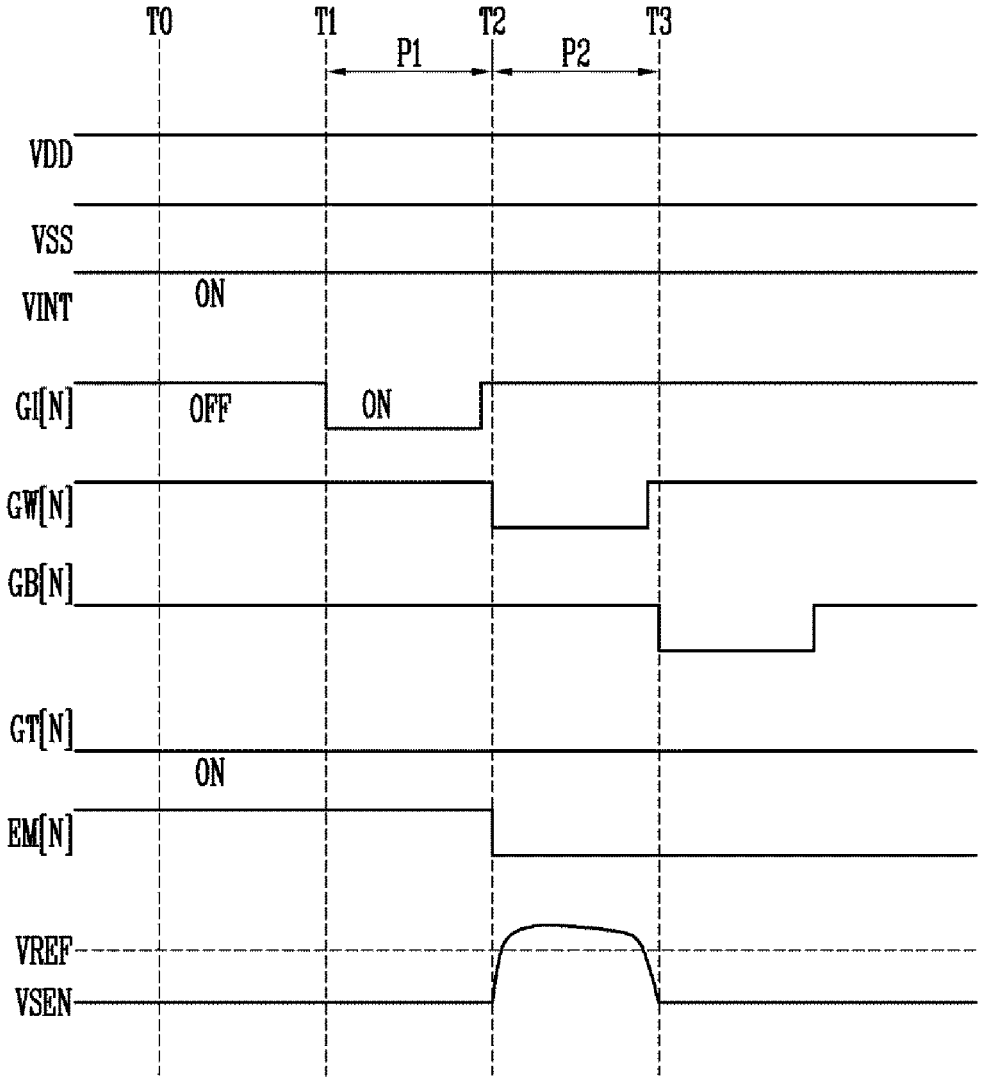
Figure 8:
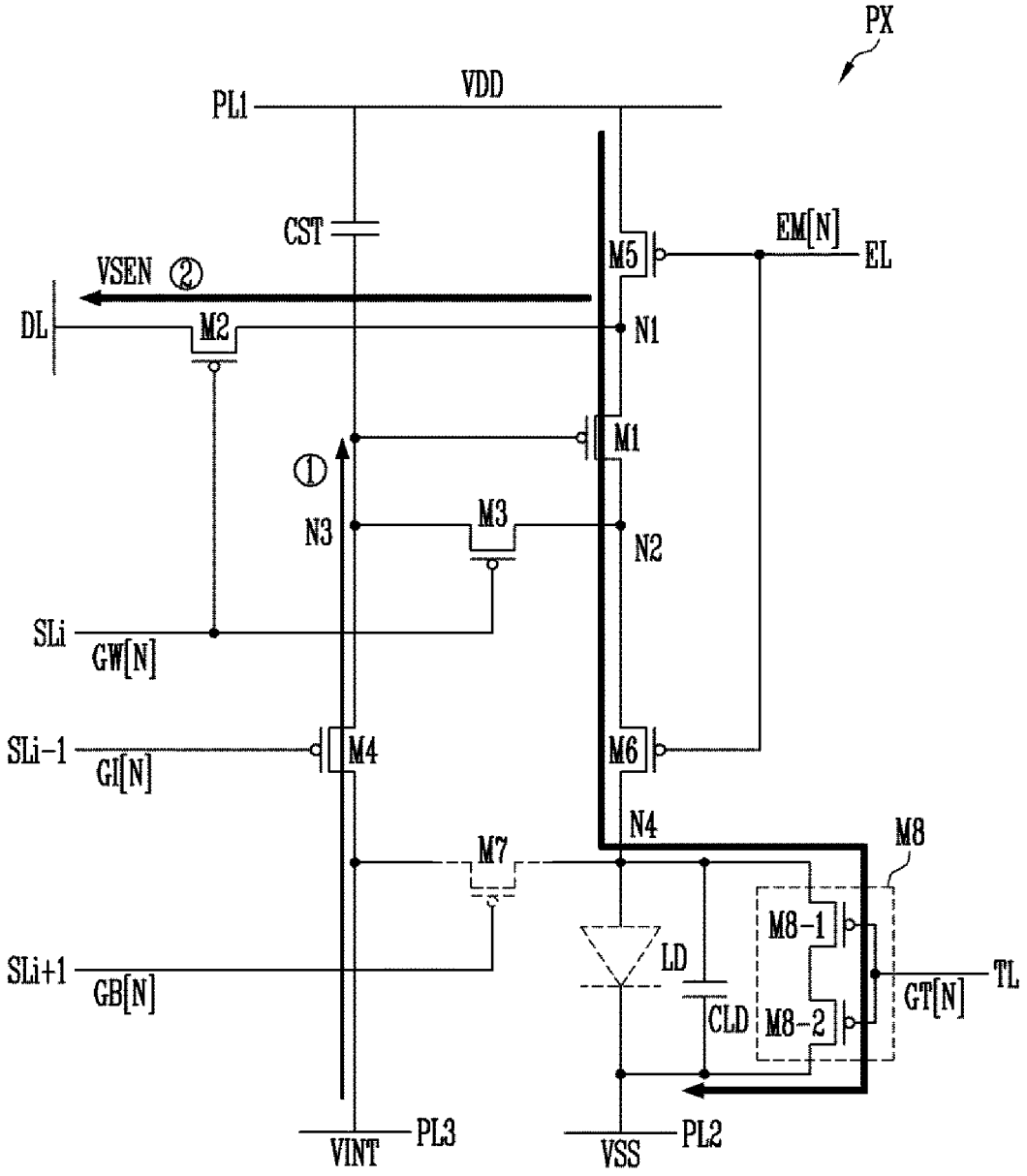
FIG. 8 is a diagram for describing an operation of the pixel in response to signals of FIG. 7A.

FIGS. 7A and 7B are waveform diagrams illustrating signals measured in the pixel PX of FIG. 2 in accordance with an exemplary embodiment. FIG. 8 is a diagram for describing an operation of the pixel PX in response to signals of FIG. 7A. FIGS. 7A, 7B, and 8 illustrate a test method of determining whether the sixth transistor M6 provided in the pixel PX is defective. The test method to be described with reference to FIGS. 7A, 7B, and 8 may be performed after (or before) the test operation described with reference to FIGS. 3, 4, 5, and 6.

Referring to FIGS. 1A, 7A, and 8, at the reference time point TO, a test on the display panel 100 may start.

The first power supply voltage VDD may be applied to the first power line PL1. The second power supply voltage VSS may be applied to the second power line PL2. The second power supply voltage VSS may have a voltage level lower than that of the first power supply voltage VDD.

Furthermore, a test voltage VTEST having a turn-on voltage level may be applied to the initialization power line PL3. In other words, an initialization voltage VINT having the same voltage level (i.e., the turn-on voltage level) as that of the test voltage VTEST may be measured.

Thereafter, a start signal (or a scan start signal) having a turn-on voltage level and an emission start signal having a turn-on voltage level may be simultaneously applied to the scan driver 400 described with reference to FIG. 1A. In response to this, the scan driver 400 may sequentially output scan signals having a turn-on voltage level to the scan lines SL1 to SLn, and may also sequentially output emission control signals having a turn-on voltage level to the emission control lines EL1 to ELn. Furthermore, gate signals having a turn-on voltage level may be sequentially provided to the test lines TL1 to TLn. For example, since the test line TL1 to TLn are respectively coupled to the scan line SL1 to SLn, gate signals may be sequentially provided to the test lines TL1 to TLn. Unlike this, as illustrated in FIGS. 1B and 7B, a gate signal (e.g., "GT" in FIG. 1B, or "GT[N]" in FIG. 7B) having a turn-on voltage level may be provided in common to the test lines TL1 to TLn (e.g., simultaneously through a separate common line).

In this case, at the first time point T1, the level of the second scan signal GI[N] may be changed from a turn-off voltage level to a turn-on voltage level in response to the start signal (or the scan start signal). During at least a portion of the first period P1, the level of the second scan signal GI[N] may be maintained at the turn-on voltage level.

During the first period P1, the level of each of the first scan signal GW[N] and the third scan signal GB[N] may be maintained at a turn-off voltage level, and the level of the emission control signal EM[N] may also be maintained at a turn-off voltage level.

In this case, as illustrated in FIG. 8, the fourth transistor M4 may be turned on in response to the second scan signal GI[N] having the turn-on voltage level, and the test voltage VTEST (i.e., the voltage having the turn-on voltage level) applied to the initialization power line PL3 may be transmitted to the third node N3. The storage capacitor CST may store the test voltage VTEST. The first transistor M1 may be turned on in response to the test voltage VTEST having the turn-on voltage level.

The second, third, fifth, sixth, and seventh transistors M2, M3, M5, M6, and M7 may remain turned off. The eighth transistor M8 may be in a turned-off state, but it is not limited thereto. For example, the eighth transistor M8 may remain turned on.

Referring to FIG. 7A again, at the second time point T2, the first scan signal GW[N] may make a transition from the turn-off voltage level to the turn-on voltage level. During the second period P2, the first scan signal GW[N] may be maintained at the turn-on voltage level. Likewise, the emission control signal EM[N] may make a transition from the turn-off voltage level to the turn-on voltage level. During the second period P2, the emission control signal EM[N] may be maintained at the turn-on voltage level. Furthermore, the gate signal GT[N] may make a transition from the turn-off voltage level to the turn-on voltage level. During the second period P2, the gate signal GT[N] may be maintained at the turn-on voltage level.

The level of the second scan signal GI[N] may be changed to the turn-off voltage level before the second time point T2 and be maintained at the turn-off voltage level during the second period P2.

In this case, as illustrated in FIG. 8, the second and third transistors M2 and M3 may be turned on in response to the first scan signal GW[N] having the turn-on voltage level, and the fifth and sixth transistors M5 and M6 may be turned on in response to the emission control signal EM[N] having the turn-on voltage level. The first power line PL1 may be electrically coupled to the second power line PL2 through the fifth transistor M5, the first transistor M1, the sixth transistor M6, and the eighth transistor M8.

A current flow path may be formed between the first power line PL1 and the second power line PL2. The voltage may be distributed depending on respective turn-on resistances of the fifth transistor M5, the first transistor M1, the sixth transistor M6, and the eighth transistor M8.

The node voltage of the first node N1 may be proportional to the turn-on resistance of each of the first transistor M1, the sixth transistor M6, and the eighth transistor M8, and may be inversely proportional to the turn-on resistance of the fifth transistor M5.

The first node N1 may be electrically coupled to the data line DL through the turned-on second transistor M2. The node voltage of the first node N1 may be provided to the data line DL, and a sensing voltage VSEN corresponding to the node voltage of the first node N1 may be measured.

Thereafter, in the test method, whether the pixel PX (or pixel circuit) is defective may be determined based on the voltage level of the sensing voltage VSEN.

For example, the test method may include comparing the sensing voltage VSEN with a preset reference voltage VREF, and determining that a failure has occurred on the sixth transistor M6 when the sensing voltage VSEN is equal to or less than the reference voltage VREF.

As described with reference to FIGS. 7A, 7B, and 8, the method of testing the display panel 100 may include: applying a start signal (or a scan start signal) having a turn-on voltage level and an emission start signal having a turn-on voltage level to the scan driver 400 in a state in which a test voltage VTEST having a turn-off voltage level has been applied to the initialization power line PL3, and simultaneously providing a gate signal GT[N] having a turn-on voltage level to the test line TL (i.e., the eighth transistor M8); and then measuring a sensing voltage VSEN on the data line DL, thus determining whether the sixth transistors M6 in the pixel PX is defective.

Although FIG. 7A illustrates that the waveform of the gate signal GT[N] is the same as that of the first scan signal GW[N], the present disclosure is not limited thereto. For example, as illustrated in FIG. 7B, the gate signal GT[N] may be maintained at a turn-on voltage level during a period in which it is determined whether the sixth transistor M6 is defective. Also, the gate signal GT[N] (i.e., "GT" in FIG. 1B) may be simultaneously applied in common to the test lines TL1 to TLn illustrated in FIG. 1B.

Figure 9A:
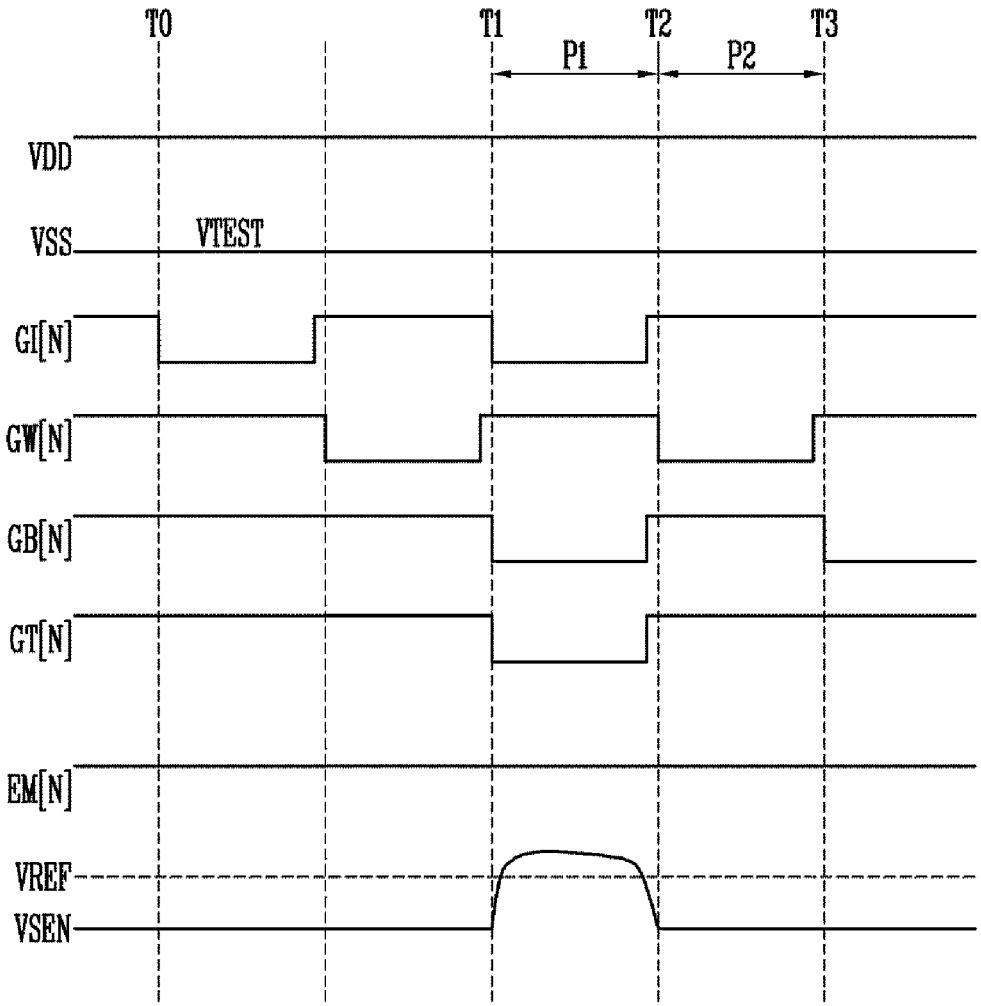
FIGS. 9A and 9B are waveform diagrams illustrating signals measured in the pixel of FIG. 2 in accordance with an exemplary embodiment.
Figure 9B:
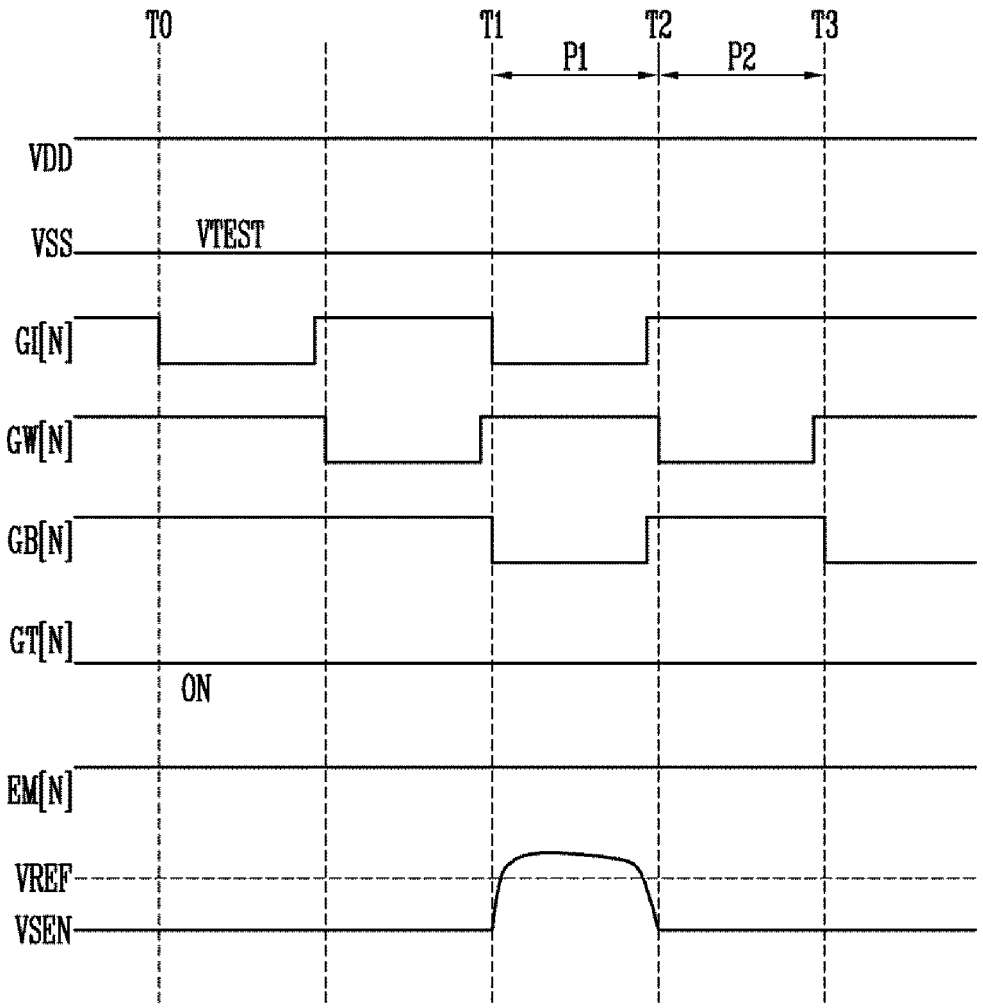
Figure 10:
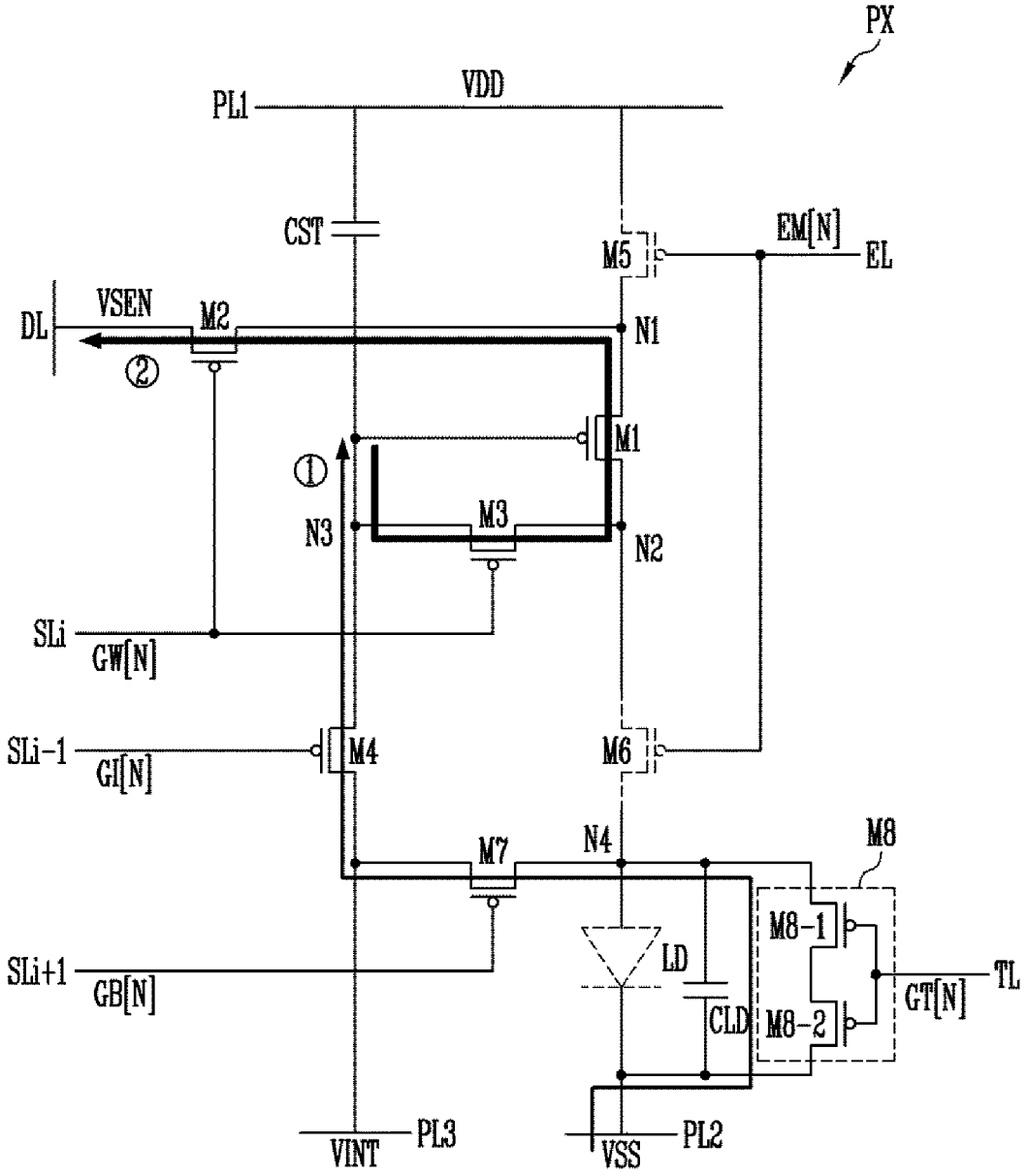
FIG. 10 is a diagram for describing an operation of the pixel in response to signals of FIG. 9A.

FIGS. 9A and 9B are waveform diagrams illustrating signals measured in the pixel PX of FIG. 2 in accordance with an exemplary embodiment. FIG. 10 is a diagram for describing an operation of the pixel PX in response to signals of FIG. 9A. FIGS. 9A, 9B, and 10 illustrate a test method of determining whether the seventh transistor M7 provided in the pixel PX is defective. The test method to be described with reference to FIGS. 9A, 9B, and 10 may be performed after (or before) the test operation described with reference to FIGS. 3, 4, 5, and 6.

Referring to FIGS. 1A, 9A, and 10, at the reference time point TO, a test on the display panel 100 may start.

The first power supply voltage VDD may be applied to the first power line PL1. A test voltage VTEST having a turn-on voltage level may be applied to the second power line PL2. The initialization power line PL3 may remain floating (in other words, a separate voltage is not applied thereto).

Thereafter, a start signal (or a scan start signal) having a turn-on voltage level may be applied to the scan driver 400 described with reference to FIG. 1A. Here, the start signal may include two pulses (e.g., two pulses generated at an interval of one horizontal period).

In response to this, the scan driver 400 may sequentially output scan signals each having two pulses with a turn-on voltage level to the scan lines SL1 to SLn. As described with reference to FIG. 7A, gate signals having a turn-on voltage level may be sequentially provided to the test lines TL1 to TLn. As illustrated in FIGS. 1B and 9B, a gate signal (i.e., "GT" in FIG. 1B or "GT[N]" in FIG. 9B) having a turn-on voltage level may be simultaneously provided to the test lines TL1 to TLn.

An emission start signal having a turn-off voltage level may be provided to the scan driver 400.

In this case, at the first time point T1, the level of the second scan signal GI[N] may be changed from a turn-off voltage level to a turn-on voltage level in response to the start signal (or the scan start signal). During at least a portion of the first period P1, the level of the second scan signal GI[N] may be maintained at the turn-on voltage level. Likewise, the level of the third scan signal GB[N] may be changed from a turn-off voltage level to a turn-on voltage level. During at least a portion of the first period P1, the level of the third scan signal GB[N] may be maintained at the turn-on voltage level. Furthermore, the level of the gate signal GT[N] may be changed from a turn-off voltage level to a turn-on voltage level. During at least a portion of the first period P1, the gate signal GT[N] may be maintained at the turn-on voltage level.

During the first period P1, the first scan signal GW[N] may be maintained at the turn-off voltage level.

In this case, as illustrated in FIG. 10, the fourth transistor M4 may be turned on in response to the second scan signal GI[N] having the turn-on voltage level. The seventh transistor M7 may be turned on in response to the third scan signal GB[N] having the turn-on voltage level. The eighth transistor M8 may remain turned on in response to the gate signal GT[N] having the turn-on voltage level. In this case, the test voltage VTEST (i.e., a voltage having a turn-on voltage level) applied to the second power line PL2 may be transmitted to the third node N3. The storage capacitor CST may store the test voltage VTEST. The first transistor M1 may be turned on in response to the test voltage VTEST having the turn-on voltage level.

The second, third, fifth, and sixth transistors M2, M3, M5, and M6 may remain turned off.

Referring to FIG. 9B again, at the second time point T2, the first scan signal GW[N] may make a transition from the turn-off voltage level to the turn-on voltage level. During the second period P2, the first scan signal GW[N] may be maintained at the turn-on voltage level.

The level of each of the second scan signal GI[N] and the third scan signal GB[N] may be changed to the turn-off voltage level before the second time point T2 and be maintained at the turn-off voltage level during the second period P2. As illustrated in FIG. 9A, before the second time point T2, the gate signal GT[N] may make a transition from the turn-on voltage level to the turn-off voltage level, but the present disclosure is not limited thereto, for example, as illustrated in FIGS. 1B and 9B, the gate signal (i.e., "GT" in FIG. 1B or "GT[N]" in FIG. 9B) commonly applied to the test lines TL1 to TLn may maintained at the turn-on voltage level.

In this case, as illustrated in FIG. 10, the second and third transistors M2 and M3 may be turned on in response to the first scan signal GW[N] having the turn-on voltage level, and the third node N3 may be electrically coupled with the data line DL through the first to third transistors M1 to M3. Hence, the test voltage VTEST may be provided to the data line DL, and a sensing voltage VSEN corresponding to the test voltage VTEST may be measured.

Thereafter, in the test method, whether the pixel PX (or pixel circuit) is defective may be determined based on the voltage level of the sensing voltage VSEN.

For example, the test method may include comparing the sensing voltage VSEN with a preset reference voltage VREF, and determining that a failure has occurred on the seventh transistor M7 when the sensing voltage VSEN is equal to or less than the reference voltage VREF.

As described with reference to FIGS. 9A, 9B, and 10, the method of testing the display panel 100 may include: applying a scan start signal having two pulses with a turn-on voltage level (and the emission start signal having the turn-off voltage level) to the scan driver 400 in a state in which the test voltage VTEST having the turn-on voltage level is applied to the second power line PL2 and the eighth transistor M8 is turned on; and measuring a sensing voltage VSEN on the data line DL, thus determining whether the seventh transistor M7 in the pixel PX is defective.

Figure 11A:
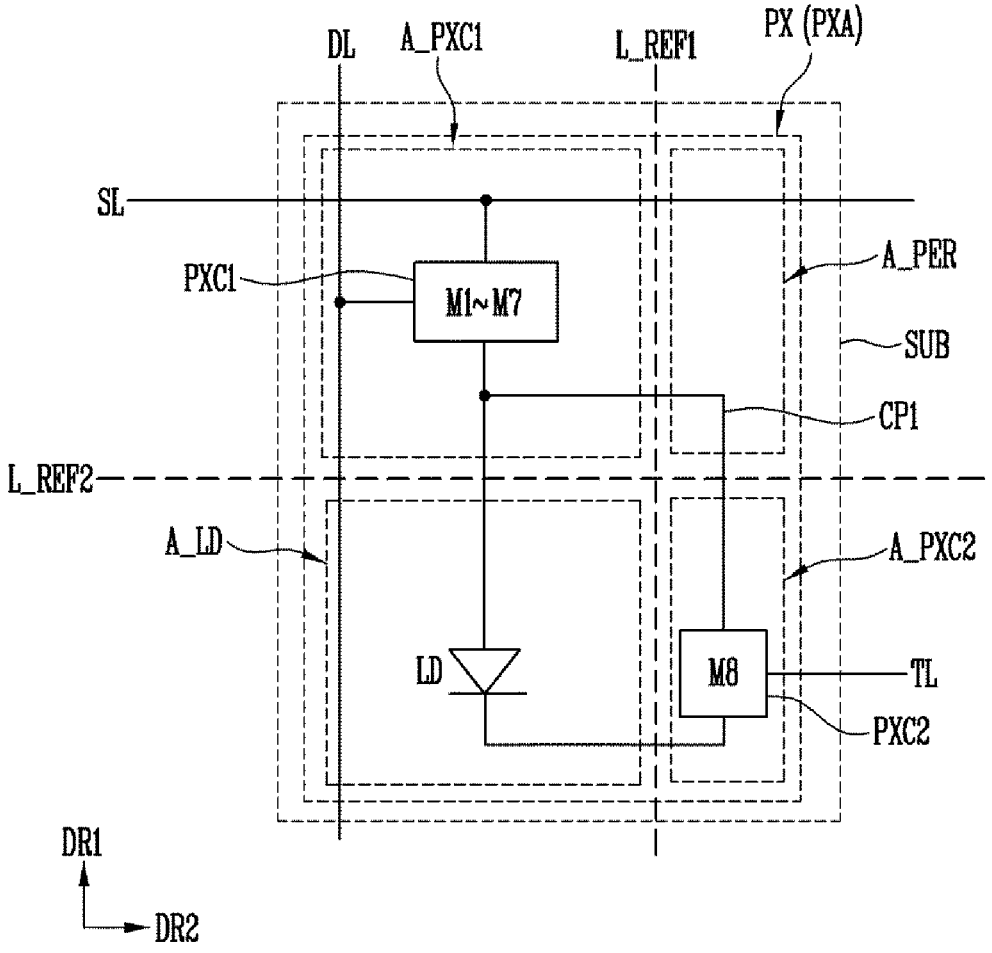
FIGS. 11A and 11B are diagrams illustrating examples of the pixel of FIG. 2.
Figure 11B:
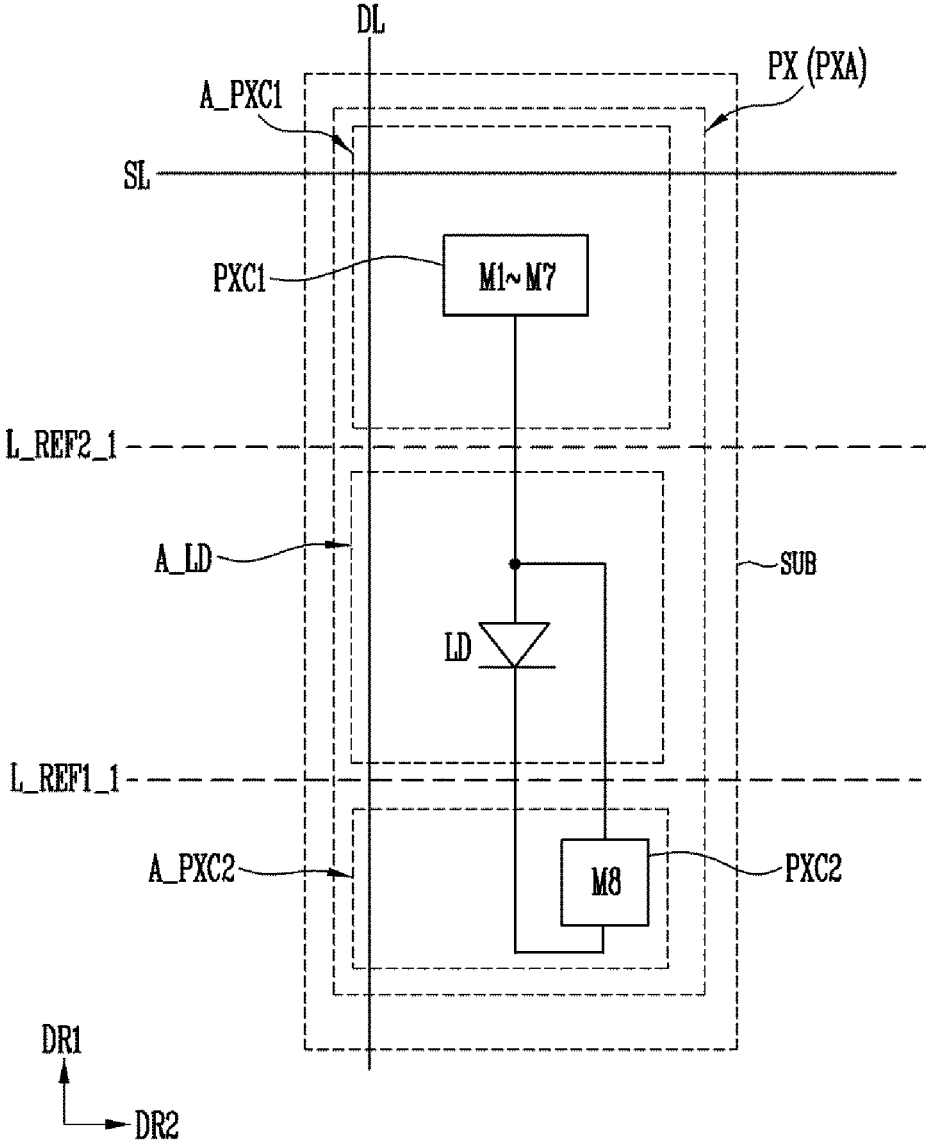

FIGS. 11A and 11B are diagrams illustrating examples of the pixel PX of FIG. 2. FIGS. 11A and 11B are plan views schematically illustrating examples of the pixel PX of FIG. 2.

Referring to FIG. 11A, a base layer (or substrate) SUB may include a pixel area PXA. The pixel area PXA may include an emission area A_LD, a first circuit area A_PXC1, and a second circuit area A_PXC2. The pixel area PXA may further include a peripheral area A_PER.

The emission area A_LD, the first circuit area A_PXC1, the second circuit area A_PXC2, and the peripheral area A_PER may be separated from each other by a first reference line L_REF1 extending in a first direction DR1 and a second reference line L_REF2 extending in a second direction DR2. The first reference line L_REF1 may be parallel to the data line DL, and the second reference line L_REF2 may be parallel to the scan line SL.

With respect to the emission area A_LD, the first circuit area A_PXC1 may be disposed in the first direction DR1, and the second circuit area A_PXC2 may be disposed in the second direction DR2. The peripheral area A_PER may be an area in the pixel area PXA other than the emission area A_LD, the first circuit area A_PXC1, and the second circuit area A_PXC2, and may be disposed adjacent to the first circuit area A_PXC1 and the second circuit area A_PXC2.

The light emitting element LD described with reference to FIG. 2 may be disposed in the emission area A_LD of the base layer SUB.

A pixel circuit PXC1 may be disposed in the first circuit area A_PXC1 of the base layer SUB. Here, the pixel circuit PXC1 may provide driving current to the light emitting element LD and include at least one transistor coupled to the scan line SL and the data line DL. For example, the pixel circuit PXC1 may include the first to seventh transistors M1 to M7 described with reference to FIG. 2, and the storage capacitor (CST; refer to FIG. 2).

A test circuit PXC2 may be provided in the second circuit area A_PXC2 of the base layer SUB. The test circuit PXC2 may include an auxiliary transistor coupled in parallel to the light emitting element LD. For example, the test circuit PXC2 may include the eighth transistor M8 described with reference to FIG. 2.

In embodiments, the light emitting element LD may be manufactured separately from the pixel circuit PXC1 and the test circuit PXC2. For example, the light emitting element LD may be manufactured in the form of a chip and then bonded to or mounted on the base layer SUB on which the pixel circuit PXC1 and the test circuit PXC2 are formed.

During a process of bonding the light emitting element LD to the base layer SUB, high temperature and/or high pressure may be generated, and a transistor in the pixel circuit PXC1 may be damaged by the high temperature and/or high pressure. In an exemplary embodiment, since the pixel circuit PXC1 is disposed in the first circuit area A_PXC1 separated from the emission area A_LD, the pixel circuit PXC1 may be prevented or suppressed from being damaged during the process of bonding the light emitting element LD.

Before the light emitting element LD is mounted on the base layer SUB since the pixel circuit PXC1 and the test circuit PXC2 have been formed on the base layer SUB, the base layer SUB, e.g., an electrode to which the light emitting element LD is to be boded, may remain exposed to the outside. Furthermore, the operation of mounting the light emitting element LD may be performed using equipment different from equipment used to form the pixel circuit PXC1 and the test circuit PXC2. Hence, the base layer SUB on which the pixel circuit PXC1 and the test circuit PXC2 are formed is required to be transferred. Thus, the electrode may be exposed to the outside for a long time, and static electricity is likely to be generated on the electrode. In the case where the static electricity is drawn, the eighth transistor M8 coupled between the electrode and the second power line (PL2; refer to FIG. 2) on a flow path of the static electricity may be damaged. Since the test circuit PXC2 is disposed in the second circuit area A_PXC2 separated from the first circuit area A_PXC1, the damage to the eighth transistor M8 may be prevented or suppressed from affecting the pixel circuit PXC1 (e.g., causing damage to the pixel circuit PXC1), whereby the pixel circuit PXC1 may be protected from static electricity.

In an exemplary embodiment, the test circuit PXC2 may be coupled with the pixel circuit PXC1 through a first bridge pattern CP1. The first bridge pattern CP1 may extend from the first circuit area A_PXC1 to the second circuit area A_PXC2 via the peripheral area A_PER. However, this is only for illustrative purposes, and the present disclosure is not limited thereto.

Referring to FIG. 11B, a base layer SUB may include a pixel area PXA. The pixel area PXA may include an emission area A_LD, a first circuit area A_PXC1, and a second circuit area A_PXC2.

The emission area A_LD, the first circuit area A_PXC1, and the second circuit area A_PXC2 may be separated from each other by a first reference line L_REF1_1 and a second reference line L_REF2_1 that extend in the second direction DR2 and are parallel to each other.

With respect to the emission area A_LD, the first circuit area A_PXC1 may be disposed at an upper position, and the second circuit area A_PXC2 may be disposed at a lower position. In other words, the emission area A_LD may be disposed between the first circuit area A_PXC1 and the second circuit area A_PXC2. The first circuit area A_PXC1 and the second circuit area A_PXC2 may be separated apart from each other by the emission area A_LD.

Figure 12:
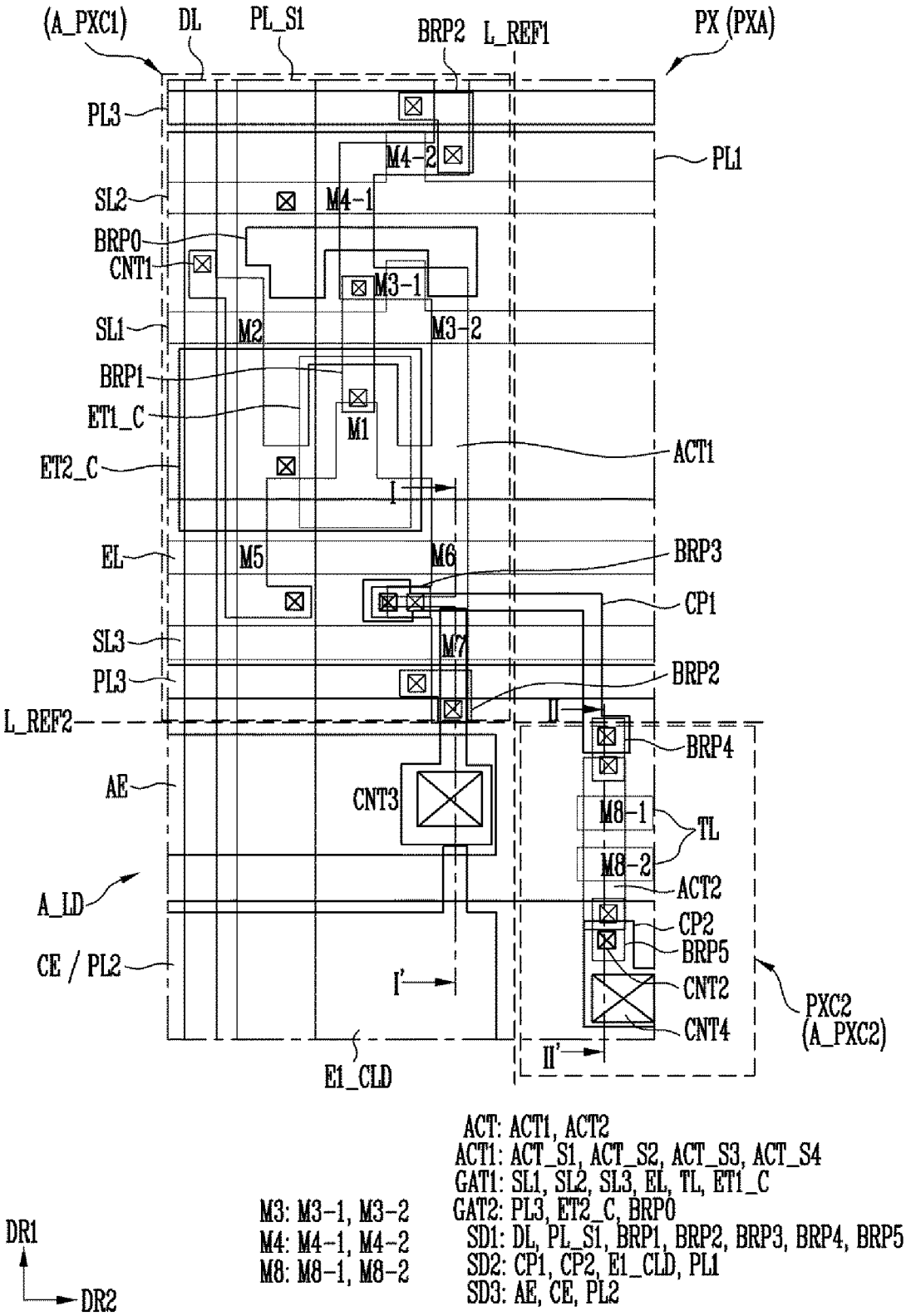
FIG. 12 is a layout illustrating an example of the pixel of FIG. 11A.

FIG. 12 is a layout illustrating an example of the pixel PX of FIG. 11A. FIG. 12 illustrates the pixel PX, focused on the pixel circuit (PXC1; refer to FIG. 11A) and the test circuit (PXC2; refer to FIG. 11A) of the pixel PX.

Referring to FIG. 12, the pixel PX may include a semiconductor layer ACT, a first conductive layer GAT1, a second conductive layer GAT2, a third conductive layer SD1, a fourth conductive layer SD2, and a fifth conductive layer (or an electrode layer) SD3. The semiconductor layer ACT, the first conductive layer GAT1, the second conductive layer GAT2, the third conductive layer SD1, the fourth conductive layer SD2, and the fifth conductive layer (or the electrode layer) SD3 may be formed on different respective layers through different respective processes. This will be described later with reference to FIG. 15.

The semiconductor layer ACT may be an active layer which forms channels of the transistors M1 to M8. The semiconductor layer ACT may include a source area and a drain area which respectively come into contact with a first transistor electrode (e.g., a source electrode) and a second transistor electrode (e.g., a drain electrode) of each of the transistors M1 to M8. An area between the source area and the drain area may be a channel area.

In an exemplary embodiment, the semiconductor layer ACT may include a silicon semiconductor (or poly silicon semiconductor). The channel area formed of a semiconductor pattern may be an undoped semiconductor pattern, which is an intrinsic semiconductor. Each of the source area and the drain area may be a semiconductor pattern doped with an impurity. A P-type impurity may be used as the impurity, but the present disclosure is not limited thereto.

The semiconductor layer ACT may include a first semiconductor pattern ACT1 and a second semiconductor pattern ACT2. Detailed description of the semiconductor layer ACT will be made with reference to FIG. 13.

Figure 13:
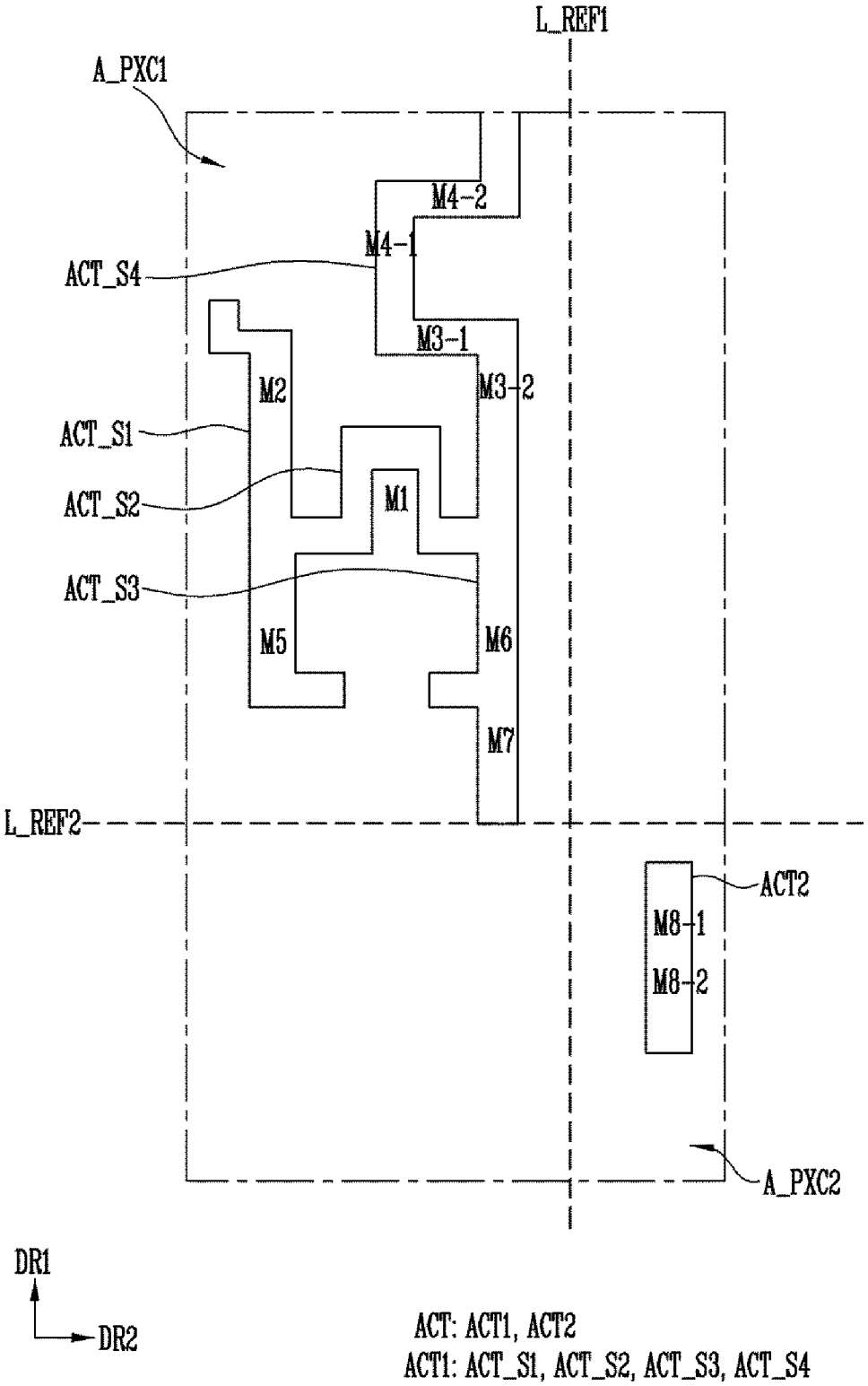
FIG. 13 is a plan view illustrating an example of a semiconductor layer included in the pixel of FIG. 12.

FIG. 13 is a plan view illustrating an example of the semiconductor layer ACT included in the pixel PX of FIG. 12.

Referring to FIG. 13, the first semiconductor pattern ACT1 and the second semiconductor pattern ACT2 may be disposed at positions spaced apart from each other. The first semiconductor pattern ACT1 may be disposed in the first circuit area A_PXC1, and the second semiconductor pattern ACT2 may be disposed in the second circuit area A_PXC2.

The first semiconductor pattern ACT1 may include a first vertical section (or a first sub-semiconductor pattern) ACT_S1, a horizontal section (or a second sub-semiconductor pattern) ACT_S2, a second vertical section (or a third sub-semiconductor pattern) ACT_S3, and a bent section ACT_S4. The first vertical section ACT_S1, the horizontal section ACT_S2, the second vertical section ACT_S3, and the bent section ACT_S4 may be coupled to each other and integrally formed with each other.

The first vertical section ACT_S1 may extend in the first direction DR1 and be disposed adjacent to one side of the first circuit area A_PXC1. The first vertical section ACT_S1 may form the channel of the second transistor M2 and the channel of the fifth transistor M5. As illustrated in FIG. 13, with respect to the horizontal section ACT_S2, an upper portion of the first vertical section ACT_S1 may form the channel of the second transistor M2, and a lower portion of the first vertical section ACT_S1 may form the channel of the fifth transistor M5.

The horizontal section ACT_S2 may extend from an intermediate portion of the first vertical section ACT_S1 in the second direction DR2 and have a bent shape. The horizontal section ACT_S2 may form the channel of the first transistor M1. Due to the bent shape of the horizontal section ACT_S2, channel capacity of the first transistor M1 may be enhanced.

The second vertical section ACT_S3 may extend in the first direction DR1 and be disposed adjacent to another side of the first circuit area A_PXC1. With respect to the horizontal section ACT_S2, an upper portion of the second vertical section ACT_S3 may form the channel of the third transistor M3, and a lower portion of the second vertical section ACT_S3 may form the channel of the sixth transistor M6 and the channel of the seventh transistor M7.

The bent section ACT_S4 may extend from an upper end of the second vertical section ACT_S3, have a bent shape, and form the channel of the fourth transistor M4.

In an exemplary embodiment, the third transistor M3 may include first and second sub-transistors M3-1 and M3-2. The first semiconductor pattern ACT1 may include channel areas of the first and second sub-transistors M3-1 and M3-2, in other words, two channel areas coupled in series to each other. Likewise, the fourth transistor M4 may include first and second sub-transistors M4-1 and M4-2. The first semiconductor pattern ACT1 may include channel areas of the first and second sub-transistors M4-1 and M4-2, in other words, two channel areas coupled in series to each other. The third transistor M3 and the fourth transistor M4 each of which is implemented as a dual-gate transistor may prevent or reduce leakage of current (e.g., driving current flowing from the first transistor M1 to the sixth transistor M6).

The second semiconductor pattern ACT2 may extend in the first direction DR1 and form the channel of the eighth transistor M8. The eighth transistor M8 may include first and second sub-transistors M8-1 and M8-2. The second semiconductor pattern ACT2 may include channel areas of the first and second sub-transistors M8-1 and M8-2, in other words, two channel areas coupled in series to each other. The eighth transistor M8 which is implemented as a dual-gate transistor may prevent or reduce leakage of current (e.g., driving current that is provided to the light emitting element (LD; refer to FIG. 12) through the sixth transistor M6.

Referring to FIG. 12 again, the first conductive layer GAT1 may include a first scan line SL1, a second scan line SL2, a third scan line SL3, an emission control line EL, a test line TL, and a first electrode (or a first capacitor electrode) ET1_C.

The second scan line SL2 may extend in the second direction DR2 and be disposed in an uppermost portion of the pixel area PXA. The second scan line SL2 may overlap with the first semiconductor pattern ACT1 (or the bent section ACT_S4 of the first semiconductor pattern ACT1; refer to FIG. 13), and may form the gate electrode of the fourth transistor M4 or be coupled to the gate electrode of the fourth transistor M4. The second scan line SL2 may be substantially the same as the second scan line SLi−1 described with reference to FIG. 2.

The first scan line SL1 may extend in the second direction DR2 and be disposed between the second scan line SL2 and a first electrode ET1_C. The first scan line SL1 may overlap with the first vertical section ACT_S1 (refer to FIG. 13) of the first semiconductor pattern ACT1, and may form the gate electrode of the second transistor M2 or be coupled thereto. Also, the first scan line SL1 may overlap with the second vertical section ACT_S3 (refer to FIG. 13) of the first semiconductor pattern ACT1, and may form the gate electrode of the third transistor M3 or be coupled thereto. The first scan line SL1 may be substantially the same as the first scan line SLi described with reference to FIG. 2.

The first electrode ET1_C may have a predetermined surface area, be disposed in an approximately central portion of the first circuit area A_PXC1, and overlap with the horizontal section ACT_S2 of the first semiconductor pattern ACT1. The first electrode ET1_C may form the gate electrode of the first transistor M1.

The emission control line EL may extend in the second direction DR2 and be disposed on a lower side of the first electrode ET1_C. The emission control line EL may overlap with each of the first vertical section ACT_S1 and the second vertical section ACT_S3 of the first semiconductor pattern ACT1, and may form each of the gate electrode of the fifth transistor M5 and the gate electrode of the sixth transistor M6 or be coupled thereto.

The third scan line SL3 may extend in the second direction DR2 and be disposed in a lowermost portion of the first circuit area A_PXC1. The third scan line SL3 may overlap with the second vertical section ACT_S3 of the first semiconductor pattern ACT1, and may form the gate electrode of the seventh transistor M7 or be coupled thereto.

The test line TL may be disposed in the second circuit area A_PXC2 and overlap with the second semiconductor pattern ACT2, and may form the gate electrode of the eighth transistor M8 or be coupled thereto.

The first conductive layer GAT1 may include one or more metals selected from among molybdenum (Mo), aluminum (Al), platinum (Pt), palladium (Pd), silver (Ag), magnesium (Mg), gold (Au), nickel (Ni), neodymium (Nd), iridium (Ir), chrome (Cr), titanium (Ti), tantalum (Ta), tungsten (W), and copper (Cu). The first conductive layer GAT1 may have a single-layer or multi-layer structure. For example, the first conductive layer GAT1 may have a single-layer structure including molybdenum (Mo).

The second conductive layer GAT2 may include a third power line PL3, a second electrode (or a second capacitor electrode) ET2_C, and a protective pattern BRP0.

The third power line PL3 may extend in the second direction DR2 and be disposed adjacent to each of an upper side and a lower side of the first circuit area A_PXC1.

The protective pattern BRP0 may be disposed between the second scan line SL2 and the first scan line SL1 in a plan view, and may partially overlap with the second vertical section ACT_S3 of the first semiconductor pattern ACT1.

The second electrode ET2_C may overlap with the first electrode ET1_C and form, along with the first electrode ET1_C, the storage capacitor CST described with reference to FIG. 2. The surface area of the second electrode ET2_C may be greater than that of the first electrode ET1_C so that the second electrode ET2_C may cover the first electrode ET1_C.

The second conductive layer GAT2 may include one or more metals selected from among molybdenum (Mo), aluminum (Al), platinum (Pt), palladium (Pd), silver (Ag), magnesium (Mg), gold (Au), nickel (Ni), neodymium (Nd), iridium (Ir), chrome (Cr), titanium (Ti), tantalum (Ta), tungsten (W), and copper (Cu). The second conductive layer GAT2 may have a single-layer or multi-layer structure. For example, the second conductive layer GAT2 may have a single-layer structure including molybdenum (Mo).

The third conductive layer SD1 may include a data line DL, a first sub-power line PL_S1, and first to fifth conductive patterns (or first to fifth connection patterns) BRP1 to BRP5.

The data line DL may extend in the first direction DR1 and overlap with an upper end of the first vertical section ACT_S1 of the first semiconductor pattern ACT1. The data line DL may come into contact with the upper end of the first vertical section ACT_S1 of the first semiconductor pattern ACT1 through a contact hole CNT1 through which the upper end of the first vertical section ACT_S1 of the first semiconductor pattern ACT1 is exposed, and may form the first electrode of the second transistor M2 or be coupled to the first electrode of the second transistor M2.

The first sub-power line PL_S1 may extend in the first direction DR1 and be disposed between the data line DL and the first electrode ET1_C in a plan view. The first sub-power line PL_S1 may be coupled with the first power line PL1 to be described later herein. The first power supply voltage (VDD; refer to FIG. 2) may be applied to the first sub-power line PL_S1. The first sub-power line PL_S1 may overlap with the second electrode ET2_C and be coupled with the second electrode ET2_C through a contact hole through which the second electrode ET2_C is exposed.

The first conductive pattern BRP1 may overlap with the first electrode ET1_C and a first end of the bent section ACT_S4 of the first semiconductor pattern ACT1. The first conductive pattern BRP1 may make a contact with the first end of the bent section ACT_S4 of the first semiconductor pattern ACT1 through a contact hole through which the first end of the bent section ACT_S4 of the first semiconductor pattern ACT1 is exposed, and may be coupled with the first electrode of the third transistor M3 (or the first sub-transistor M3-1 of the third transistor M3) and the first electrode of the fourth transistor M4 (or the first sub-transistor M4-1 of the fourth transistor M4) or form the first electrodes thereof.

The second conductive pattern BRP2 may overlap with the third power line PL3 and a second end of the bent section ACT_S4 of the first semiconductor pattern ACT1. The second conductive pattern BRP2 may be coupled with the third power line PL3 through a contact hole through which the third power line PL3 is exposed. Furthermore, the second conductive pattern BRP2 may make a contact with the second end of the bent section ACT_S4 of the first semiconductor pattern ACT1 through a contact hole through which the second end of the bent section ACT_S4 of the first semiconductor pattern ACT1 is exposed, and may be coupled with the second electrode of the fourth transistor M4 (or the second sub-transistor M4-2 of the fourth transistor M4) or form the second electrode. The second conductive pattern BRP2 may couple the fourth transistor M4 and the third power line PL3 to each other.

The third conductive pattern BRP3 may overlap with the second vertical section ACT_S3 of the first semiconductor pattern ACT1 and make a contact with the second vertical section ACT_S3 of the first semiconductor pattern ACT1 through a contact hole through which a portion of the second vertical section ACT_S3 of the first semiconductor pattern ACT1 is exposed. The third conductive pattern BRP3 may form each of the second electrode of the sixth transistor M6 and the first electrode of the seventh transistor M7 or be coupled thereto.

The fourth conductive pattern BRP4 may overlap with a first end of the second semiconductor pattern ACT2 and make a contact with the first end of the second semiconductor pattern ACT2 through a contact hole through which the first end of the second semiconductor pattern ACT2 is exposed. The fourth conductive pattern BRP4 may be coupled to the first electrode of the eighth transistor M8 or form the first electrode of the eighth transistor M8.

Likewise, the fifth conductive pattern BRP5 may overlap with a second end of the second semiconductor pattern ACT2 and make a contact with the second end of the second semiconductor pattern ACT2 through a contact hole through which the second end of the second semiconductor pattern ACT2 is exposed. The fifth conductive pattern BRP5 may be coupled to the second electrode of the eighth transistor M8 or form the second electrode of the eighth transistor M8.

The third conductive layer SD1 may include one or more metals selected from among molybdenum (Mo), aluminum (Al), platinum (Pt), palladium (Pd), silver (Ag), magnesium (Mg), gold (Au), nickel (Ni), neodymium (Nd), iridium (Ir), chrome (Cr), titanium (Ti), tantalum (Ta), tungsten (W), and copper (Cu). The third conductive layer SD1 may have a single-layer or multi-layer structure. For example, the third conductive layer SD1 may have a multi-layer structure of Ti/Al/Ti.

The fourth conductive layer SD2 may include the first bridge pattern (or the connection line) CP1, a second bridge pattern CP2, a first emission capacitor electrode E1_CLD, and the first power line PL1.

The first bridge pattern CP1 may overlap with the third conductive pattern BRP3 and be coupled with the third conductive pattern BRP3 through a contact hole through which the third conductive pattern BRP3 is exposed.

A portion of the first bridge pattern CP1 may extend in the second direction DR2, and the other portion thereof may extend in the first direction DR1. The first bridge pattern CP1 may extend across the peripheral area A_PER and overlap with the fourth conductive pattern BRP4. The first bridge pattern CP1 may be coupled with the fourth conductive pattern BRP4 through a contact hole through which the fourth conductive pattern BRP4 is exposed. The first bridge pattern CP1 may extend in the first direction DR1 and be coupled with the first emission capacitor electrode E1_CLD. The first bridge pattern CP1 may include a portion having a comparatively large width (or line width) at a position preceding a point at which the first bridge pattern CP1 is coupled with the first emission capacitor electrode E1_CLD, and may be coupled with the anode electrode AE to be described later herein through the portion having the large width.

The first emission capacitor electrode E1_CLD may have a predetermined surface area and be integrally formed with the first bridge pattern CP1. For example, the first bridge pattern CP1 may have an increased line width on a portion thereof that overlaps with the cathode electrode CE (or the second power line PL2), and may form the first emission capacitor electrode E1_CLD.

The second bridge pattern CP2 may overlap with the fifth conductive pattern BRP5 and be coupled with the fifth conductive pattern BRP5 through a contact hole CNT2 through which the fifth conductive pattern BRP5 is exposed.

The first power line PL1 may extend in the second direction DR2 and cover most of the first circuit area A_PXC1 and the peripheral area A_PER. The first power line PL1 may overlap with the first sub-power line PL_S1 and be coupled with the first sub-power line PL_S1 through a contact hole through which the first sub-power line PL_S1 is exposed. The first power line PL1 may be coupled with the first sub-power line PL_S1 extending in the first direction DR1, thus forming an overall mesh structure. The first power line PL1 may reduce a drop of the first power supply voltage (VDD; refer to FIG. 2).

The fourth conductive layer SD2 may include one or more metals selected from among molybdenum (Mo), aluminum (Al), platinum (Pt), palladium (Pd), silver (Ag), magnesium (Mg), gold (Au), nickel (Ni), neodymium (Nd), iridium (Ir), chrome (Cr), titanium (Ti), tantalum (Ta), tungsten (W), and copper (Cu). The fourth conductive layer SD2 may have a single-layer or multi-layer structure. For example, the fourth conductive layer SD2 may have a multi-layer structure of Ti/Al/Ti.

The fifth conductive layer SD3 may include the anode electrode AE (or the first pixel electrode), the cathode electrode CE (or the second pixel electrode), and the second power line PL2.

Description of the fifth conductive layer SD3 will be made with reference to FIG. 14.

Figure 14:
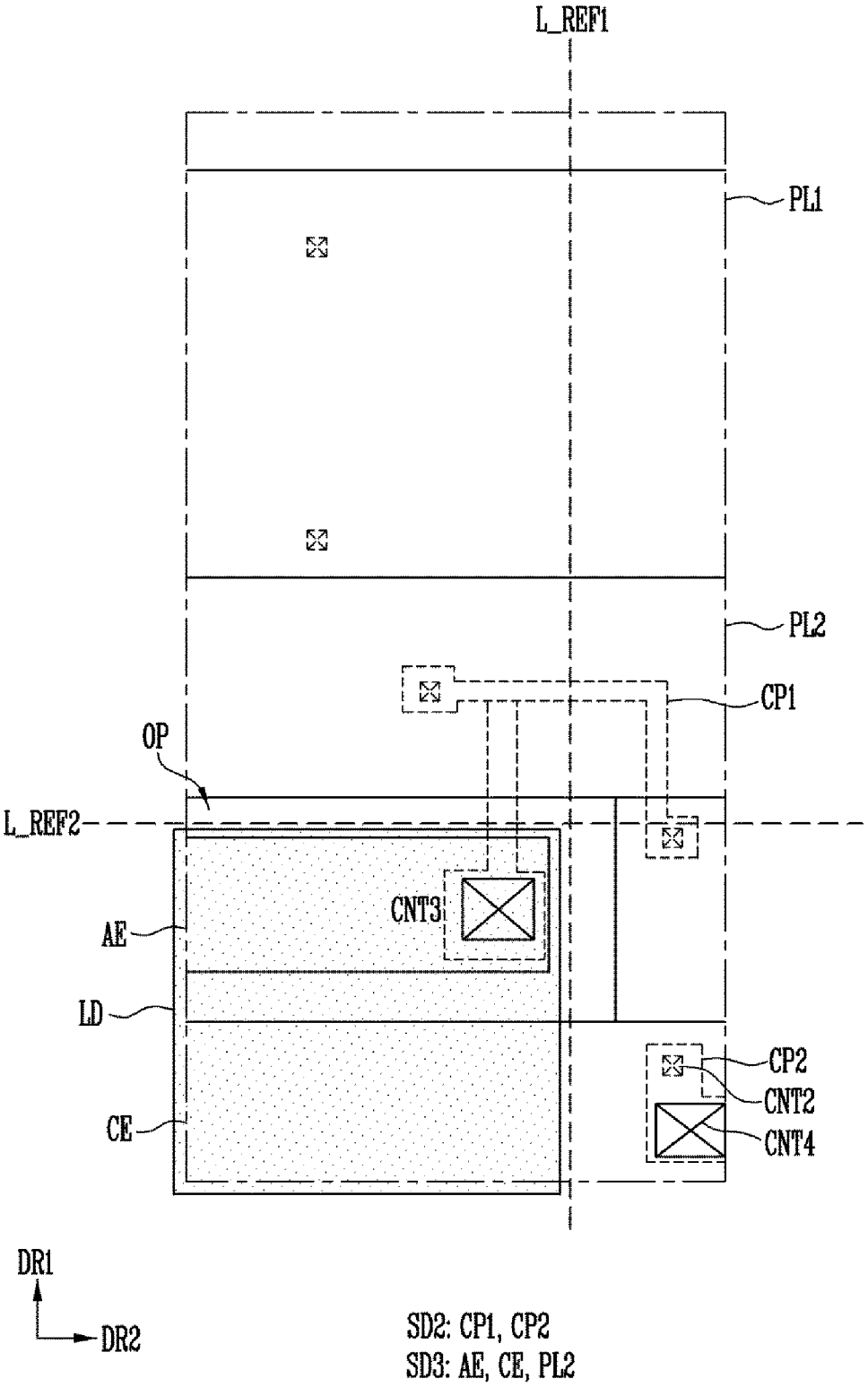
FIG. 14 is a plan view illustrating conductive layers included in the pixel of FIG. 12 in accordance with an exemplary embodiment.

FIG. 14 is a plan view illustrating conductive layers included in the pixel PX of FIG. 12 in accordance with an exemplary embodiment. In FIG. 14, there are illustrated the fourth conductive layer SD2, the fifth conductive layer SD3, and the light emitting element LD.

The anode electrode AE may overlap with a portion (i.e., the width-increased portion) of the first bridge pattern CP1 in the emission area A_LD, and be coupled with the first bridge pattern CP1 through a contact hole (or a via hole) CNT3 through which the portion of the first bridge pattern CP1 is exposed. In this case, the anode electrode AE may be coupled to the first electrode of the sixth transistor M6, the first electrode of the seventh transistor M7, and the first electrode of the eighth transistor M8 through the first bridge pattern CP1.

The cathode electrode CE may be disposed at a position spaced apart from the anode electrode AE in the emission area A_LD, and overlap with the first emission capacitor electrode E1_CLD. The cathode electrode CE may form a second emission capacitor electrode of the light emitting element (LD; refer to FIG. 2), and form the emission capacitor (CLD; refer to FIG. 2) along with the first emission capacitor electrode E1_CLD.

Furthermore, the cathode electrode CE may extend in the second direction DR2 and overlap with the second bridge pattern CP2 in the second circuit area A_PXC2. The cathode electrode CE may be coupled to the second bridge pattern CP2 through the contact hole CNT4 through which the second bridge pattern CP2 is exposed. In this case, the cathode electrode CE may be coupled to the second electrode of the eighth transistor M8 through the second bridge pattern CP2.

The second power line PL2 may cover the first circuit area A_PXC1, the second circuit area A_PXC2, and the peripheral area A_PER, other than the emission area A_LD. The second power line PL2 may be integrally formed with the cathode electrode CE. The second power line PL2 may include an opening OP in the emission area A_LD. The anode electrode AE may be disposed in the opening OP and spaced apart from the second power line PL2 by a predetermined distance. Although will be described below, the second power line PL2 may be disposed in the overall area of the base layer (SUB; refer to FIG. 11A) except the opening OP in the emission area A_LD.

The light emitting element LD may be disposed in the emission area A_LD. A portion of the light emitting element LD may be coupled to the anode electrode AE, and another portion of the light emitting element LD may be coupled to the cathode electrode CE.

The fifth conductive layer SD3 may include one or more metals selected from among molybdenum (Mo), aluminum (Al), platinum (Pt), palladium (Pd), silver (Ag), magnesium (Mg), gold (Au), nickel (Ni), neodymium (Nd), iridium (Ir), chrome (Cr), titanium (Ti), tantalum (Ta), tungsten (W), and copper (Cu). The fifth conductive layer SD3 may have a single-layer or multi-layer structure. For example, the fifth conductive layer SD3 may have a multi-layer structure of Ti/Al/Ti.

Figure 15:
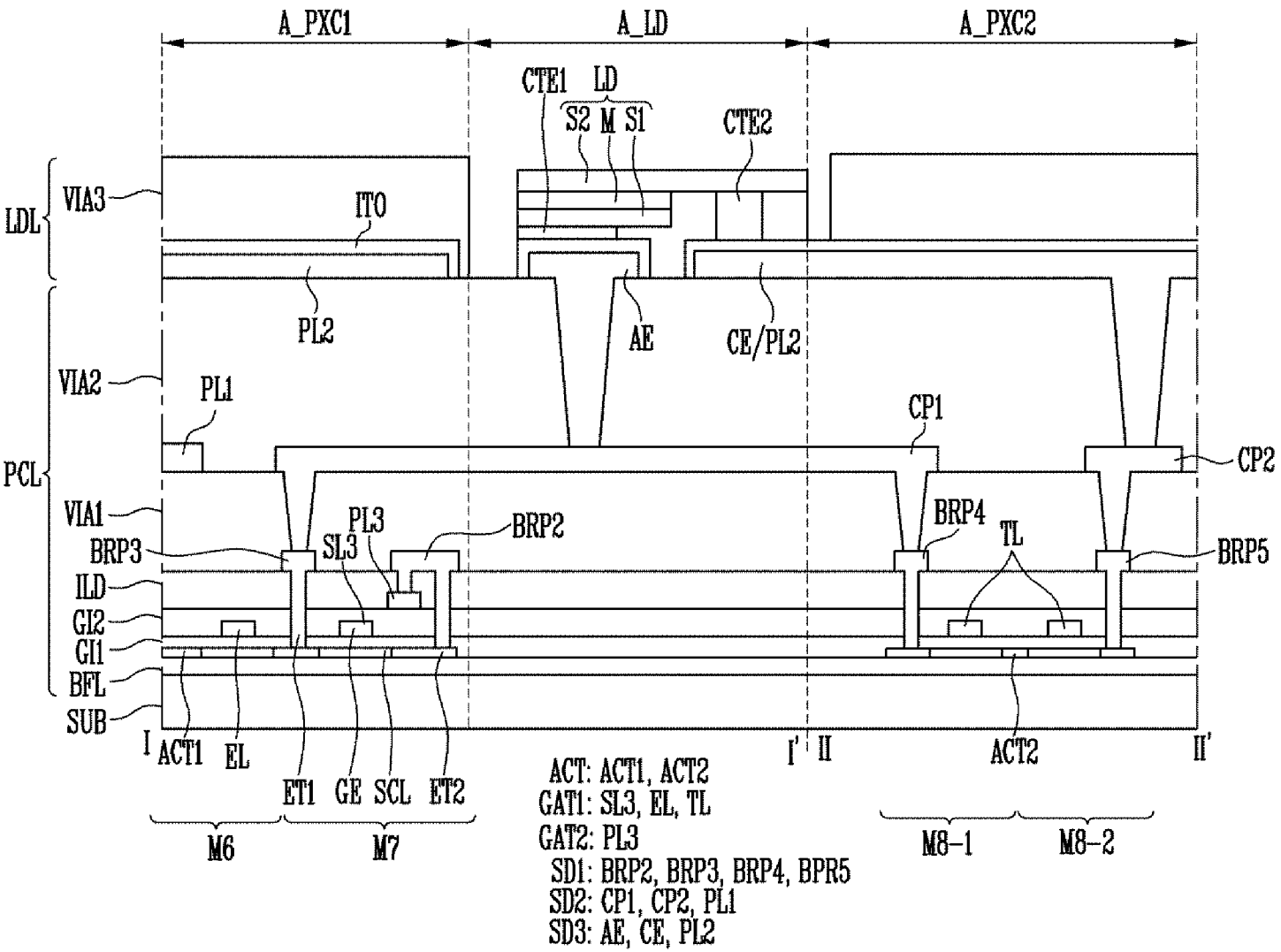
FIG. 15 is a sectional view illustrating an example of the pixel, taken along sectional lines I-I' and II-II' of FIG. 12.

FIG. 15 is a sectional view illustrating an example of the pixel PX, taken along sectional lines I-I' and II-IF of FIG. 12.

Referring to FIGS. 12, 13, 14, and 15, the pixel PX may include a pixel circuit layer PCL and a light emitting element layer LDL that are stacked on the base layer SUB. The pixel circuit layer PCL may include a buffer layer BFL, the semiconductor layer ACT, a first insulating layer GI1 (or a first gate insulating layer), the first conductive layer GAT1, a second insulating layer GI2 (or a second gate insulating layer), the second conductive layer GAT2, a third insulating layer ILD (or an intermediate insulating layer), the third conductive layer SD1, a first via layer VIA1 (or a fourth insulating layer), the fourth conductive layer SD2, and a second via layer VIA2 (or a fifth insulating layer). The light emitting element layer LDL may include the fifth conductive layer SD3, a third via layer VIA3 (or a sixth insulating layer), and the light emitting element LD.

The buffer layer BFL, the semiconductor layer ACT, the first insulating layer GI1, the first conductive layer GAT1, the second insulating layer GI2, the second conductive layer GAT2, the third insulating layer ILD, the third conductive layer SD1, the first via layer VIA1, the fourth conductive layer SD2, the second via layer VIA2, the fifth conductive layer SD3, and the third via layer VIA3 may be sequentially stacked on the base layer SUB. Since the semiconductor layer ACT, the first conductive layer GAT1, the second conductive layer GAT2, the third conductive layer SD1, the fourth conductive layer SD2, and the fifth conductive layer SD3 have been described with reference to FIGS. 12, 13, and 14, repetitive explanation thereof will be omitted.

The buffer layer BFL may be disposed on the overall surface of the base layer SUB. The buffer layer BFL may prevent or suppress impurity ions from being diffused, prevent or suppress penetration of water or outside air, and perform a surface planarization function. The buffer layer BFL may include inorganic insulating material. For example, the buffer layer BFL may include at least one of silicon oxide (SiOx), silicon nitride (SiNx), and silicon oxynitride (SiON). For example, the buffer layer BFL may be a bilayer structure including a silicon oxide layer with a thickness of approximately 2000 Å and a silicon nitride layer with a thickness of approximately 500 Å. The buffer layer BFL may be omitted depending on the type of the base layer SUB or processing conditions.

The semiconductor layer ACT may be disposed on the buffer layer BFL. The semiconductor layer ACT may be disposed between the buffer layer BFL and the first insulating layer GI1. The semiconductor layer ACT may include a first area which comes into contact with a first transistor electrode ET1, a second area which comes into contact with a second transistor electrode ET2, and a channel area disposed between the first and second areas. The semiconductor layer ACT may be a semiconductor pattern formed of poly silicon, amorphous silicon, an oxide semiconductor, or the like. For example, the semiconductor layer ACT may include a poly silicon layer with a thickness ranging from approximately 400 Å to 500 Å. The channel area of the semiconductor layer ACT may be an intrinsic semiconductor, which is an undoped semiconductor pattern. Each of the first and second areas of the semiconductor layer ACT may be a semiconductor pattern doped with a predetermined impurity.

As described with reference to FIGS. 12 and 13, the semiconductor layer ACT may include the first semiconductor pattern ACT1 disposed in the first circuit area A_PXC1, and the second semiconductor pattern ACT2 disposed in the second circuit area A_PXC2. The first semiconductor pattern ACT1 may include a channel area of each of the sixth transistor M6 and the seventh transistor M7. The second semiconductor pattern ACT2 may include the channel area of the eighth transistor M8 (or the first and second sub-transistors M8-1 and M8-2 of the eighth transistor M8).

The first insulating layer GI1 may be disposed on the semiconductor layer ACT and the buffer layer BFL (or the base layer SUB). The first insulating layer GI1 may be disposed over an approximately overall surface of the base layer SUB. The first insulating layer GI1 may be a gate insulating layer having a gate insulating function.

The first insulating layer GI1 may include inorganic insulating material such as a silicon compound or metal oxide. For example, the first insulating layer GI1 may include silicon oxide, silicon nitride, silicon oxynitride, aluminum oxide, tantalum oxide, hafnium oxide, zirconium oxide, titanium oxide, or a combination thereof. The first insulating layer GI1 may have a single layer structure or a multi-layer structure including stacked layers formed of different materials. For example, the first insulating layer GI1 may have a single layer structure having a thickness ranging from 1000 Å to 1500 Å and including silicon oxide.

The first conductive layer GAT1 may be disposed on the first insulating layer GI1. The first conductive layer GAT1 may include the emission control line EL, the third scan line SL3, and the test line TL. The emission control line EL may overlap with the channel area of the sixth transistor M6 and form the gate electrode of the sixth transistor M6. The third scan line SL3 may overlap with the channel area of the seventh transistor M7 and form the gate electrode of the seventh transistor M7. The test line TL may overlap with the channel area of the eighth transistor M8 and form the gate electrode of the eighth transistor M8.

Furthermore, in the case where the eighth transistor M8 is implemented as a dual-gate transistor, two gate electrodes may be spaced apart from each other and overlap with the second semiconductor pattern ACT2.

As illustrated with reference to FIG. 12, the first conductive layer GAT1 may have a single layer structure including molybdenum and have a thickness of approximately 3000 Å.

The second insulating layer GI2 may be disposed on the first insulating layer GI1 and the first conductive layer GAT1. The second insulating layer GI2 may be disposed over the overall surface of the base layer SUB.

The second insulating layer GI2 may include inorganic insulating material such as a silicon compound or metal oxide in a manner similar to that of the first insulating layer GI1. For example, the second insulating layer GI2 may have a single layer structure having a thickness ranging from 1000 Å to 1500 Å and including silicon nitride.

The second conductive layer GAT2 may be disposed on the second insulating layer GI2. The second conductive layer GAT2 may include the third power line PL3.

As illustrated with reference to FIG. 12, the second conductive layer GAT2 may have a single layer structure including molybdenum and have a thickness of approximately 3000 Å.

The third insulating layer ILD may be disposed on the second insulating layer GI2 and the second conductive layer GAT2. The third insulating layer ILD may be disposed over an approximately overall surface of the base layer SUB.

The third insulating layer ILD may include inorganic insulating material such as a silicon compound or metal oxide. For example, the third insulating layer ILD may include silicon oxide, silicon nitride, silicon oxynitride, aluminum oxide, tantalum oxide, hafnium oxide, zirconium oxide, titanium oxide, or a combination thereof. The third insulating layer ILD may have a single layer structure or a multi-layer structure including stacked layers formed of different materials. For example, the third insulating layer ILD may have a multi-layer structure formed by stacking a silicon nitride layer and a silicon oxide layer each of which has a thickness of 2500 Å.

The third conductive layer SD1 may be disposed on the third insulating layer ILD. The third conductive layer SD1 may include second to fifth conductive patterns BRP2 to BRP5.

The third conductive pattern BRP3 may be coupled to a portion of the first semiconductor pattern ACT1 through a contact hole passing through the first to third insulating layers GI1, GI2, and ILD, and form the first transistor electrode ET1 of each of the sixth and seventh transistors M6 and M7.

The second conductive pattern BRP2 may be coupled to the third power line PL3 through a contact hole passing through the third insulating layer ILD, be coupled to a portion of the first semiconductor pattern ACT1 through a contact hole passing through the first to third insulating layers GI1, GI2, and ILD, and form the second transistor electrode ET2 of the seventh transistor M7.

The fourth conductive pattern BRP4 may be coupled to a portion of the second semiconductor pattern ACT2 through a contact hole passing through the first to third insulating layers GI1, GI2, and ILD, and form the first transistor electrode ET1 of the eighth transistor M8.

Likewise, the fifth conductive pattern BRP5 may be coupled to a portion of the second semiconductor pattern ACT2 through a contact hole passing through the first to third insulating layers GI1, GI2, and ILD, and form the second transistor electrode ET2 of the eighth transistor M8.

As illustrated with reference to FIG. 12, the third conductive layer SD1 may have a multi-layer structure including Ti/Al/Ti and have a thickness of approximately 7000 Å.

The first via layer VIA1 may be disposed on the third insulating layer ILD and the third conductive layer SD1. The first via layer VIA1 may be disposed over an approximately overall surface of the base layer SUB.

The first via layer VIA1 may include organic insulating material such as polyacrylate-based resin, epoxy resin, phenolic resin, polyamide-based resin, polyimide-based resin, unsaturated polyesters resin, polyphenylen ether-based resin, polyphenylene sulfide-based resin, or benzocyclobutene (BCB). The first via layer VIA1 may have a single layer structure or a multi-layer structure including stacked layers formed of different materials. For example, the first via layer VIA1 may include polyimide-based resin and have a thickness ranging from approximately 15000 Å to 20000 Å.

The fourth conductive layer SD2 may be disposed on the first via layer VIAL The fourth conductive layer SD2 may include the first power line PL1, the first bridge pattern CP1, and the second bridge pattern CP2.

The first bridge pattern CP1 may extend through the first circuit area A_PXC1, the emission area A_LD, and the second circuit area A_PXC2 and be coupled to each of the third conductive pattern BRP3 and the fourth conductive pattern BRP4 through contact holes (or via holes) passing through the first via layer VIA1.

The second bridge pattern CP2 may be coupled to the fifth conductive pattern BRP5 through contact holes passing through the first via layer VIA1 in the second circuit area A_PXC2.

As illustrated with reference to FIG. 12, the fourth conductive layer SD2 may have a multi-layer structure including Ti/Al/Ti and have a thickness of approximately 7000 Å.

The second via layer VIA2 may be disposed on the first via layer VIA1 and the fourth conductive layer SD2. The second via layer VIA2 may be disposed over an approximately overall surface of the base layer SUB. The second via layer VIA2 may include polyimide-based resin in a manner similar to that of the first via layer VIA1, and have a thickness of approximately 30000 Å.

The light emitting element layer LDL may be disposed on the second via layer VIA2. The light emitting element layer LDL may include the fifth conductive layer SD3, the third via layer VIA3 (or a pixel defining layer), and the light emitting element LD.

The fifth conductive layer SD3 may be disposed on the second via layer VIA2 and include the anode electrode AE and the cathode electrode CE of the light emitting element LD and the second power line PL2. The anode electrode AE, the cathode electrode CE, and the second power line PL2 may be disposed on the same layer through the same process. Furthermore, as described with reference to FIGS. 12 and 14, the cathode electrode CE may be integrally formed with the second power line PL2.

The anode electrode AE may be coupled with the first bridge pattern CP1 through a contact hole (or a via hole) passing through the second via layer VIA2 in the emission area A_LD.

In embodiments, the anode electrode AE and the cathode electrode CE (and the second power line PL2) each may have a multi-layer structure. For example, the anode electrode AE and the cathode electrode CE each may include an opaque electrode layer having a multi-layer structure that has a thickness 7000 Å and includes Ti/Al/Ti, in a manner similar to that of the fourth conductive layer SD2, and may further include a transparent electrode layer ITO which has a thickness of 500 Å and is disposed on the opaque electrode layer to cover the opaque electrode layer. The transparent electrode layer ITO may cap the anode electrode AE and the cathode electrode CE (and the second power line PL2), thus preventing or suppressing the anode electrode AE and the cathode electrode CE (and the second power line PL2) from being damaged.

The cathode electrode CE or the second power line PL2 may partially overlap with the first bridge pattern CP1 so that the emission capacitor (CLD; refer to FIG. 2) described with reference to FIG. 12 may be formed.

The third via layer VIA3 may be disposed on the second via layer VIA2, include polyimide-based resin in a manner similar to that of the first via layer VIA1, and have a thickness of approximately 16000 Å.

The third via layer VIA3 may expose the anode electrode AE and the cathode electrode CE. The third via layer VIA3 may separate adjacent pixels from each other, and define the pixel area (or the emission area A_LD) on which the light emitting element (LD; refer to FIG. 14) is formed or mounted.

The light emitting element LD may be disposed on the anode electrode AE and the cathode electrode CE.

The light emitting element LD may be a light emitting element having a micrometer size. The light emitting element LD may include a first semiconductor layer S1, an intermediate layer M, and a second semiconductor layer S2 that are sequentially stacked. The anode electrode AE may be coupled to the first semiconductor layer Si of the light emitting element LD through the first contact electrode CTE1. The cathode electrode CE may be coupled to the second semiconductor layer S2 through the second contact electrode CTE2. The first semiconductor layer S1 may be a P-type semiconductor layer. The second semiconductor layer S2 may be an N-type semiconductor layer. The intermediate layer M may be an area in which electrons and holes are recombined.

As illustrated in FIG. 15, the anode electrode AE and the cathode electrode CE of the light emitting element LD may be disposed in the same layer on the pixel circuit layer PCL. In other words, before the light emitting element LD is supplied or disposed, the anode electrode AE and the cathode electrode CE are formed. Therefore, a test and a failure detection operation for the first to seventh transistors M1 to M7 (particularly, the sixth transistor M6 and the seventh transistor M7) may be performed through the eighth transistor M8 described with reference to FIG. 2.

For reference, in the case of a pixel in which the light emitting element is disposed on the anode electrode AE and the cathode electrode CE is formed on the light emitting element, a test on some transistors (e.g., the sixth transistor M6 and the seventh transistor M7 illustrated in FIG. 2) to be coupled to the cathode electrode CE (and the second power line PL2) may be performed after the light emitting element has been disposed. In this case, because a failure of some transistors may be detected after the light emitting element has been disposed, the production cost may be increased.

The display device 10 (or the display panel 100 and the pixel PX) in accordance with embodiments of the present disclosure may include the anode electrode AE and the cathode electrode CE that are formed in the same layer, and the eighth transistor M8 electrically coupled to the anode electrode AE and the cathode electrode CE. Therefore, before the light emitting element LD is disposed, all tests for the pixel PX (or the pixel circuit included in the pixel circuit layer PCL) may be performed.

Figure 16A:
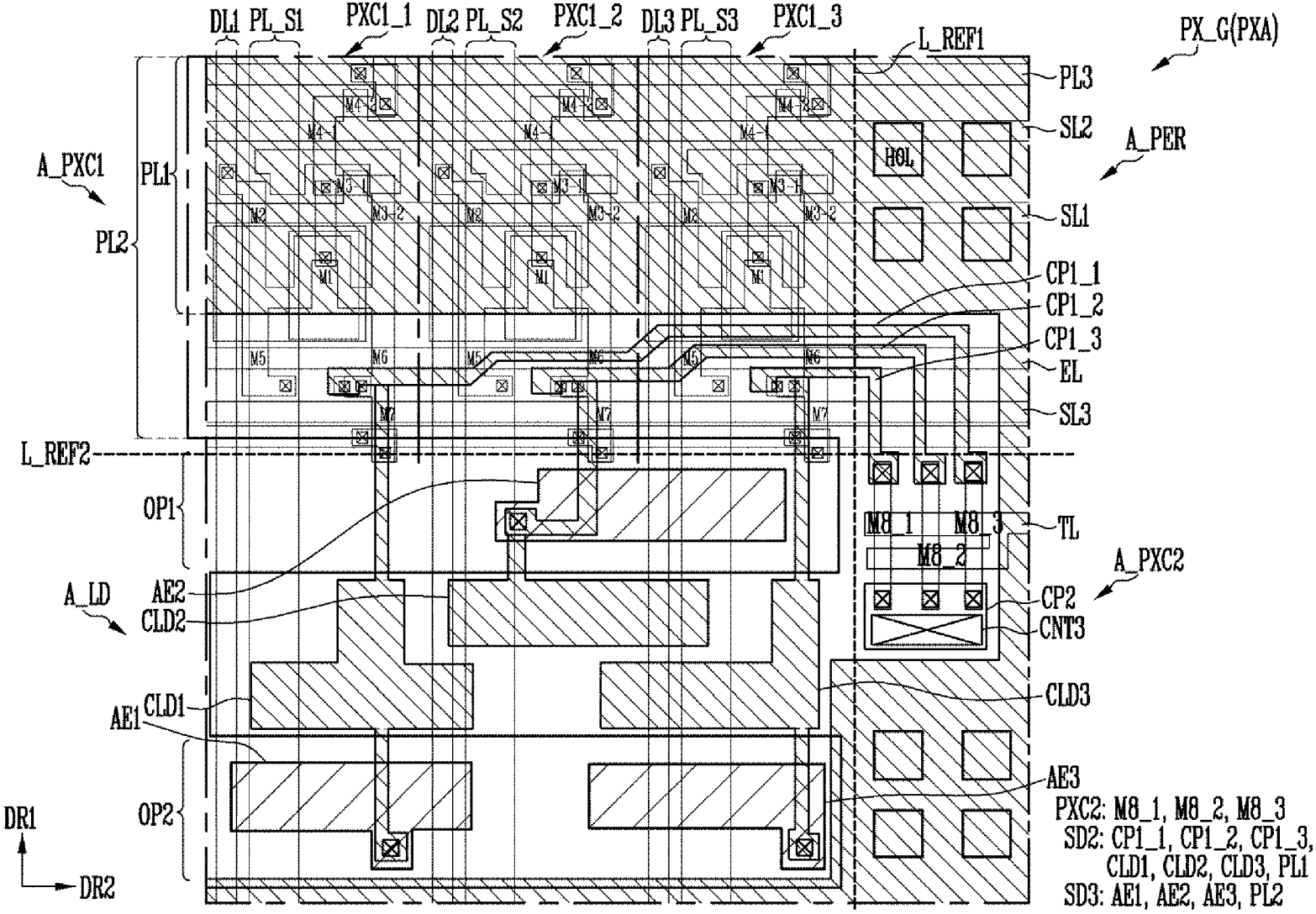
FIGS. 16A, 16B, 16C, and 16D are layouts illustrating pixels included in the display device of FIG. 1B in accordance with an exemplary embodiment.
Figure 16B:
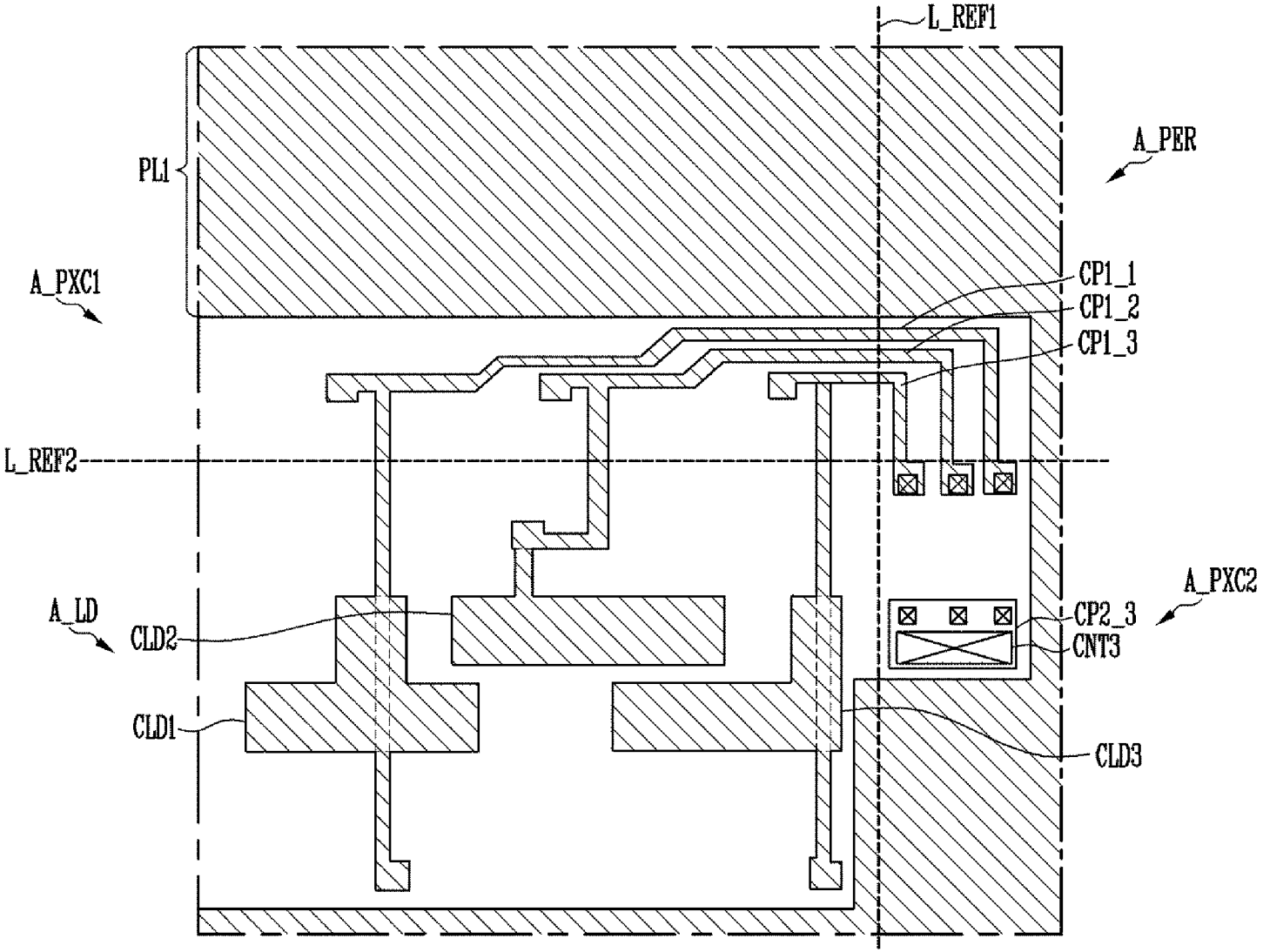
Figure 16C:
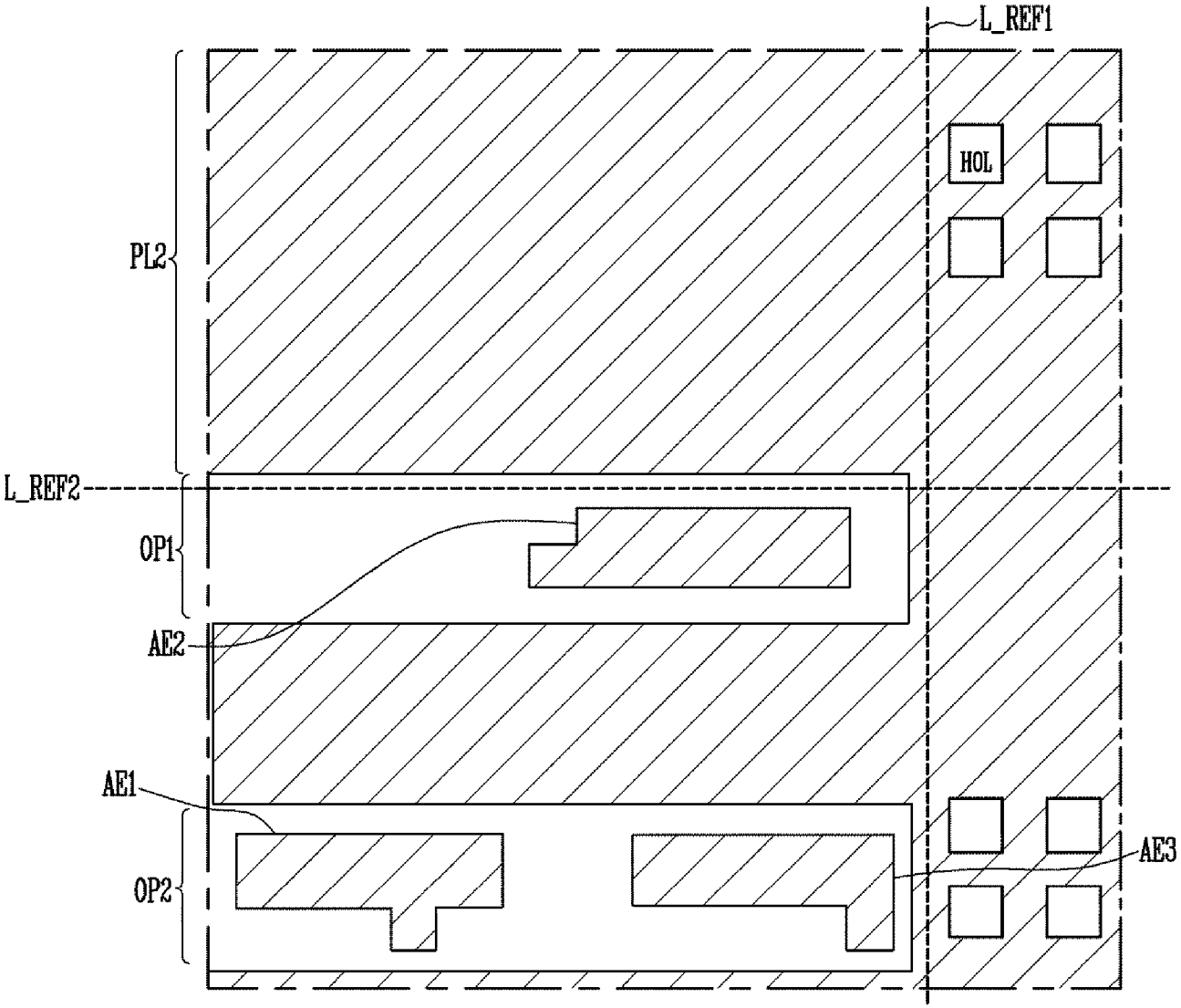

FIGS. 16A, 16B, 16C, and 16D are layouts illustrating pixels PX included in the display device 10 of FIG. 1B in accordance with an exemplary embodiment. FIG. 16A illustrates a unit pixel PX_G (i.e., a pixel including sub-pixels) corresponding to the pixel PX of FIG. 12. FIG. 16B illustrates a fourth conductive layer SD2 included in FIG. 16A. FIG. 16C illustrates a fifth conductive layer SD3 included in FIG. 16A.

Referring to FIGS. 1B and 16A, the base layer (or substrate) SUB may include a pixel area PXA. The pixel area PXA may include an emission area A_LD, a first circuit area A_PXC1, and a second circuit area A_PXC2. The pixel area PXA may further include a peripheral area A_PER.

The emission area A_LD, the first circuit area A_PXC1, the second circuit area A_PXC2, and the peripheral area A_PER may be separated from each other by a first reference line L_REF1 extending in a first direction DR1 and a second reference line L_REF2 extending in a second direction DR2. The first reference line L_REF1 may be parallel to data lines DL1, DL2, and DL3, and the second reference line L_REF2 may be parallel to a scan line SL.

With respect to the emission area A_LD, the first circuit area A_PXC1 may be disposed in an area adjacent to the emission area A_LD in the first direction DR1, and the second circuit area A_PXC2 may be disposed in an area adjacent to the emission area A_LD in the second direction DR2.

Figure 16D:
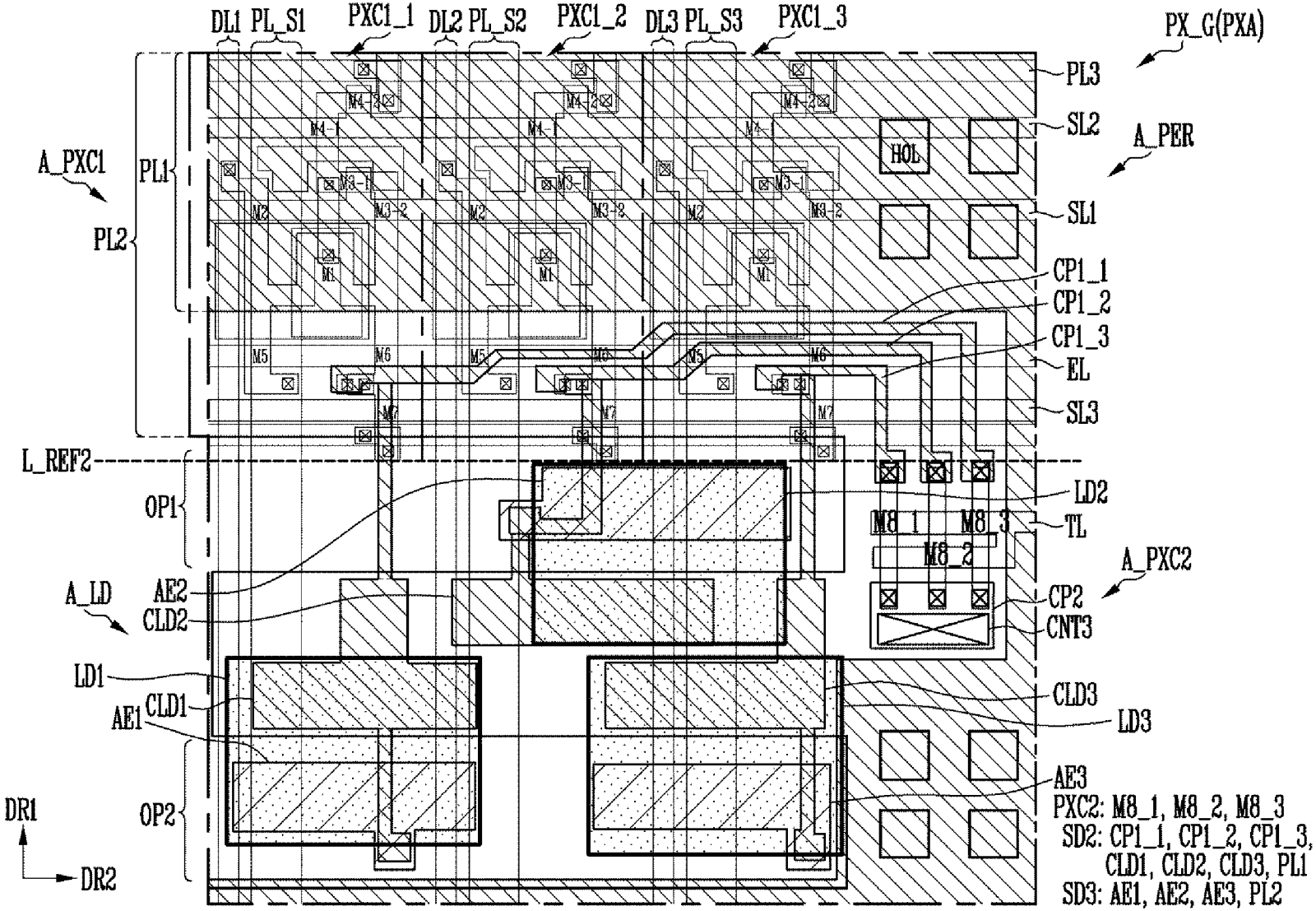

As illustrated in FIG. 16D, first to third light emitting elements LD1, LD2, and LD3 may be disposed in the emission area A_LD of the base layer SUB. First to third pixel circuits PXC1_1, PXC1_2, PXC1_3 (or first to third sub-pixel circuits) may be disposed sequentially along the second direction DR2 on the first circuit area A_PXC1 of the base layer SUB. A test circuit PXC2 may be disposed in the second circuit area A_PXC2.

Each of the first to third pixel circuits PXC1_1, PXC1_2, and PXC1_3 is substantially equal to or similar to the pixel circuit PXC1 described with reference to FIGS. 12, 13, 14, and 15; therefore, repetitive explanation thereof will be omitted.

Each of the data lines DL1, DL2, and DL3 may extend in the first direction DR1, and may be substantially equal to the data line DL described with reference to FIG. 12. The data lines DL1, DL2, and DL3 may be repeatedly disposed along the second direction DR2, in response to the first to third pixel circuits PXC1_1, PXC1_2, and PXC1_3. The first to third pixel circuits PXC1_1, PXC1_2, and PXC1_3 may be separated from each other by the data lines DL1, DL2, and DL3.

Referring to FIGS. 16A and 16B, the fourth conductive layer SD2 may include a first sub-bridge pattern CP1_1 (or a first sub-connection line), a second sub-bridge pattern CP1_2, a third sub-bridge pattern CP1_3, a first emission capacitor CLD1 (or a first emission capacitor electrode), a second emission capacitor CLD2 (or a second emission capacitor electrode), a third emission capacitor CLD3 (or a third emission capacitor electrode), and the first power line PL1.

The first emission capacitor CLD1, the second emission capacitor CLD2, and the third emission capacitor CLD3 may be formed or disposed in an area overlapping with the second power line PL2 in the emission area A_LD.

The first sub-bridge pattern CP1_1 of the first pixel circuit PXC1_1 may extend in the first direction DR1 and be coupled with the first emission capacitor CLD1 in the emission area A_LD. The first sub-bridge pattern CP1_1 of the first pixel circuit PXC1_1 may be integrally formed with an electrode of the first emission capacitor CLD1. The first sub-bridge pattern CP1_1 may extend from the first pixel circuit PXC1_1 to the second circuit area A_PXC2 via the second pixel circuit PXC1_2 (or the second sub-pixel circuit area), the third pixel circuit PXC1_3 (or the third sub-pixel circuit area), and the peripheral area A_PER, and may be coupled to a first electrode of a first auxiliary transistor M8_1 in the test circuit PXC2. Here, the first auxiliary transistor M8_1 may be substantially equal to the eighth transistor M8 described with reference to FIG. 12.

Likewise, the second sub-bridge pattern CP1_2 Of the second pixel circuit PXC1_2 may extend in the first direction DR1 and be coupled with the second emission capacitor CLD2 in the emission area A_LD. The second sub-bridge pattern CP1_2 may be integrally formed with an electrode of the second emission capacitor CLD2. Also, the second sub-bridge pattern CP1_2 may extend to the second circuit area A_PXC2 in a manner similar to that of the first sub-bridge pattern CP1_1 and be coupled to a first electrode of a second auxiliary transistor M8_2 in the test circuit PXC2.

The third sub-bridge pattern CP1_3 of the third pixel circuit PXC1_3 may extend in the first direction DR1 and be coupled with the third emission capacitor CLD3 in the emission area A_LD. The third sub-bridge pattern CP1_3 may be integrally formed with an electrode of the third emission capacitor CLD3. Also, the third sub-bridge pattern CP1_3 may extend to the second circuit area A_PXC2 in a manner similar to that of the first sub-bridge pattern CP1_1 and be coupled to a first electrode of a third auxiliary transistor M8_3 in the test circuit PXC2.

The first power line PL1 may extend in the second direction DR2 and be disposed in the overall areas of the first circuit area A_PXC1, the peripheral area A_PER, and the second circuit area A_PXC2 within a range in which the first power line PL1 does not overlap with the first to third sub-bridge patterns CP1_1, CP1_2, and CP1_3. The first power line PL1 may include a hole HOL through which the first via layer VIA1 is exposed from the peripheral area A_PER.

Referring to FIGS. 16A and 16C, the fifth conductive layer SD3 may include the second power line PL2, a first anode electrode AE1, a second anode electrode AE2, and a third anode electrode AE3.

The second power line PL2 may be disposed on the overall surface of the pixel area PXA other than the first opening OP1 and the second opening OP2 that are formed in the emission area A_LD. The first opening OP1 may be formed adjacent to the first circuit area A_PXC1 in the emission area A_LD. The second opening OP2 may be formed in the emission area A_LD at a position spaced apart from the first opening OP1 in the first direction DR1. The size of the second opening OP2 may be equal to that of the first opening OP1; but the present disclosure is not limited thereto.

The second power line PL2 may be coupled in the second circuit area A_PXC2 to the second bridge pattern CP2 through a contact hole (or a via hole) through which the second bridge pattern CP2 is exposed, and may be coupled to the second electrode of the eighth transistor M8 through the second bridge pattern CP2.

The second anode electrode AE2 may be disposed in the first opening OP1 and spaced apart from the second power line PL2. The first anode electrode AE1 and the third anode electrode AE3 each may be disposed in the second opening OP2 and spaced apart from the second power line PL2.

The first light emitting element LD1 may be disposed to partially overlap with the first anode electrode AE1 and the first emission capacitor CLD1. The second light emitting element LD2 may be disposed to partially overlap with the second anode electrode AE2 and the second emission capacitor CLD2. The third light emitting element LD3 may be disposed to partially overlap with the third anode electrode AE3 and the third emission capacitor CLD3. Each of the first to third light emitting elements LD1, LD2, and LD3 is substantially equal to or similar to the light emitting element LD described with reference to FIGS. 14 and 15; therefore, repetitive explanation thereof will be omitted.

In an exemplary embodiment, each of the first to third light emitting elements LD1, LD2, and LD3 may emit light with a different single color. For example, the first light emitting element LD1 may emit light with a first color (e.g., green), the second light emitting element LD2 may emit light with a second color (e.g., red), and the third light emitting element LD3 may emit light with a third color (e.g., blue).

The first pixel circuit PXC1_1, the first light emitting element LD1, and the first auxiliary transistor M8_1 may form a first pixel (or a first sub-pixel). The second pixel circuit PXC1_2, the second light emitting element LD2, and the second auxiliary transistor M8_2 may form a second pixel (or a second sub-pixel). The third pixel circuit PXC1_3, the third light emitting element LD3, and the third auxiliary transistor M8_3 may form a third pixel (or a third sub-pixel). The unit pixel PX_G may include first to third pixels that emit light with different colors.

As described with reference to FIGS. 16A, 16B, 16C, and 16D, in the case where the unit pixel PX_G includes a plurality of pixels, the light emitting elements LD1, LD2, and LD3 of the pixels may also be disposed in the emission area A_LD. The pixel circuits PXC1_1, PXC1_2, and PXC1_3 of the pixels may also be disposed in the first circuit area A_PXC1 separated from the emission area A_LD. The test circuit PXC2 may also be disposed in the second circuit area A_PXC2 separated from the emission area A_LD and the first circuit area A_PXC1.

Hence, even when high temperature and/or high pressure is generated during a process of bonding the light emitting elements LD1, LD2, and LD3 to the base layer SUB, the transistors in the pixel circuits PXC1_1, PXC1_2, and PXC1_3 may be prevented or suppressed from being damaged by the high temperature and/or high pressure. Furthermore, damage to the eighth transistor M8 due to static electricity drawn through the anode electrodes AE1, AE2, and AE3 may be prevented or suppressed from leading to damage to the pixel circuits PXC1_1, PXC1_2, and PXC1_3.

Figure 17:
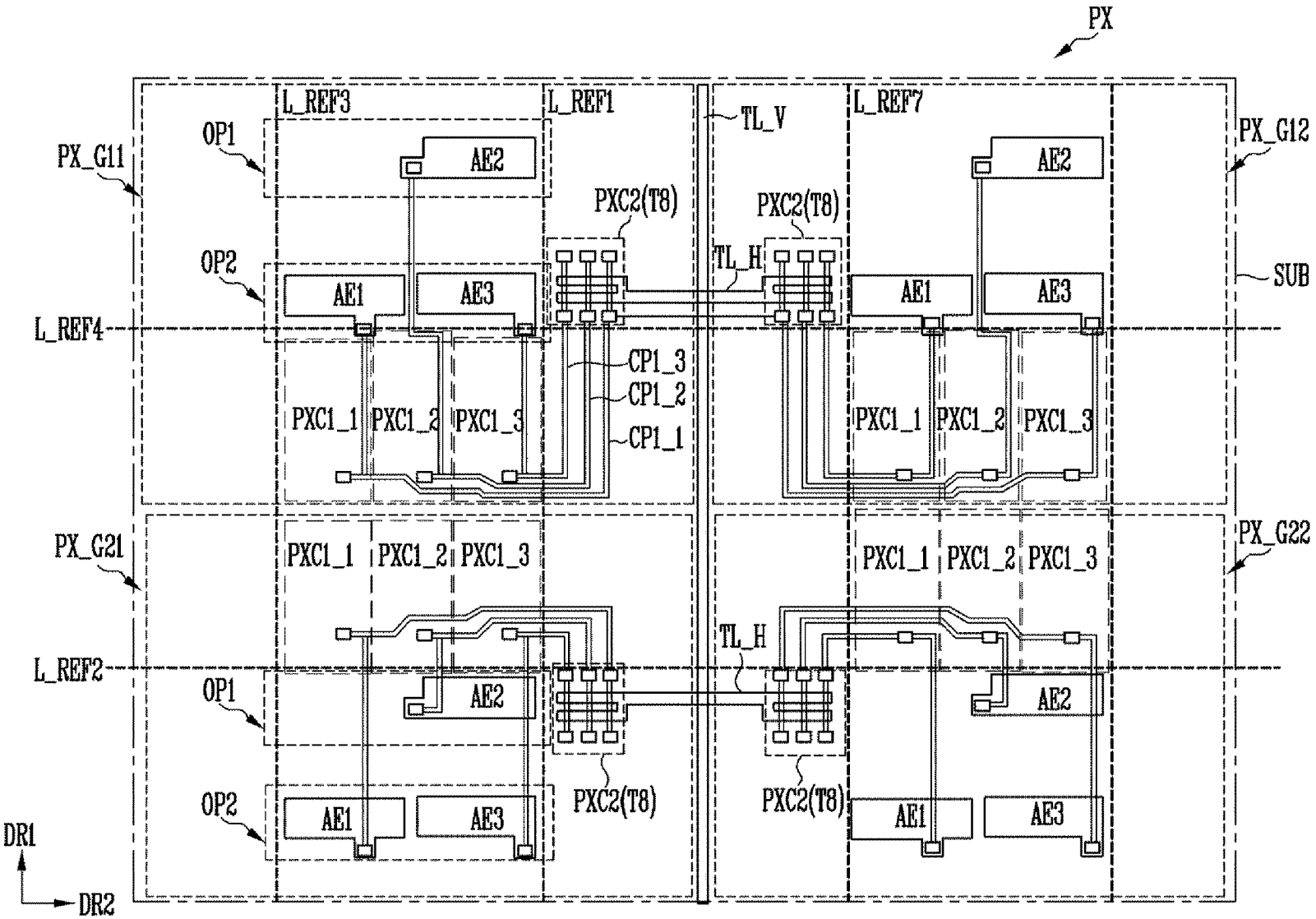
FIG. 17 is a plan view illustrating pixels included in the display device of FIG. 1B in accordance with an exemplary embodiment.

FIG. 17 is a plan view illustrating pixels PX included in the display device 10 of FIG. 1B in accordance with an exemplary embodiment. FIG. 17 schematically illustrates the pixels PX, focused on connection relationship between the test circuit PXC2 and the pixel electrodes (i.e., the cathode electrode and the anode electrode) of the unit pixel PX_G described with reference to FIG. 16A.

Referring to FIGS. 16A and 17, each of unit pixels PX_G11, PX_G12, PX_G21, and PX_G22 is substantially equal to or similar to the unit pixel PX_G described with reference to FIG. 16A; therefore, repetitive explanation thereof will be omitted.

A first sub-test line TL_V extending in the first direction DR1 may be provided on the base layer SUB. The first sub-test line TL_V may be included in the third conductive layer (SD1; refer to FIG. 12) described with reference to FIG. 12 and be formed in the same layer through the same process as the data line (DL; refer to FIG. 12).

The 11-th unit pixel PX_G11 disposed on a first row and a first column and the 12-th unit pixel PX_G12 disposed on the first row and a second column may be approximately symmetrical with each other with respect to the first sub-test line TL_V.

Disposition of the first to third pixel circuits PXC1_1, PXC1_2, and PXC1_3 and the anode electrodes AE1, AE2, and AE3 of the 12-th unit pixel PX_G12 may be substantially equal to that of the first to third pixel circuits PXC1_1, PXC1_2, and PXC1_3 and the anode electrodes AE1, AE2, and AE3 of the 11-th unit pixel PX_G11.

The test circuit PXC2 of the 11-th unit pixel PX_G11 may be disposed in an area (e.g., a second circuit area) between the anode electrodes AE1, AE2, and AE3 (or the emission area in which the anode electrodes AE1, AE2, and AE3 are disposed) of the 11-th unit pixel PX_G11 and the first sub-test line TL_V. The test circuit PXC2 of the 12-th unit pixel PX_G12 may be disposed in an area between the anode electrodes AE1, AE2, and AE3 of the 12-th unit pixel PX_G12 and the first sub-test line TL_V. The test circuit PXC2 of the 12-th unit pixel PX_G12 may be adjacent to the test circuit PXC2 of the 11-th unit pixel PX_G11. In other words, the test circuit PXC2 of the 11-th unit pixel PX_G11 and the test circuit PXC2 of the 12-th unit pixel PX_G12 may be provided in an area between the first reference line L_REF1 and a seventh reference line L_REF7.

A second sub-test line TL_H may be provided in the area between the first reference line L_REF1 and the seventh reference line L_REF7. The second sub-test line TL_H may be substantially equal to or similar to the test line TL described with reference to FIG. 12. The second sub-test line TL_H may extend in the second direction DR2, overlap with the first sub-test line TL_V, and be coupled with the first sub-test line TL_V through a contact hole (not illustrated). In this case, a test signal applied to the first sub-test line TL_V from an external device may be transmitted to the second sub-test line TL_H. Furthermore, the second sub-test line TL_H may be coupled with the test circuit PXC2 of the 11-th unit pixel PX_G11 and the test circuit PXC2 of the 12-th unit pixel PX_G12, and may form the gate electrode of the eighth transistor M8 in the test circuit PXC2 or be coupled to the gate electrode.

In the 11-th unit pixel PX_G11, as described with reference to FIGS. 16A and 16B, the sub-bridge patterns CP1_1, CP1_2, and CP1_3 may be disposed across the peripheral area ("A_PER" in FIGS. 16A and 16B) and be coupled to the first to third pixel circuits PXC1_1, PXC1_2, and PXC1_3 (and/or the anode electrodes AE1, AE2, and AE3) and the test circuit PXC2.

In the 21-th unit pixel PX_G21, the first to third pixel circuits PXC1_1, PXC1_2, and PXC1_3 may be disposed in the first direction DR1 (or at an upper position) with respect to the anode electrodes AE1, AE2, and AE3. In other words, the 21-th unit pixel PX_G21 may be approximately symmetrical with the 11-th unit pixel PX_G11 in the vertical direction.

Disposition of the first to third pixel circuits PXC1_1, PXC1_2, and PXC1_3 and the anode electrodes AE1, AE2, and AE3 of the 21-th unit pixel PX_G21 may be substantially equal to that of the first to third pixel circuits PXC1_1, PXC1_2, and PXC1_3 and the anode electrodes AE1, AE2, and AE3 of the 11-th unit pixel PX_G11.

However, the first to third pixel circuits PXC1_1, PXC1_2, and PXC1_3 of the 11-th unit pixel PX_G11 may be disposed at a lower position with respect to the anode electrodes AE1, AE2, and AE3 (or the emission area in which the anode electrodes AE1, AE2, and AE3 are disposed) of the 11-th unit pixel PX_G11. The first to third pixel circuits PXC1_1, PXC1_2, and PXC1_3 of the 21-th unit pixel PX_G21 may be disposed at an upper position with respect to the anode electrodes AE1, AE2, and AE3 of the 21-th unit pixel PX_G21. The first to third pixel circuits PXC1_1, PXC1_2, and PXC1_3 of the 21-th unit pixel PX_G21 may be adjacent to the first to third pixel circuits PXC1_1, PXC1_2, and PXC1_3 of the 11-th unit pixel PX_G11. In other words, the first to third pixel circuits PXC1_1, PXC1_2, and PXC1_3 of the 11-th unit pixel PX_G11 and the first to third pixel circuits PXC1_1, PXC1_2, and PXC1_3 of the 21-th unit pixel PX_G21 may be provided in an area between the second reference line L_REF2 and a fourth reference line L_REF4.

The first to third pixel circuits PXC1_1, PXC1_2, and PXC1_3 of the 22-th unit pixel PX_G22 may be disposed at an upper position with respect to the anode electrodes AE1, AE2, and AE3 (or the emission area in which the anode electrodes AE1, AE2, and AE3 are disposed) of the 22-th unit pixel PX_G22. The test circuit PXC2 of the 22-th unit pixel PX_G22 may be disposed to the left of the anode electrodes AE1, AE2, and AE3 of the 22-th unit pixel PX_G22. In other words, the 22-th unit pixel PX_G22 may have a structure obtained by rotating the 11-th unit pixel PX_G11 to 180 degrees in a plan view.

The 22-th unit pixel PX_G22 may share, with the 12-th unit pixel PX_G12, a first circuit area in which the first to third pixel circuits PXC1_1, PXC1_2, and PXC1_3 are disposed, and may share, with the 21-th unit pixel PX_G21, a second circuit area in which the test circuit PXC2 is disposed.

As described with reference to FIG. 17, some (e.g., unit pixels included in the same column) of the unit pixels PX_G11, PX_G12, PX_G21, and PX_G22 may include pixel circuits PXC1_1, PXC1_2, and PXC1_3 disposed in different directions with respect to the corresponding anode electrodes AE1, AE2, and AE3 (or the emission area), and may share the corresponding first circuit area in which the pixel circuits PXC1_1, PXC1_2, and PXC1_3 are disposed.

Likewise, some (e.g., unit pixels included in the same row) of the unit pixels PX_G11, PX_G12, PX_G21, and PX_G22 may include the respective test circuits PXC2 disposed in different directions with respect to the corresponding anode electrodes AE1, AE2, and AE3 (or the emission area), and may share the corresponding second circuit area in which the test circuit PXC2 is disposed.

Figure 18:
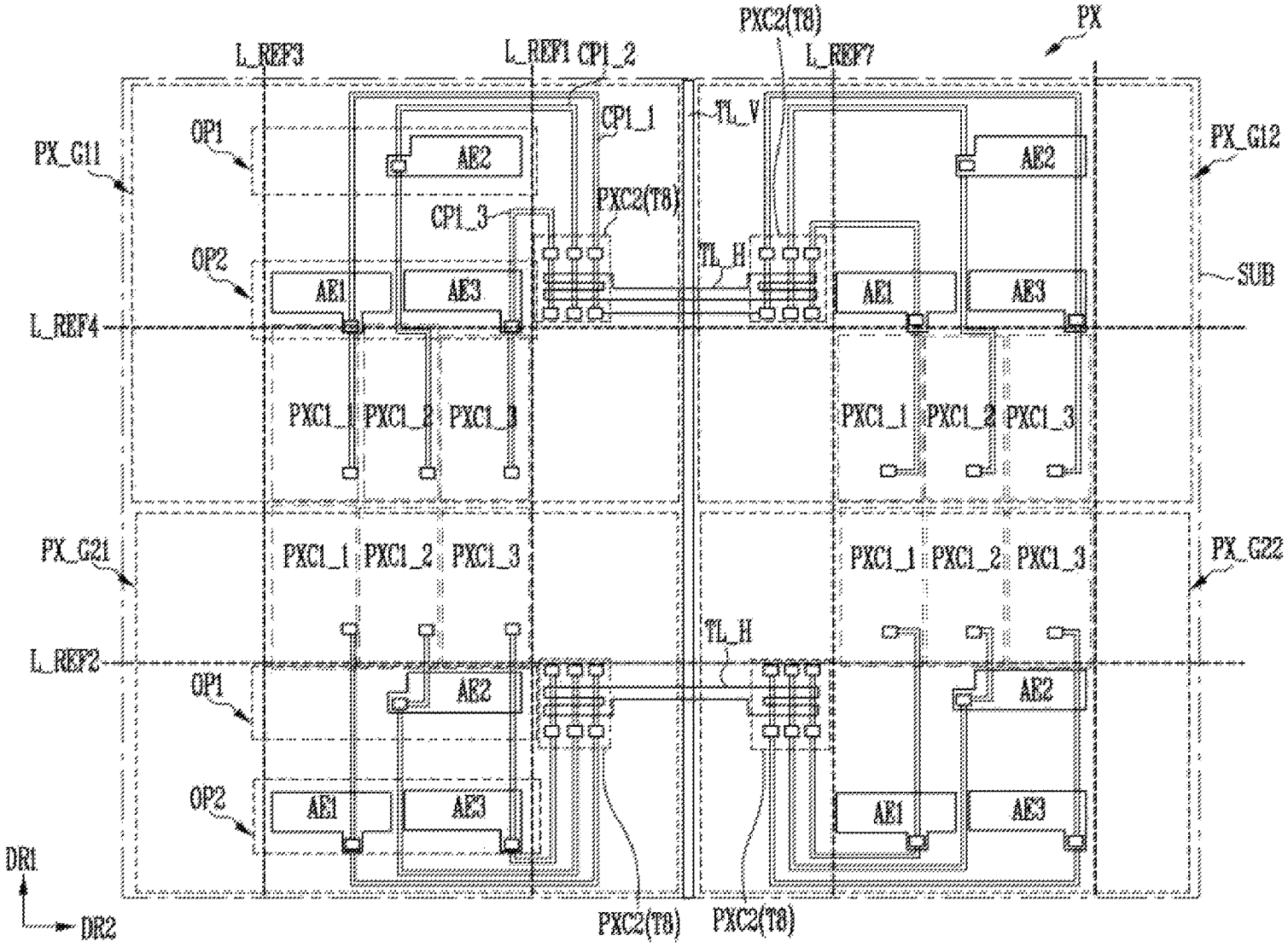
FIG. 18 is a plan view illustrating pixels included in the display device of FIG. 1B in accordance with an exemplary embodiment.

FIG. 18 is a plan view illustrating pixels PX included in the display device 10 of FIG. 1B in accordance with an exemplary embodiment. FIG. 18 is a diagram corresponding to that of FIG. 17.

Referring to FIGS. 17 and 18, the unit pixels PX_G11, PX_G12, PX_G21, and PX_G22 of FIG. 18, other than the first to third sub-bridge patterns CP1_1, CP1_2, and CP1_3, may be substantially equal to or similar to the unit pixels PX_G11, PX_G12, PX_G21, and PX_G22 of FIG. 17. Therefore, repetitive explanation thereof will be omitted.

In the 11-th unit pixel PX_G11, the first sub-bridge pattern CP1_1 may extend from the first pixel circuit PXC1_1 in the first direction DR1, be coupled to the first anode electrode AE1 disposed in the second opening OP2 (or form the first anode electrode AE1), extend in the second direction DR2 via the emission area, and be coupled to the test circuit PXC2. In other words, the first sub-bridge pattern CP1_1 may extend across or via the emission area in which the anode electrodes AE1, AE2, and AE3 are disposed, rather than extending via the peripheral area.

In this case, the test circuit PXC2 may be coupled to the first anode electrode AE1 through a path independent from a connection path of the first pixel circuit PXC1_1, so that the first pixel circuit PXC1_1 may be protected from static electricity through the first anode electrode AE1.

Likewise, the second sub-bridge pattern CP1_2 and the third sub-bridge pattern CP1_3 may be coupled to the test circuit PXC2 across or via the emission area.

In the 12-th unit pixel PX_G12, the 21-th unit pixel PX_G21, and the 22-th unit pixel PX_G22, disposition of the first to third sub-bridge patterns CP1_1, CP1_2, and CP1_3 are similar to the disposition of the first to third sub-bridge patterns CP1_1, CP1_2, and CP1_3 in the 11-th unit pixel PX_G11 (i.e., the disposition scheme in which the first to third sub-bridge patterns CP1_1, CP1_2, and CP1_3 extend across the emission area); therefore, repetitive explanation thereof will be omitted.

As described with reference to FIG. 18, the sub-bridge patterns CP1_1, CP1_2, and CP1_3 connecting the anode electrodes AE1, AE2, and AE3 and the test circuit PXC2 may be dispose across or via the emission area rather than extending via the peripheral area.

Figure 19:
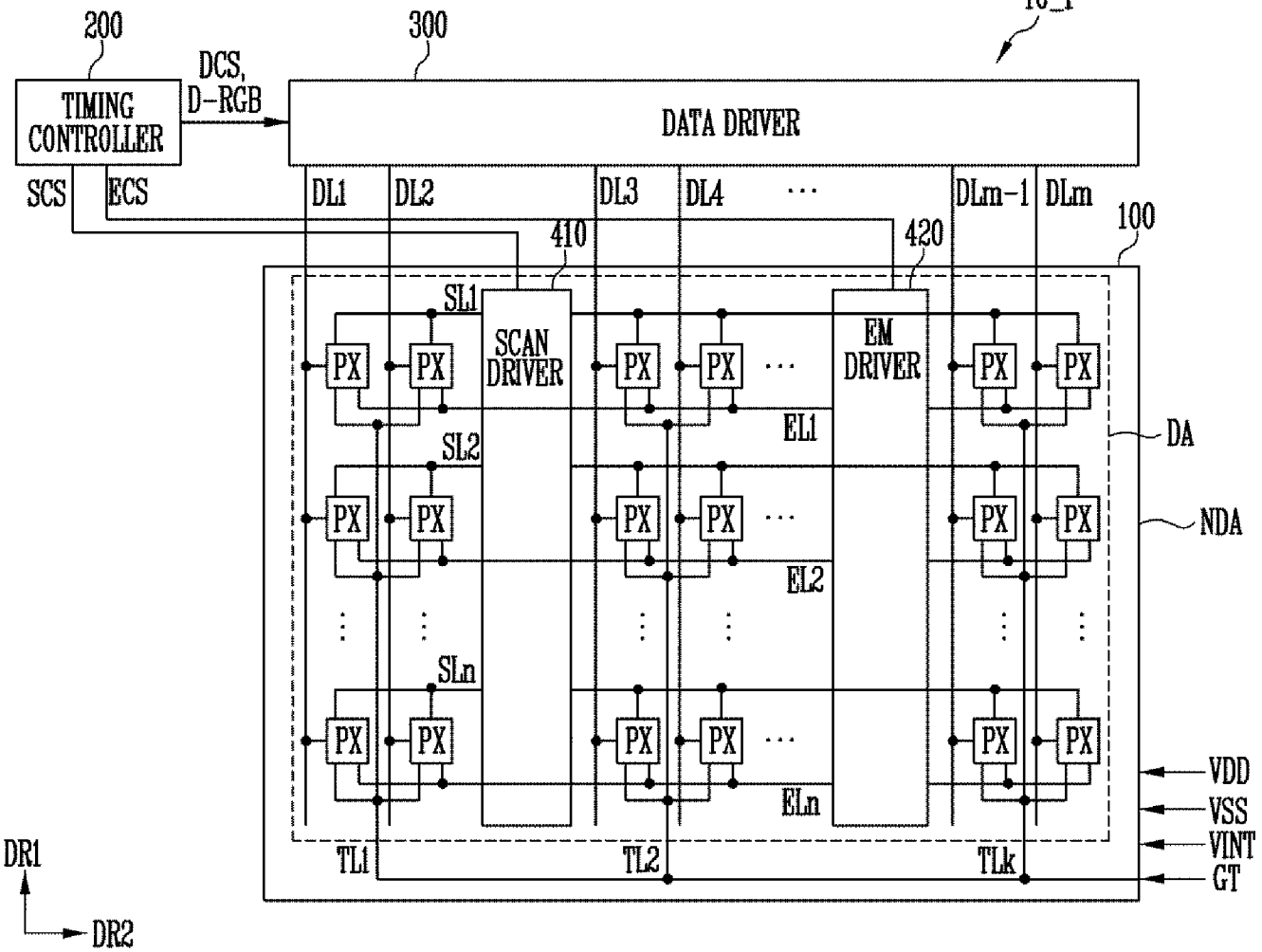
FIG. 19 is a diagram illustrating a display device in accordance with an exemplary embodiment of the present disclosure.

FIG. 19 is a diagram illustrating a display device 10_1 in accordance with an exemplary embodiment of the present disclosure.

Referring to FIG. 19, the display device 10_1 may include a display panel 100, a timing controller 200, a data driver 300, a scan driver 410, and an emission driver 420. The display device 10_1, other than the scan driver 410 and the emission driver 420, may be substantially equal to or similar to the display device 10 described with reference to FIG. 1B. Therefore, repetitive explanation thereof will be omitted.

The display panel 100 may include a display area DA on which an image is displayed, and a non-display area NDA excluded from the display area DA. The non-display area NDA may be disposed on one side of the display area DA or formed to enclose the display area DA, but it is not limited thereto.

The display panel 100 may include signal lines and pixels PX. The signal lines may include data lines DL1 to DLm, scan lines SL1 to SLn, emission control lines EL1 to ELn, and test lines TL1 to TLk (here, k is a positive integer). The pixel PX, the data lines DL1 to DLm, the scan lines SL1 to SLn, and the emission control lines EL1 to ELn may be substantially equal to or similar to the pixel PX, the data lines DL1 to DLm, the scan lines SL1 to SLn, and the emission control lines EL1 to ELn described with reference to FIG. 1B. Therefore, repetitive explanation thereof will be omitted.

The test lines TL1 to TLk may extend in the first direction DR1 and be repeatedly disposed along the second direction DR2. Each of the test lines TL1 to TLk may be coupled to pixels PX (or unit pixels described with reference to FIG. 18) included in two columns. The test lines TL1 to TLk may be electrically coupled to each other and receive gate signals GT from an external device (e.g., a test device that is used to perform a test on the display panel 100).

The timing controller 200 may generate a scan control signal SCS and an emission control signal ECS based on a control signal provided from an external device (e.g., a graphic processor). The scan control signal SCS may be a signal for controlling the operation of the scan driver 410, and include a start signal (or a scan start signal), clock signals (or scan clock signals), etc. The emission control signal ECS may be a signal for controlling the operation of the emission driver 420, and include a start signal (or an emission start signal), clock signals (or emission clock signals), etc.

The scan driver 410 may generate a scan signal based on the scan control signal SCS and provide the scan signal to the scan lines SL1 to SLn.

In embodiments, the scan driver 410 may be disposed in the display area DA of the display panel 100. For example, the scan driver 410 may be disposed between pixel columns adjacent to one side (e.g., the left side) of the display panel 100 and be formed along with the pixel circuits of the pixels PX.

The emission driver 420 may generate an emission control signal based on the emission control signal ECS and provide the generated emission control signal to the emission control lines EL1 to ELn.

In embodiments, the emission driver 420 may be disposed in the display area DA of the display panel 100. For example, the emission driver 420 may be disposed between pixel columns adjacent to another side (e.g., the right side) of the display panel 100 and be formed along with the pixel circuits of the pixels PX.

More detailed description of the scan driver 410 and the emission driver 420 will be made with reference to FIG. 20.

Figure 20:
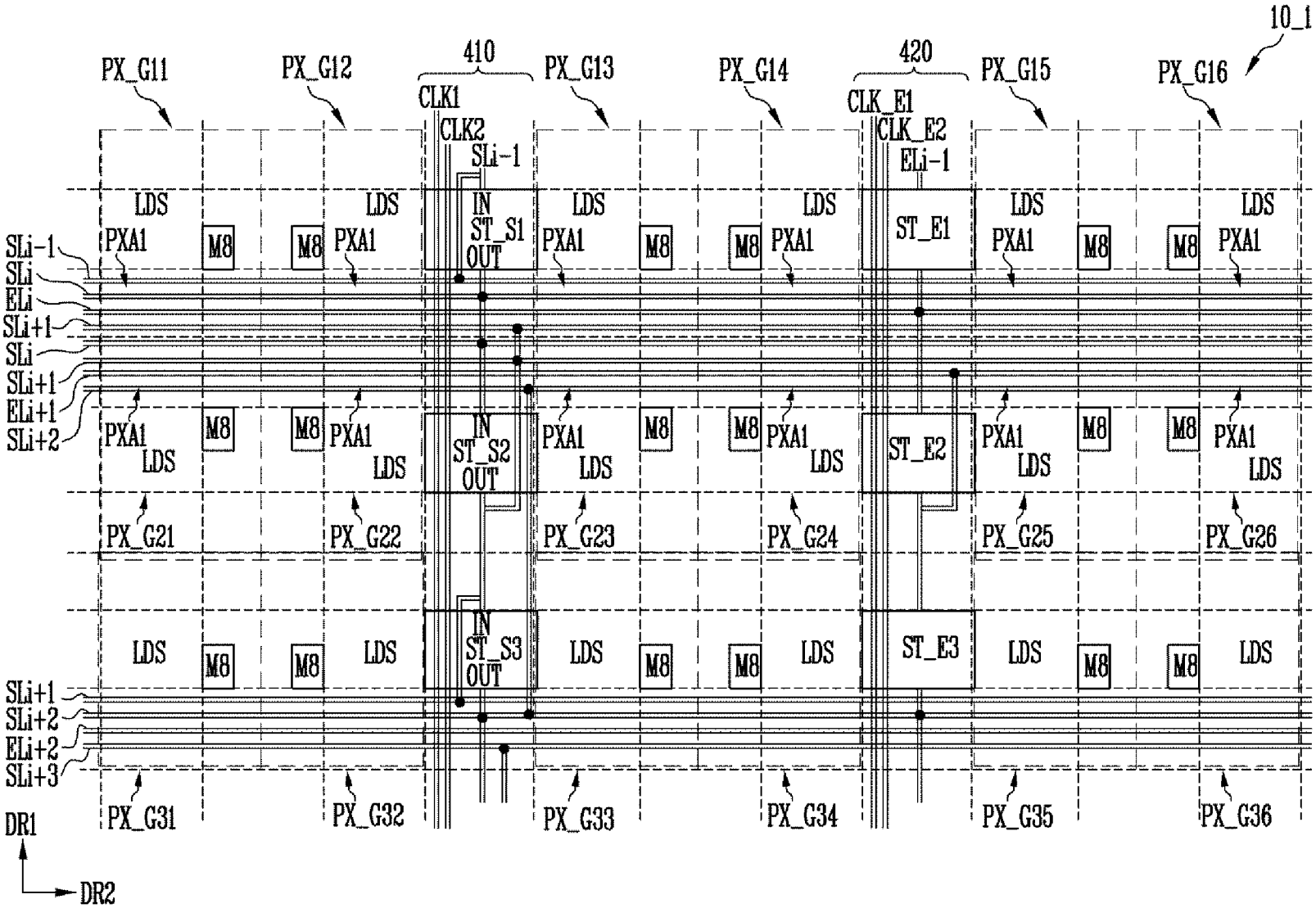
FIG. 20 is a plan view illustrating an example of the display device of FIG. 19.

FIG. 20 is a plan view illustrating an example of the display device 10_1 of FIG. 19. FIG. 20 schematically illustrates the display device 10_1, focused on the unit pixels described with reference to FIG. 17.

Referring to FIGS. 19 and 20, the display device 10_1 may include unit pixels PX_G11 to PX_G16, PX_G21 to PX_G26, and PX_G31 to PX_G36. Each of the unit pixels PX_G11 to PX_G16, PX_G21 to PX_G26, and PX_G31 to PX_G36 may include light emitting elements LDS disposed in areas separated from each other, a pixel circuit PXA1, and a test circuit (or an eighth transistor M8). Here, the light emitting elements LDS may include first to third light emitting elements LD1, LD2, and LD3 described with reference to FIG. 16D. The pixel circuit PXA1 may include first to third pixel circuits PXC1_1, PXC1_2, and PXC1_3 described with reference to FIG. 17.

Each of the unit pixels PX_G11 to PX_G16, PX_G21 to PX_G26, and PX_G31 to PX_G36 may be the same as the unit pixel PX_G described with reference to FIGS. 16A and 16B and any one of the unit pixels PX_G11, PX_G12, PX_G21, and PX_G22 described with reference to FIG. 17; therefore, repetitive explanation thereof will be omitted.

The display device 10_1 may include clock signal lines CLK1 and CLK2 and emission clock signal lines CLK_E1 and CLK_E2. The clock signal lines CLK1 and CLK2 may extend in the first direction DR1 and be disposed between adjacent unit pixels. For example, the clock signal lines CLK1 and CLK2 may be disposed between the 12-th unit pixel PX_G12 and the 13-th unit pixel PX_G13 (or in the peripheral area between the 12-th unit pixel PX_G12 and the 13-th unit pixel PX_G13). The clock signal lines CLK1 and CLK2 may transmit clock signals.

The scan driver 410 may be disposed between adjacent unit pixels. For example, in response to the clock signal lines CLK1 and CLK2, the scan driver 410 may be disposed between the 12-th unit pixel PX_G12 and the 13-th unit pixel PX_G13 (or in the peripheral area between the 12-th unit pixel PX_G12 and the 13-th unit pixel PX_G13).

The scan driver 410 may include scan stages ST_S1, ST_S2, and ST_S3. Each of the scan stages ST_S1, ST_S2, and ST_S3 may generate a scan signal corresponding to an output signal (or a carry signal or a start signal) of a preceding stage using clock signals transmitted through the clock signal lines CLK1 and CLK2.

The first scan stage ST_S1 may be disposed in the peripheral area between the light emitting elements LDS of the 12-th unit pixel PX_G12 and the light emitting elements LDS of the 13-th unit pixel PX_G13. An input terminal IN of a first scan stage ST_S1 may be coupled to an i−1-th scan line SLi−1 (or a preceding scan line). An output terminal OUT of the first scan stage ST_S1 may be coupled to an i-th scan line SLi.

Likewise, the second scan stage ST_S2 may be disposed in the peripheral area between the light emitting elements LDS of the 22-th unit pixel PX_G22 and the light emitting elements LDS of the 23-th unit pixel PX_G23. The third scan stage ST_S3 may be disposed in the peripheral area between the light emitting elements LDS of the 32-th unit pixel PX_G32 and the light emitting elements LDS of the 33-th unit pixel PX_G33. Connection relationship between the second and third scan stages ST_S2 and ST_S3 and the scan lines SLi, SLi+1, SLi+2, and SLi+3 may be substantially equal to or similar to the connection relationship between the first scan stage ST_S1 and the scan lines SLi−1, SLi, and SLi+1; therefore, repetitive explanation thereof will be omitted.

The emission driver 420 may include emission stages ST_E1, ST_E2, and ST_E3. Each of the emission stages ST_E1, ST_E2, and ST_E3 may generate an emission signal corresponding to an output signal (or an emission carry signal or an emission start signal) of a preceding emission stage using emission clock signals transmitted through the emission clock signal lines CLK_E1 and CLK_E2.

The first emission stage ST_E1 may be disposed in the peripheral area between the light emitting elements LDS of the 14-th unit pixel PX_G14 and the light emitting elements LDS of the 15-th unit pixel PX_G15. The first emission stage ST_E1 may receive a preceding emission control signal through an i−1-th emission control line ELi−1 and output an emission control signal to an i-th emission control line ELi.

Likewise, the second emission stage ST_E2 may be disposed in the peripheral area between the light emitting elements LDS of the 24-th unit pixel PX_G24 and the light emitting elements LDS of the 25-th unit pixel PX_G25. The third emission stage ST_E3 may be disposed in the peripheral area between the light emitting elements LDS of the 34-th unit pixel PX_G34 and the light emitting elements LDS of the 35-th unit pixel PX_G35.

As described with reference to FIGS. 19 and 20, the scan driver 410 and the emission driver 420 may be disposed in the display area DA of the display panel 100. Since the test circuits of two unit pixels among the unit pixels PX_G11 to PX_G16, PX_G21 to PX_G26, and PX_G31 to PX_G36 are disposed adjacent to each other in one peripheral area, the scan driver 410 and the emission driver 420 may be disposed in a portion of the peripheral area other than a portion in which the test circuits are disposed. Therefore, the non-display area NDA formed around the perimeter of the display area DA of the display device 10_1 may be reduced, so that dead space of the display device 10_1 may be reduced.

In a display panel and a method of testing the display panel in accordance with an exemplary embodiment of the present disclosure, a transistor coupled in parallel to a light emitting element is provided so that a defect test may be performed on an entire pixel circuit.

Furthermore, an auxiliary transistor is disposed in a separate area spaced apart from an area in which the light emitting element and the pixel circuit configured to provide driving current to the light emitting element are disposed. Hence, the auxiliary transistor and the pixel circuit may be prevented or suppressed from being damaged during a process of mounting the light emitting element.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A method of testing a display panel comprising a pixel coupled to a first power line, a second power line, a third power line, a data line, scan lines, an emission control line, and a test line, the method comprising:

applying a first power supply voltage and a second power supply voltage to the first power line and the second power line, respectively;

applying a test voltage having a turn-on voltage level to the third power line;

applying, by a scan driver, a scan signal having a turn-on voltage level sequentially to the scan lines and an emission control signal having a turn-on voltage level to the emission control line;

applying, through the test line, a gate signal having a turn-on voltage level to a test transistor coupled between a first pixel electrode and a second pixel electrode of a light emitting element included in the pixel;

measuring a sensing voltage output through the data line; and determining whether the pixel is defective, based on a voltage level of the sensing voltage measured through the data line.

2. The method according to claim 1, wherein the pixel comprises:

a first transistor comprising a first electrode coupled to a first node, a second electrode coupled to a second node, and a gate electrode coupled to a third node;

a second transistor comprising a first electrode coupled to the data line, a second electrode coupled to the first node, and a gate electrode coupled to a first scan line;

a third transistor comprising a first electrode coupled to the second node, a second electrode coupled to the third node, and a gate electrode coupled to the first scan line;

a fourth transistor comprising a first electrode coupled to the third power line, a second electrode coupled to the third node, and a gate electrode coupled to a second scan line;

a fifth transistor comprising a first electrode coupled to the first power line, a second electrode coupled to the first node, and a gate electrode coupled to the emission control line;

a sixth transistor comprising a first electrode coupled to the second node, a second electrode coupled to a fourth node, and a gate electrode coupled to the emission control line;

a seventh transistor comprising a first electrode coupled to the third power line, a second electrode coupled to the fourth node, and a gate electrode coupled to a third scan line; and a capacitor coupled between the first power line and the third node, wherein the light emitting element is coupled between the fourth node and the second power line.

3. The method according to claim 2, wherein the scan signal is sequentially provided to the second scan line, the first scan line, and the third scan line.

4. The method according to claim 3, wherein the scan signal having one pulse is applied during each frame period.

5. The method according to claim 3, wherein the applying of the scan signal and the emission control signal comprises:

applying, during a first period, a scan signal having a turn-on voltage level to the second scan line; and applying, during a second period, a scan signal having a turn-on voltage level to the first scan line, an emission control signal having a turn-on voltage level to the emission control line, and a gate signal having a turn-on voltage level to the test line.

6. The method according to claim 5, wherein the applying of the scan signal and the emission control signal further comprises:

turning on, during the second period, the fifth transistor, the first transistor, the sixth transistor, and the test transistor.

7. The method according to claim 6, wherein the sensing voltage is formed at the first node proportional to each of a turn-on resistance of the first transistor, a turn-on resistance of the sixth transistor, and a turn-on resistance of the test transistor, and is inversely proportional to a turn-on resistance of the fifth transistor.

8. The method according to claim 2, wherein the determining of the pixel being defective comprises determining that the sixth transistor is defective in response to the voltage level of the sensing voltage being equal to or less than a reference voltage level.

9. The method according to claim 2, further comprising, before the applying of the first power supply voltage and the second power supply voltage, applying a test voltage having a turn-on voltage level to the third power line;

applying, by a scan driver, a scan signal having a turn-on voltage level sequentially to the scan lines and an emission control signal having a turn-off voltage level to the emission control line;

measuring a second sensing voltage output through the data line; and determining whether the first to fourth transistors are defective based on the second sensing voltage.

10. The method according to claim 2, wherein the applying of the first power supply voltage and the second power supply voltage comprises:

applying the first power supply voltage to the first power line;

applying a test voltage having a turn-off voltage level to the third power line;

applying, by a scan driver, a scan signal having a turn-on voltage level sequentially to the scan lines and an emission control signal having a turn-on voltage level to the emission control line;

measuring a third sensing voltage output through the data line; and determining whether the fifth transistor is defective based on the third sensing voltage.

11. A method of testing a display panel comprising a pixel coupled to a first power line, a second power line, a third power line, a data line, scan lines, an emission control line, and a test line, the method comprising:

applying a first power supply voltage to the first power line;

applying a test voltage having a turn-on voltage level to the second power line;

applying, through the test line, a gate signal having a turn-on voltage level to a test transistor coupled between a first pixel electrode and a second pixel electrode of a light emitting element included in the pixel;

applying, by a scan driver, a scan signal having a turn-on voltage level sequentially to the scan lines and an emission control signal having a turn-on voltage level to the emission control line;

measuring a sensing voltage output through the data line; and determining whether the pixel is defective, based on a voltage level of the sensing voltage.

12. The method according to claim 11, wherein the pixel comprises:

a first transistor comprising a first electrode coupled to a first node, a second electrode coupled to a second node, and a gate electrode coupled to a third node;

a second transistor comprising a first electrode coupled to the data line, a second electrode coupled to the first node, and a gate electrode coupled to a first scan line;

a third transistor comprising a first electrode coupled to the second node, a second electrode coupled to the third node, and a gate electrode coupled to the first scan line;

a fourth transistor comprising a first electrode coupled to the third power line, a second electrode coupled to the third node, and a gate electrode coupled to a second scan line;

a fifth transistor comprising a first electrode coupled to the first power line, a second electrode coupled to the first node, and a gate electrode coupled to the emission control line;

a sixth transistor comprising a first electrode coupled to the second node, a second electrode coupled to a fourth node, and a gate electrode coupled to the emission control line;

a seventh transistor comprising a first electrode coupled to the third power line, a second electrode coupled to the fourth node, and a gate electrode coupled to a third scan line; and a capacitor coupled between the first power line and the third node, wherein the light emitting element is coupled between the fourth node and the second power line.

13. The method according to claim 12, wherein the scan signal is sequentially provided to the second scan line, the first scan line, and the third scan line.

14. The method according to claim 13, wherein the scan signal having two pulses is applied during each frame period.

15. The method according to claim 14, wherein the gate signal having one pulse in a section between two pulses is applied during each frame period.

16. The method according to claim 13, wherein the applying of the scan signal and the emission control signal comprises:

applying, during a first period, a scan signal having a turn-on voltage level to the second scan line and the third scan line, and a gate signal having a turn-on voltage level to the test line; and applying, during a second period, a scan signal having a turn-on voltage level to the first scan line.

17. The method according to claim 12, wherein the determining of the pixel being defective comprises determining that the seventh transistor is defective in response to the voltage level of the sensing voltage being equal to or less than a reference voltage level.

18. The method according to claim 12, further comprising, before the applying of the first power supply voltage, applying a test voltage having a turn-on voltage level to the third power line;

applying, by a scan driver, a scan signal having a turn-on voltage level sequentially to the scan lines and an emission control signal having a turn-off voltage level to the emission control line;

measuring a second sensing voltage output through the data line; and determining whether the first to fourth transistors are defective based on the second sensing voltage.

19. A display panel comprising:

first, second, third, and fourth scan lines;

a data line;

an emission control line a first power line;

a second power line;

a third power line; and a pixel comprising:

a first transistor comprising a first electrode coupled to a first node, a second electrode coupled to a second node, and a gate electrode coupled to a third node;

a second transistor comprising a first electrode coupled to the data line, a second electrode coupled to the first node, and a gate electrode coupled to a first scan line;

a third transistor comprising a first electrode coupled to the second node, a second electrode coupled to the third node, and a gate electrode coupled to the first scan line;

a fourth transistor comprising a first electrode coupled to the third power line, a second electrode coupled to the third node, and a gate electrode coupled to a second scan line;

a fifth transistor comprising a first electrode coupled to the first power line, a second electrode coupled to the first node, and a gate electrode coupled to the emission control line;

a sixth transistor comprising a first electrode coupled to the second node, a second electrode coupled to a fourth node, and a gate electrode coupled to the emission control line;

a seventh transistor comprising a first electrode coupled to the third power line, a second electrode coupled to the fourth node, and a gate electrode coupled to a third scan line;

an eighth transistor comprising a first electrode coupled to the fourth node, a second electrode coupled to the second power line, and a gate electrode coupled to the fourth scan line;

a storage capacitor coupled between the first power line and the third node; and a light emitting element coupled between the fourth node and the second power line.

20. A display panel comprising:

data lines extending in a first direction;

scan lines extending in a second direction intersecting the first direction; and a unit pixel coupled to the data lines and the scan lines, the unit pixel comprising a first pixel, a second pixel, a third pixel, and a fourth pixel disposed adjacent to each other in the first direction and the second direction, wherein each of the first to fourth pixels comprises:

a light emitting element provided in an emission area;

a pixel circuit provided in a first circuit area, the pixel circuit comprising a sub-pixel circuit configured to respectively provide driving current to the light emitting element; and a test circuit provided in a second circuit area, the test circuit comprising auxiliary transistors coupled in parallel to the light emitting element.

21. The display panel according to claim 20, wherein the first circuit area is disposed between emission areas of two pixels adjacent in the first direction, wherein the second circuit area is disposed between emission areas of two pixels adjacent in the second direction, and wherein the sub-pixel circuit comprises at least one transistor coupled to the scan lines and the data lines.

22. The display panel according to claim 21, further comprising a scan driver coupled to the scan lines and configured to provide a scan signal to the scan lines, and wherein the scan driver is disposed between two unit pixels adjacent to each other in the second direction.

* * * * *